US012459620B2

(12) United States Patent
Afman et al.

(10) Patent No.: US 12,459,620 B2
(45) Date of Patent: Nov. 4, 2025

(54) SYSTEM FOR AND METHOD OF CONTROLLING WATERCRAFT

(71) Applicant: Yamaha Hatsudoki Kabushiki Kaisha, Shizuoka (JP)

(72) Inventors: Juan-Pablo Afman, Marietta, GA (US); Thomas Gurriet, Acworth, GA (US); Jun Otsu, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 206 days.

(21) Appl. No.: 17/655,962

(22) Filed: Mar. 22, 2022

(65) Prior Publication Data

US 2022/0306257 A1 Sep. 29, 2022

Related U.S. Application Data

(60) Provisional application No. 63/210,878, filed on Jun. 15, 2021, provisional application No. 63/165,025, filed on Mar. 23, 2021.

(51) Int. Cl.

| | |
|---|---|
| ***B63H 20/12*** | (2006.01) |
| ***B63H 20/00*** | (2006.01) |
| ***B63H 25/02*** | (2006.01) |
| ***B63H 25/42*** | (2006.01) |

(52) U.S. Cl.

CPC ..... *B63H 20/12* (2013.01); *B63H 25/02* (2013.01); *B63H 25/42* (2013.01); *B63H 2020/003* (2013.01); *B63H 2025/026* (2013.01)

(58) Field of Classification Search

CPC ..... B63H 20/12; B63H 25/02; B63H 25/42; B63H 2020/003; B63H 2025/026

See application file for complete search history.

(56) References Cited

U.S. PATENT DOCUMENTS

| | | | | |
|---|---|---|---|---|
| 9,545,987 | B1 | 1/2017 | Przybyl et al. | |
| 9,932,098 | B1 * | 4/2018 | Andrasko | G05D 1/0206 |
| 10,377,458 | B1 * | 8/2019 | McGinley | G05D 1/0206 |
| 10,661,872 | B1 * | 5/2020 | Ito | B63H 20/12 |
| 10,766,589 | B1 | 9/2020 | Ito | |
| 2007/0093147 | A1 * | 4/2007 | Mizutani | B63H 25/02 440/1 |
| 2008/0113570 | A1 * | 5/2008 | Kaji | B63H 25/42 440/1 |

(Continued)

FOREIGN PATENT DOCUMENTS

| | | |
|---|---|---|
| JP | 2014-76761 | 5/2014 |

OTHER PUBLICATIONS

Maneouvring with Azipods—turning in independent mode, by ISSIMS, Nov. 28, 2020, retrieved from https://www.youtube.com/watch?v=DhGYpgm-NOM&list=PLPBYnZT7aF1sMtBp-UIZ-MukVvX1_bsNP&index=2.*

(Continued)

*Primary Examiner* — Donald J Wallace
*Assistant Examiner* — Henry R Hinton
(74) *Attorney, Agent, or Firm* — Knobbe, Martens, Olson & Bear LLP

(57) ABSTRACT

A remote control system for a watercraft can provide various modes of joystick propulsion control including cruise control, sub-idle watercraft speed operation, composite lateral propulsion, and shiftless docking maneuvers. The system can be used with outboard motors having 360-degree rotatable lower units.

43 Claims, 19 Drawing Sheets

(56) References Cited

U.S. PATENT DOCUMENTS

| | | | | |
|---|---|---|---|---|
| 2011/0166724 | A1 | 7/2011 | Hiramatsu | |
| 2011/0188938 | A1* | 8/2011 | Nedwed | B63B 35/08 114/40 |
| 2014/0046515 | A1 | 2/2014 | Mitzutani | |
| 2015/0072575 | A1* | 3/2015 | Mizutani | B63H 20/12 440/1 |
| 2015/0166159 | A1* | 6/2015 | Inoue | B63H 20/12 440/53 |
| 2015/0246714 | A1 | 9/2015 | Morikawa et al. | |
| 2017/0232944 | A1* | 8/2017 | Owen | B60T 7/12 701/94 |
| 2018/0057132 | A1 | 3/2018 | Ward et al. | |
| 2019/0118922 | A1* | 4/2019 | McGinley | B63H 25/42 |
| 2023/0150637 | A1 | 5/2023 | Afman | |

OTHER PUBLICATIONS

Maneouvring with Azipods—speed control in independent mode, by ISSIMS, Nov. 28, 2020, retrieved from https://www.youtube.com/watch?v=2cNzA4ac8JQ&list=PLPBYnZT7aF1sMtBp-UIZ-MukVvX1_bsNP&index=3 on Jan. 30, 2024.*

Shiphandling With Azumuthing Podded Propulsors, by Alper Tunga Aniker, pp. 6, 154-164, Jan. 2015, retrieved from https://books.google.com/books?id=jiRGEAAAQBAJ&pg=PA154&lpg=PA154&dq=how+to+control+maneuver+azipod&source=bl&ots=zjpvb9w16g&sig=ACfU3U2tpZArSKbguNXXAkzvjGOq9TPkng&hl=en&sa=X&ved=2ahUKEwiAl57ixYW.*

Bluenav, "BlueSpin Retractable Motor," web printout from https://bluenav.com/hybrid/, printed Dec. 6, 2022.

Bluenav, "Hybrid and electric motorizations for boats," flyer downloaded from https://bluenav.com/wp-content/uploads/2022/09/Flyers_BLUENAV.pdf, downloaded Dec. 6, 2022.

* cited by examiner

FIG. 4B1

SYSTEM FOR AND METHOD OF CONTROLLING WATERCRAFT

CROSS-REFERENCE TO RELATED APPLICATIONS

This application claims priority to U.S. Provisional Patent Application No. 63/165,025, filed Mar. 23, 2021, and U.S. Provisional Patent Application No. 63/210,878, filed Jun. 15, 2021, the entire contents of which are hereby incorporated by reference herein in their entirety and for all purposes.

BACKGROUND OF THE INVENTIONS

Field of the Inventions

The present inventions relate to systems and methods of controlling a watercraft, for example, with multiple outboard motors.

Description of the Related Art

A type of control method that controls the magnitude and direction of a thrust generated by each of a plurality of outboard motors so as to turn the bow of a watercraft has been known. For example, a control device for outboard motors described in U.S. Pat. No. 10,766,589 controls right and left outboard motors in accordance with movements of a joystick, including twisting. Specifically, when the joystick is twisted rightward, the control device causes the outboard motor disposed on the port side to generate a thrust for forward movement, and simultaneously, causes the outboard motor disposed on the starboard side to generate a thrust for rearward movement. Thus, the watercraft turns the bow rightward due to difference in forces between the right and left outboard motors.

The control device disclosed in U.S. Pat. No. 10,766,589 can also be used to move the watercraft forward (or rearward) while turning the bow of the watercraft. In such a situation, the operator can push the joystick forward or rearward and also simultaneously twist the joystick rightward or leftward. The control device controls the throttle position, steering angle, and gear selection (forward or reverse) to generate a movement corresponding to the operator's movement of the joystick. Further, the control system of U.S. Pat. No. 10,766,589 also provides for sideways or lateral movements of a watercraft. For example, when an operator moves the joystick rightward or leftward, the control system puts one of the outboard motors in a forward gear and the other outboard motor in a rearward gear and adjusts the steering angles and throttles appropriately to cause a leftward or rearward lateral movement of the watercraft. In this mode of operation, the steering angles of the outboard motors are nonparallel and pass through the center of pressure of the watercraft to avoid creating any torque on the watercraft and thus resulting only in a net lateral thrust direction. In some modes of operation, this control system returns the gear position of both outboard motors to neutral when the joystick is released. Further, when the joystick is subsequently moved, the control system automatically changes the gear position of each outboard motor to forward or reverse, to effect the movement corresponding to the operator's manipulation of the joystick.

SUMMARY OF THE INVENTIONS

An aspect of at least one of the inventions disclosed herein includes the realization that outboard motors with larger ranges of steering angle adjustment can be controlled in such as manner as to provide a shiftless maneuvering mode of operation. For example, conventional outboard motors that are mounted to a watercraft so as to be steerable about a steering axis, typically have a steering range of approximately 30 degrees (positive or negative) (e.g., 30 degrees to either side of straight ahead). The total range of movement can illustratively be approximated to a total of 60 degrees of a range of movement about the steering axis. As such, in order to produce the thrusts required for certain low-speed maneuvers, such as rotation or lateral movement, and no thrust, the outboard motors are shifted into and out of gear (forward or reverse) each time the operator releases the joystick so it return to the default position and each time the operator moves the joystick from the default position. As such, both outboard motors produce a shock or vibration that is both audible to the users of the boat and tactile in that the operators can feel the shock transmitted to the boat, for each gearshift. This effect is more pronounced on smaller vessels.

However, outboard motors that have an increased steering angle range, including an orientation in which the propellers can be oriented so as to generate thrust vectors that are directly opposed and thereby cancelled, can be operated in a manner so as to provide a shockless maneuvering mode.

More specifically, using such outboard motors can provide for a mode of operation in which the outboard motors are in a drive gear (e.g., forward gear) and oriented at directly opposed orientations so as to generate no net thrust when a joystick is in its default position, i.e., a position in which the user is not requesting any thrust. In this orientation, the outboard motors can both be running at idle speed, in forward gear, and thus generating equal but opposite thrusts, for a net zero thrust. When the user then manipulates the joystick, such as pushing the joystick directly forward, the outboard motors can be steered toward a partially or totally forward-pointing orientation, so as to produce a net forward thrust. Thus, the outboard motors switch from a mode in which they are producing no net thrust, to producing a net positive forward thrust, without the need for any gear changes, thereby avoiding the creation of any shocks or sounds normally associated with shifting an outboard motor from a neutral gear to forward or reverse.

Further, if the operator is holding the joystick in a forward position for generating forward thrust, then releases the joystick, the outboard motors can be steered from an orientation for a net forward thrust to a directly opposed orientation to generate a net zero thrust. Again, this allows the outboard motors to change from a mode of operation in which they are generating a net forward thrust to a net zero thrust, without the requirement to shift from a forward or reverse gear to neutral. This further avoids the creation of noise and shock associated with an outboard motor being shifted from a forward or reverse gear, to neutral.

In some embodiments, such a control system can be used with outboard motors that have a steering angle of at least about 180 degrees (measured as a positive value or a negative value and can further include some variation (e.g., +/−5 degrees). The total steering angle can illustratively be approximated as a range of 180 degrees to 360 degrees. Such a further enlarged steering angle range can support additional, shiftless changes in modes of operation. For example, but without limitation, outboard motors with such an increased steering angle range can be controlled in a shiftless manner to provide a reverse movement, sideways movement, as well as forward, reverse, and sideways movements with rotation.

In some embodiments, the outboard motors used with the present control system can be configured to provide for 360-degree steering angle ranges. In some embodiments, the upper unit of such outboard motors can be mounted to a watercraft in a fixed angular orientation (relative to a vertical axis) and include steerable lower units.

Thus, in accordance with some embodiments, a system for controlling a watercraft can include a left outboard motor on a port side of the watercraft, a right outboard motor on a starboard side of the watercraft, a left steering actuator configured to change a steering angle of the left outboard motor, a right steering actuator that is configured to change a steering angle of the right outboard motor, and a controller communicating with the left and right outboard motors and the left and right steering actuators. The controller can be configured to receive a forward thrust signal and a no-thrust signal, wherein the controller is configured to control the left and right steering actuators so as to adjust the steering angles of the left and right outboard motors to be in direct opposition to each other so as to produce a net zero thrust when the controller receives the no-thrust signal, and wherein the controller is configured to control the left and right steering actuators to adjust the steering angles of the left and right outboard motors so as to produce a net positive forward thrust, when the controller receives the forward thrust signal.

In some embodiments, a method of controlling a watercraft having left and right outboard motors and left and right steering actuators, can comprise receiving a no-thrust signal and a forward thrust signal. The method can also include controlling the left and right steering actuators, in response to receiving the no-thrust signal, so as to direct the steering angles of the left and right outboard motors to be in direct opposition thereby generating no substantial net thrust, and controlling the left and right steering actuators, in response to receiving the forward thrust signal, so as to adjust the steering angles of the left and right outboard motors to an orientation generating a net forward thrust.

Another aspect of at least one of the inventions disclosed herein includes the realization that a watercraft having outboard motors with 360° steerable lower units can benefit from a remote control system that provides different propulsion control modes, including a mode where the steering angles of the outboard motors are limited to less than 360°. For example, although the outboard motors may be capable of rotating the lower units 360°, for enhanced maneuvering control, with a joystick for example, it also may be beneficial or desirable to a user to provide a more convention propulsion mode as well. Thus, an aspect of at least one of the inventions disclosed herein includes the realization that a propulsion control system can include a steering wheel, throttle levers, and a joystick for controlling outboard motors that have 360° steerable capability. In a joystick maneuvering mode of operation, the control system can utilize the 360° rotatability of the motors to provide for enhanced maneuvering, such as docking, rotating, lateral movements, etc. Additionally, the control system can offer a more conventional steering mode in which the steering wheel angle input by a user is used to control the rudder angles of the outboard motors to a limited range of steering angles that is more common for conventional outboard motor steering, for example, to about 30° to the left and right sides. In such a mode of operation, optionally, the controller can control the throttle output and gear position of the outboard motors in a more conventional manner. Thus, the handling characteristics of the watercraft would feel more typical of conventional watercraft behavior and response when using the steering and throttle levers.

Another aspect of at least one of the inventions disclosed herein includes the realization that under a joystick control mode, a remote control system for multiple outboard motor powered watercraft can provide a more user-friendly and easier to use speed control technique for changing a speed of the watercraft in an integrative proportional or stepwise manner in which a thrust generated by the outboard motors is held when the joystick is released thereby providing a more convenient manner for speed control for the user. For example, the remote control system can be configured to operate in a thrust hold mode and detect and respond to "tapped" inputs into the joystick. One example would be if a user were to tap the joystick in the forward direction and the controller would, in response, increase the thrust generated by the outboard motors in a stepwise manner. The control system could control the outboard motors to provide one or more watercraft sub idle speed modes of operation and one or more super idle speed modes of operation.

In some embodiments, the system is configured for use with 360° steerable outboard motors. For example, the control system, in response to receiving an initial "tap" could orient the 360° steerable outboard motors into position in which the rudder angles of the outboard motors are pointed partially at each other, thereby cancelling some of the thrust generated by the outboard motors but producing a net positive forward thrust on the watercraft. In such a mode of operation, the watercraft would move at a forward speed that is less than the watercraft speed achievable with both outboard motors, parallel to the longitudinal axis of the watercraft with the engines operating at idle speed. Some such speed settings can be useful for trolling for example, and other low speed maneuvers.

With additional "taps" to the joystick, the controller can cycle through, optionally, additional orientations of the outboard motors providing additional sub idle watercraft speed modes, or, optionally, orient the outboard motor straight ahead and cycle through additional forward modes of operation in which the engine speed of the outboard motors is increased to provide higher, super idle watercraft speeds. In this "tapping" mode of operation, each time the joystick is tapped and released causes the controller to change the total amount of propulsion generated by the outboard motors and thereby changing the watercraft speed of the watercraft. Thus, the watercraft would continue to operate at speed without the user needing to hold the joystick in any particular position.

Optionally, in a different thrust hold mode of operation, the control system can be configured to integrate a detected position of the joystick and gradually and/or continuously change the thrust generated by the outboard motors at a predetermined rate of increase or proportional to the displacement of the joystick by the operator. For example, if the watercraft was at rest with the control system generating zero thrust and the user pushes the joystick forward to 60% of its full range of motion, the control system can integrate the detected position over time and gradually increase the thrust produced by the outboard motors from a zero thrust most towards a mode corresponding to the 60% actuation position. In such a mode of operation, the controller could first, change the rudder angles of the outboard motors through a range of orientations from being directly opposed to one another (in which they generate a zero net thrust on the watercraft) up through rudder angles in which the outboard motors are almost parallel to one another, which corresponds to a range of watercraft speeds that are less than a typical idle watercraft speed. After the outboard motors reach a fully parallel orientation, then the controller can further increase the thrust generated by increasing the output from the outboard motor engines, thereby for example, raising the engine speeds and thus the speed of the propellers. After the user releases the joystick allowing it to return to its default position, the control system can hold the power output of each outboard motor and their rudder angle to thereby continue to produce the thrust generated when the user released the joystick thereby, thereby providing a more convenient mode for using a joystick for propulsion control. To slow the watercraft, a user could tilt the joystick towards the rearward direct, in response to which the control system could gradually reduce the thrust produced by the outboard motors.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 4B1 is a schematic diagram showing control of the outboard motors in a first mode of forward movement.

DETAILED DESCRIPTION OF THE PREFERRED EMBODIMENTS

Figure 1:
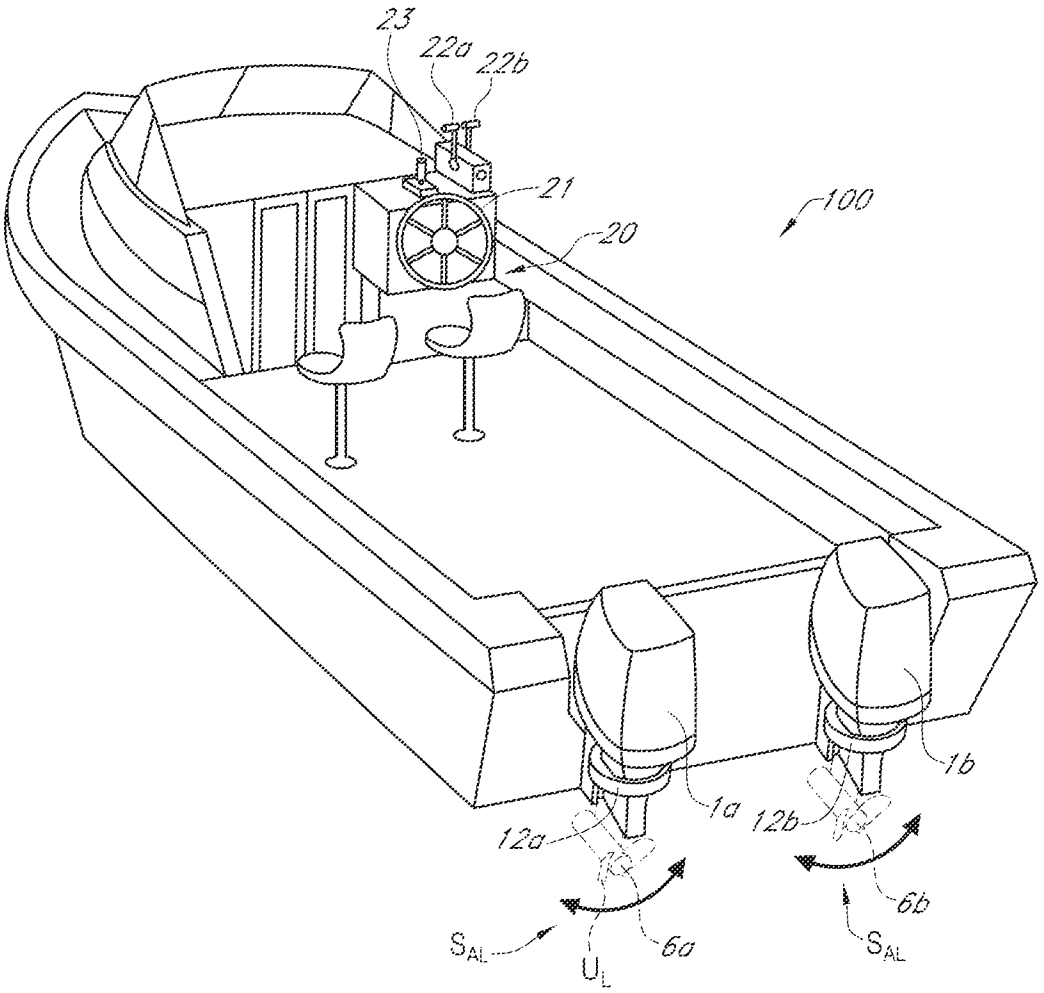
FIG. 1 is a schematic diagram of a watercraft in which a watercraft control system according to a preferred embodiment of the present invention is embedded.

Preferred embodiments of the present inventions are hereinafter explained with reference to the drawings. FIG. 1 is a schematic diagram of a watercraft 100 in which a control system according to a preferred embodiment is embedded. As shown in FIG. 1, the control system can include a plurality of outboard motors 1*a*, 1*b*. Specifically, the watercraft 100 includes a first outboard motor (e.g., a left outboard motor 1*a*) and a second outboard motor (e.g., a right outboard motor 1*b*). In some embodiments, other numbers of outboard motors can also be used. For example, in some embodiments, a third or one or more "middle" outboard motors (not shown), can be mounted between the left and right outboard motors 1*a*, 1*b*. In such embodiments, the one or more middle outboard motors can be operated synchronously or substantially synchronously (same gear position, rudder angle, power output) with the outboard motors 1*a*, 1*b*. Optionally, in other modes of operation, for example, sub idle watercraft speed operation modes, one or more of any middle outboard motors can be operated independently of the left and right outboard motors 1*a*, 1*b*, for example, held in a neutral gear.

The outboard motors 1*a*, 1*b* are preferably attached to the stern of the watercraft 100. In some embodiments, the outboard motors 1*a*, 1*b* can be disposed in alignment in the width direction of the watercraft 100. Specifically, the left outboard motor 1*a* can be disposed on the port side of the watercraft 100 and the right outboard motor 1*b* can be disposed on the starboard side of the watercraft 100. Each of the outboard motors 1*a*, 1*b* generates a thrust to propel the watercraft 100.

Figure 2:
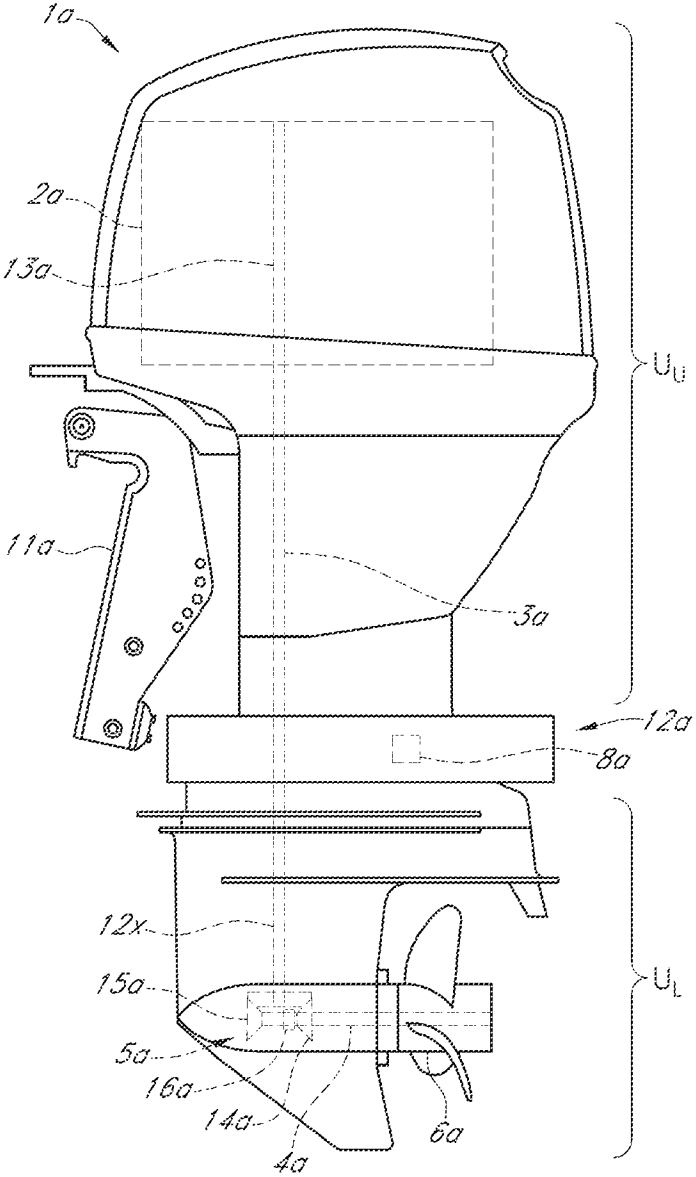
FIG. 2 is a side view of an outboard motor according to a preferred embodiment of the present invention.

FIG. 2 is a schematic side view of the left outboard motor 1*a*. A structure of the left outboard motor 1*a* is hereinafter explained. However, the right outboard motor 1*b* also preferably has the same or a similar structure to the left outboard motor 1*a*. In some embodiments, the left and right outboard motors 1*a*, 1*b* can have propellers 6*a*, 6*b* that rotate in opposite directions or can have a pair of propellers that counter rotate. The left outboard motor 1*a* is preferably attached to the watercraft 100 through a bracket 11*a*. The bracket 11*a* can include a tilt mechanism for tilting the outboard motor 1*a* about a horizontal axis, for trim adjustments.

Optionally, the bracket 11*a* supports in the upper portion of the left outboard motor 1*a* in an angular position that is fixed with regard to a vertical axis, relative to a watercraft 100. The left outboard motor 1*a* can also include a steering unit 12*a* that connects an upper unit $U_U$ to a lower unit $U_L$ and is configured to rotate the lower unit $U_L$ relative to the upper unit $U_U$. For example, the steering unit 12*a* can include a rotatable connection configured to allow the lower unit $U_L$ to rotate about a steering axis 12*x* that can be coincident with the drive shaft 3*a*. Additionally, the steering unit 12*a* can include a steering actuator 8*a*. In some embodiments, the steering unit 12*a* can be referred to as a rotatable connector, the upper unit $U_U$ can be referred to as a stationary portion, and the lower unit $U_L$ can be referred to as a rotatable portion.

For example, the steering actuator 8*a* can be an electric or hydraulic powered device. The steering actuator 8*a* can be configured to receive a signal to drive the lower unit $U_L$ to a desired angular orientation about the steering axis 12*x*. In some embodiments, the steering unit 12*a* can be configured to provide for a full 360 degree rotation of the lower unit $U_L$ relative to the upper unit $U_U$. U.S. Pat. Nos. 9,776,700 and 9,862,473 both disclose hardware for allowing a lower unit to be rotated relative to an upper unit and any of those mechanisms or other mechanisms can be used as the steering unit 12*a*. The entire contents of U.S. Pat. Nos. 9,776,700 and 9,862,473 are hereby incorporated by reference in their entirety.

The left outboard motor 1*a* preferably includes an engine 2*a*, a drive shaft 3*a*, a propeller shaft 4*a*, and a shift mechanism 5*a*. The engine 2*a* can drive the propeller 6*a* to thereby generate a thrust to propel the watercraft 100. The engine 2*a* includes a crankshaft 13*a*. The crankshaft 13*a* can extend in the vertical direction. The drive shaft 3*a* is connected to the crankshaft 13*a*. The drive shaft 3*a* can extend in the vertical direction. The propeller shaft 4*a* can extend in the front-and-back direction, which can be non-parallel (e.g., perpendicular) to the vertical direction, in some embodiment. The propeller shaft 4*a* is connected to the drive shaft 3*a* through the shift mechanism 5*a*. The propeller 6*a* is attached to the propeller shaft 4*a*. Though an internal combustion engine is used as an example of the engine 2*a*, 2*b* included in the outboard motor 1*a*, 1*b* other types of power source may be implemented as the engine 2*a*, 2*b*. For example, the engine 2*a*, 2*b* can comprise an electric motor.

The shift mechanism 5*a* preferably includes a forward moving gear 14*a*, a rearward moving gear 15*a*, and a clutch 16*a*. When gear engagement is switched between the gears 14*a*,15*a* by the clutch 16*a*, the direction of rotation transmitted from the drive shaft 3*a* to the propeller shaft 4*a* is reversed. This is one example technique that can be utilized for switching the direction of movement of the watercraft 100 between forward movement and rearward movement. In some embodiments, the shift mechanism 5*a* can be referred to as a gear shifter.

Figure 3:
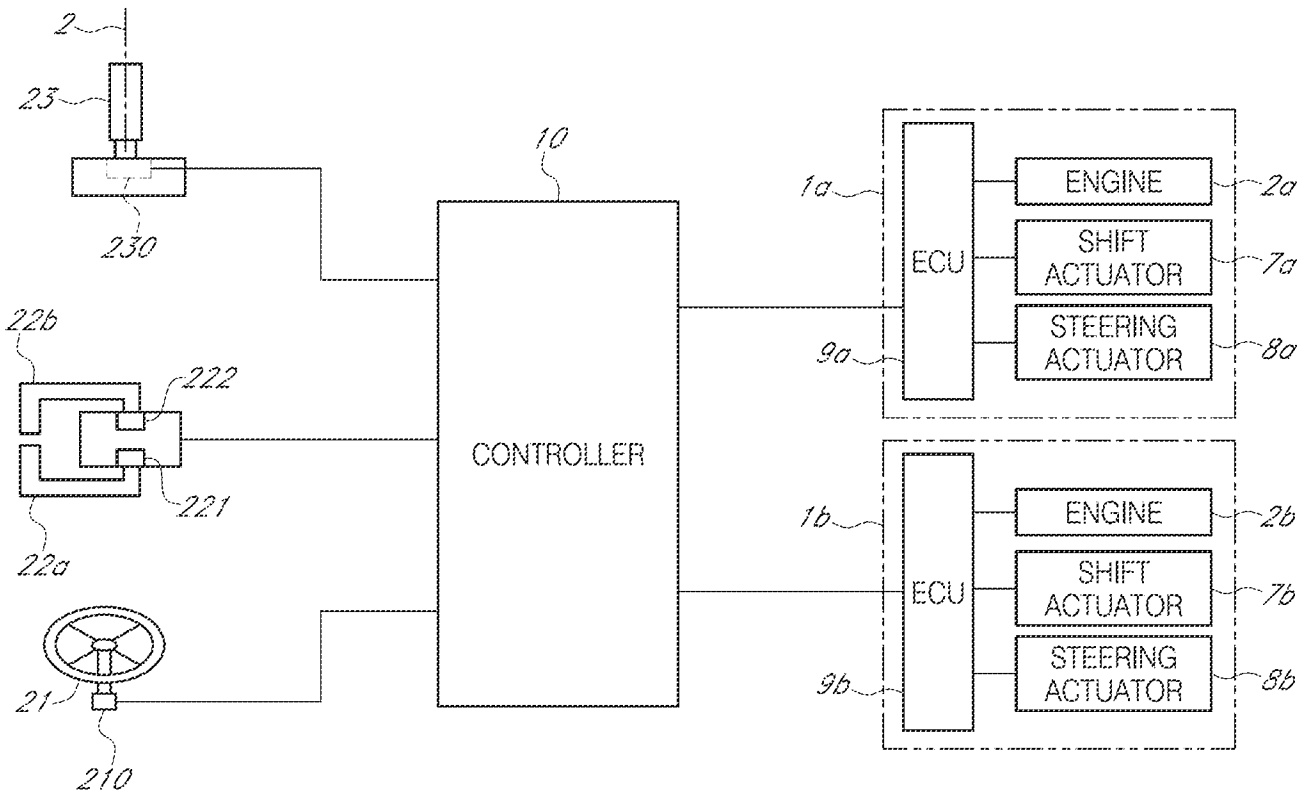
FIG. 3 is a schematic configuration diagram of the watercraft control system.

FIG. 3 is a schematic configuration diagram of a control system of the watercraft 100. As shown in FIG. 3, the left outboard motor 1*a* can include a shift actuator 7*a* and a steering actuator 8*a*, and the right outboard motor 1*b* can include a shift actuator 7*b* and a steering actuator 8*b*.

The shift actuator 7*a* is connected to the clutch 16*a* of the shift mechanism 5*a*. The shift actuator 7*a* actuates the clutch 16*a* so as to switch gear engagement between the gears 14*a*, 15*a*. With this optional technique, movement of the watercraft 100 is thus switched between forward movement and rearward movement. Additionally, movements of the watercraft 100 can be switched between forward and rearward movement by operation of the steering actuator 8*b* so as to turn the lower unit $U_L$ to produce thrust in a rearward direction while the forward gear 14*a* is engaged. Additional modes of operation are described below. The shift actuator 7*a* can preferably comprise an electric motor. It should be noted that the shift actuator 7*a* may alternatively comprise another type of actuator such as, for example, an electric cylinder, a hydraulic motor, a hydraulic cylinder, etc.

The steering actuator 8*a* is connected to the left outboard motor 1*a*. The steering actuator 8*a* rotates the lower unit $U_L$ of the left outboard motor 1*a* about the steering shaft axis 12*x*. The rudder angle of the left outboard motor 1*a* can thus be changed. The steering actuator 8*a* preferably comprise an electric motor. It should be noted that the steering actuator 8*a* may alternatively comprise another type of actuator such as, for example, an electric cylinder, a hydraulic motor, a hydraulic cylinder, etc.

The left outboard motor 1*a* includes an electric control unit (ECU) 9*a*. The ECU 9*a* preferably includes a processor such as a CPU and memory such as, for example, a RAM and a ROM. The ECU 9*a* stores a program and data to control the left outboard motor 1*a*. The ECU 9*a* controls actions of the engine 2*a*, the shift actuator 7*a*, and the steering actuator 8*a*.

As shown in FIG. 3, the right outboard motor 1*b* preferably includes an engine 2*b*, a shift actuator 7*b*, a steering actuator 8*b*, and an ECU 9*b*. The engine 2*b*, the shift actuator 7*b*, the steering actuator 8*b*, and the ECU 9*b* in the right outboard motor 1*b* are preferably configured similarly to the engine 2*a*, the shift actuator 7*a*, the steering actuator 8*a*, and the ECU 9*a* in the left outboard motor 1*a*, respectively.

The control system includes a steering wheel 21, throttle levers 22*a*,22*b*, and a joystick 23. As shown in FIG. 1, the steering wheel 21, the throttle levers 22*a*, 22*b*, and the joystick 23 are disposed in a cockpit 20 of the watercraft 100.

The steering wheel 21 is a device that allows an operator to operate the watercraft 100 in a truing or operating direction. The steering wheel 21 includes a sensor 210. The sensor 210 outputs a signal indicating the operating direction and an operating amount (e.g., a rotation angle) of the steering wheel 21.

The throttle levers 22*a*, 22*b* can include a first lever 22*a* and a second lever 22*b*. The first lever 22*a* can comprise a device that allows the operator to regulate the magnitude of a thrust generated by the left outboard motor 1*a*. In some embodiments, the thrust generated by the left outboard motor 1*a* can depend at least in part on a throttle level controlled by the operator through the first lever 22*a* and a gear position. The first lever 22*a* can comprise a device that allows the operator to switch the direction of the thrust generated by the left outboard motor 1*a* between forward and rearward directions. The first lever 22*a* can be disposed to be operable from a neutral position to a forwardly moving directional side and a rearward moving directional side. The first lever 22*a* includes a sensor 221. The sensor 221 outputs a signal indicating an operating direction and an operating amount (e.g., a displacement from the neutral position) of the first lever 22*a*.

The second lever 22*b* can comprise a device that allows the operator to regulate the magnitude of a thrust generated by the right outboard motor 1*b*. The second lever 22*b* can comprise a device that allows the operator to switch the direction of the thrust generated by the right outboard motor 1*b* between forward and rearward directions. The second lever 22*b* can be disposed to be operable from a neutral position to a forwardly moving directional side and a rearward moving directional side. The second lever 22*b* includes a sensor 222. The sensor 222 outputs a signal indicating an operating direction and an operating amount (e.g., a displacement from the neutral position) of the second lever 22*b*.

The joystick 23 can comprise a device that allows the operator to operate the movement of the watercraft 100 in each of the moving directions of front, rear, right and left. The joystick 23 can comprise a device that allows the operator to operate the bow turning motion of the watercraft 100. The joystick 23 is tiltable in multi-directions. For example the joystick can be configured to tilt in at least four directions including front, rear, right and left. It should be noted that four or more directions, and furthermore, all directions may be instructed by the joystick 23.

Moreover, the joystick 23 is preferably disposed to be turnable about a rotational axis Z. The joystick 23 includes a sensor 230. The sensor 230 outputs a propulsion signal indicating the tilt direction and a tilt amount (e.g., a tilt angle) of the joystick 23. The sensor 230 outputs a bow turning signal indicating a twist direction and a twist amount (e.g., a twist angle) of the joystick 23.

The control system includes a controller 10. The controller 10 preferably includes a processor such as a CPU and memory such as a RAM and an ROM, for example. The controller 10 stores a program and data used to control the right and left outboard motors 1*b*, 1*a*. The controller 10 is connected to the ECUs 9*a*, 9*b* through wired or wireless communication. The controller 10 is connected to the steering wheel 21, the throttle levers 22*a*, 22*b*, and the joystick 23 through wired or wireless communication.

The controller 10 receives signals from the sensors 210, 221, 222, 230. The controller 10 outputs command signals to the ECUs 9*a*, 9*b* based at least in part on the signals from the sensors 210, 221, 222, 230.

For example, the controller 10 outputs a command signal to the shift actuator 7*a* in accordance with the operating direction of the first lever 22*a*. Movement of the left outboard motor 1*a* is thus switched between forward movement and rearward movement. The controller 10 outputs a command signal to the engine 2*a* in accordance with the operating amount of the first lever 22*a*. An engine rotational speed of the left outboard motor 1*a* is thus controlled.

The controller 10 outputs a command signal to the shift actuator 7*b* in accordance with the operating direction of the second lever 22*b*. Movement of the right outboard motor 1*b* is thus switched between forward movement and rearward movement. The controller 10 outputs a command signal to the engine 2*b* in accordance with the operating amount of the second lever 22*b*. An engine rotational speed of the right outboard motor 1*b* is thus controlled.

The controller 10 outputs command signals to the steering actuators 8*a* and 8*b* in accordance with the operating direction and the operating amount of the steering wheel 21. When the steering wheel 21 is operated leftward from the neutral position, the controller 10 controls the steering actuators 8*b*, 8*a* such that the right and left outboard motors 1*b*, 1*a* are rotated rightward thereby enabling the watercraft 100 to turn, for example, in a leftward direction. When the steering wheel 21 is operated rightward from the neutral position, the controller 10 controls the steering actuators 8*b*, 8*a* such that the right and left outboard motors 1*b*, 1*a* are rotated leftward thereby enabling the watercraft 100 to turn, for example, in a rightward direction. The controller 10 can control the rudder angles of the right and left outboard motors 1*b*, 1*a* in accordance with the operating amount of the steering wheel 21.

Optionally, in some embodiments, the controller 10 can be configured to operate in two different modes, one associated with the use of the steering wheel 21 and the throttle levers 22*a*, 22*b* and another mode of operation associated with use of the joystick 23. In some embodiments, the mode of operation associated with the use of the steering wheel 21 and the throttle levers 22*a*, 22*b* can be configured to provide a more conventional watercraft propulsion control technique. For example, although the outboard motors 1*a*, 1*b* can included a mechanism for an enlarged rudder angle steering range, such as over 180°, up to 360°. The controller 10 can be configured to limit the rudder angles achievable with the steering wheel 21. For example, in some embodiments, when the controller 10 is operating in the first mode of operation, the controller 10 operates the steering actuators 8*a* so that the rudder angles of the outboard motors 1*a*, 1*b* remain within 30° of straight ahead, for example, within 30° to the right and 30° to the left. This is a steering angle range that is common with conventional outboard motors that steer with a steering bracket. In this mode of operation, the engines 2*a*, 2*b* and shift actuators 7*a*, 7*b* can be controlled with the throttle levers 22*a*, 22*b* as described above. This can improve the comfort of steering wheel operations for a user. In a second mode of operation, in which the thrust generated by the outboard motors 1*a*, 1*b* is controlled by the joystick 23, the controller 10 can allow for the rudder angles of the outboard motors 1*a*, 1*b* to be adjusted through a larger range of movement, for example, more than 30°, more than 180°, or a full 360°.

The controller 10 also outputs command signals to the engines 2*a*, 2*b*, the shift actuators 7*a*, 7*b*, and the steering actuators 8*a*, 8*b* in accordance with the tilt direction and the tilt amount of the joystick 23. The controller 10 controls the engines 2*a* and 2*b*, the shift actuators 7*a* and 7*b*, and the steering actuators 8*a* and 8*b* such that translation (linear motion) of the watercraft 100 is made at a velocity corresponding to the tilt amount of the joystick 23 in a direction corresponding to the tilt direction of the joystick 23. Additionally, the controller 10 controls the engines 2*a*, 2*b*, the shift actuators 7*a*, 7*b*, and the steering actuators 8*a*, 8*b* such that the watercraft 100 turns the bow at an angular velocity corresponding to the twist amount of the joystick 23 in a direction corresponding to the twist direction of the joystick 23.

Processing executed by the controller 10 in accordance with an operation of the joystick 23 will be hereinafter explained in detail. In the following explanation, the term "composite operation" refers to a condition in which a bow turning operation and any one of forward (or rearward) and a lateral moving operation are both ongoing for the watercraft 100. In other words, the term "composite operation" means that the twist operation about the rotational axis Z and the tilt operation are both ongoing for the joystick 23. On the other hand, the term "sole operation" refers to a condition that only one of the bow turning operation, the forward (or rearward) moving operation, or the lateral moving operation is ongoing for the watercraft 100. In other words, the term "sole operation" means that only one of the twist operation about the rotational axis Z and the tilt operation is ongoing for the joystick 23.

The controller 10 determines which of the composite operation and the sole operation is ongoing based at least in part on the signal from the joystick 23. The controller 10 determines that the composite operation of bow turning and forward, rearward or lateral propulsion is ongoing when receiving both the propulsion signal indicating the tilt operation of the joystick 23 and the bow turning signal indicating the twist operation of the joystick 23. The controller 10 determines that the sole operation of bow turning is ongoing when receiving the bow turning signal without receiving the any of the forward, rearward or lateral propulsion signals. The controller 10 determines that the sole operation of propulsion is ongoing when receiving the forward, rearward, or lateral propulsion signals without receiving the bow turning signal.

The controller 10 can be configured to operate the outboard motors 1*a*, 1*b* so as to provide a continuous proportional response to movements of the joystick 23, stepwise operation of the outboard motors based at least in part on movements of the joystick 23, or a limited number of predetermined operational modes. Additionally, the controller 10 can be configured to accept pulsed inputs to the joystick 23 and to hold an operational condition of the outboard motors 1*a*, 1*b* when the joystick 23 is pulsed and released, for example, when the joystick 23 is "tapped" by an operator. In such a tapping mode of operation, the controller 10 can be configured to cycle the operational parameters of the outboard motors 1*a*, 1*b* through a series of particular operational states which may be predetermined.

For example, the controller 10 can divide forward movement of the watercraft 100 into ten (10) steps of forward propulsion and thus ten (10) taps of the joystick 23 in the forward direction would cause the controller 10 to cycle through ten (10) different operational states of increasing the forward propulsion, for example, between 0% forward propulsion to 100% forward propulsion. In some embodiments, the controller 10 can include an integrator unit configured to integrate one or more inputs from the joystick 23 over time, to produce a more gradual response to movements of the joystick 23. In some embodiments, the controller can be configured to change the operational states of the outboard motors 1*a*, 1*b* in proportional response to the integrated signal from the joystick sensor 230, and hold the then current operational stats of the outboard motors 1*a*, 1*b* when the joystick 23 is released by a user and returned to its default position; a position that otherwise corresponds to a request for no propulsion. Other optional modes of operation are described below.

Figure 4B:
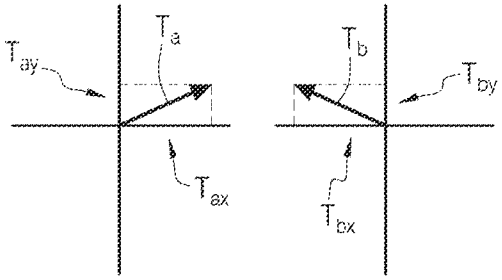
FIG. 4B is a schematic diagram showing control of the outboard motors in a first mode of operation for forward movement.
Figure 4B:
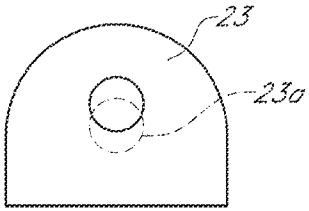
Figure 4B:
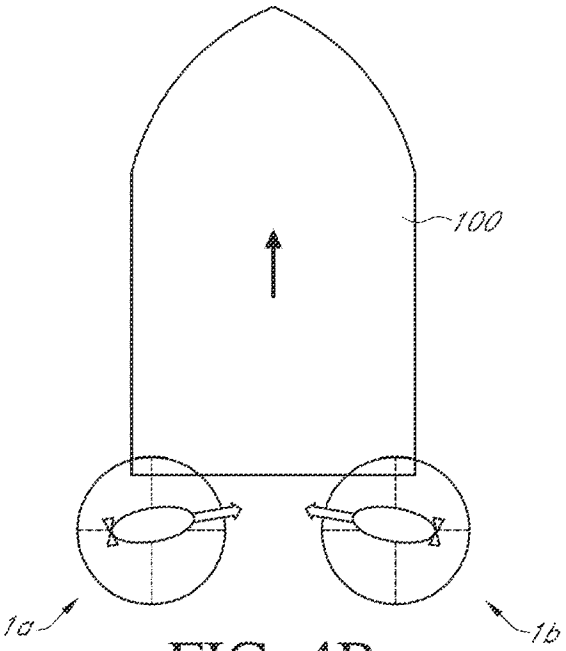
Figure 4A:
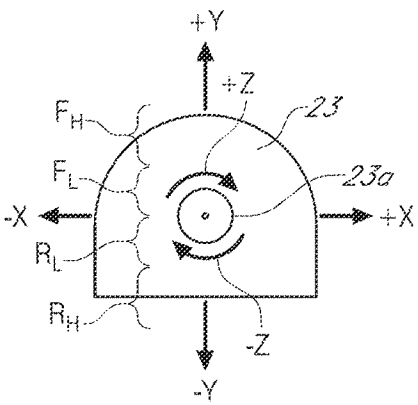
FIG. 4A is a schematic diagram showing control of the outboard motors in a no-thrust operation.
Figure 4A:
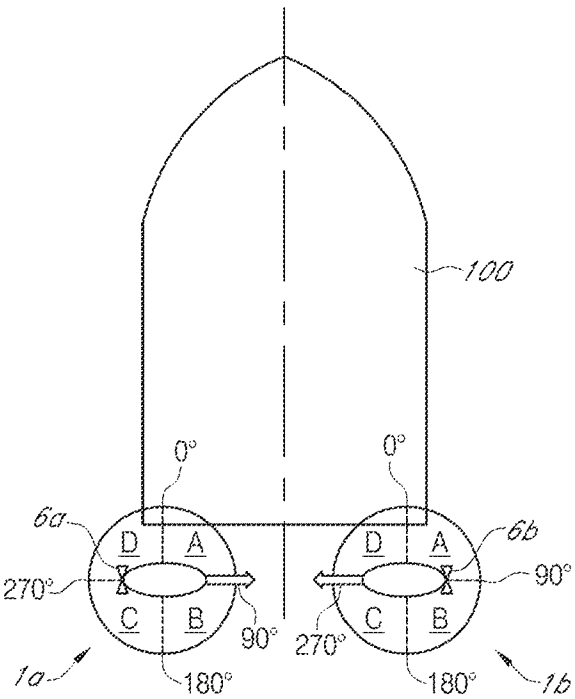

FIG. 4A is a schematic diagram showing an optional control of the outboard motors 1*a*, 1*b* in a sole operation of no propulsion. In this mode, the joystick 23 is maintained in its default position 23*a* which can be centered in its range of movements and is not twisted about the z axis. As noted above, the joystick 23 can be tiltable. For example, the joystick 23 can tilt forward and rearward along they axis. As shown in FIG. 4A, +y can correspond to forward movement and −y can correspond to rearward movement. For example, the joystick 23 can move (e.g., tilt) laterally along the x axis. As shown in FIG. 4A, +x can correspond to movement in the rightward direction and −x can correspond to movement in the leftward direction. The joystick 23 is also twistable about the z axis. As shown in FIG. 4A, +z can correspond to clockwise rotation of the joystick 23 and −z can correspond to counterclockwise rotation of the joystick 23.

In the mode of operation illustrated in FIG. 4A, the controller 10 is operating in a no-propulsion mode. In this mode, the shift actuators 7*a* and 7*b* maintain the outboard motors 1*a*, 1*b* in a drive gear, for example but without limitation, the forward gear 14*a* engaged with the drive shaft 3*a* so that the propellers 6*a*, 6*b* are rotating continuously and generating thrust. In this mode of operation, the steering actuators 8*a*, 8*b* can be operated to rotate the outboard motors 1*a*, 1*b* such that the rudder angles are opposed (e.g., directly opposed) so as to generate thrust in opposed orientations (e.g., directly opposed orientations). For purposes of explanation, the lower units $U_L$ can be rotated relative to the upper units $U_U$ such that the propellers 6*a*, 6*b* are rotated to desired angles. As used in the present Specification, for explaining the orientations of the lower units $U_L$ of the outboard motors 1*a*, 1*b*, 0 degrees will be referred to as a straight ahead direction, e.g., parallel with the longitudinal axis L of the watercraft 100. Going clockwise from 0 degrees in 90 degree increments provides 90 degrees at the far right edge, 180 degrees directed rearwardly and 270 degrees at the left edge. As such, the range of movement of each of the outboard motors 1*a*, 1*b* can be considered as being divided into four quadrants, quadrant A extending from zero degrees to 90 degrees, quadrant B extending from 90 degrees to 180 degrees, quadrant C extending from 180 degrees to 270 degrees, and quadrant D extending from 270 degrees to 360 degrees (which is also 0 degrees). As used herein, the term "directly opposed" can mean where the rudder angles point directly at each other, for example, the left outboard motor 1*a* is at 90 degrees and the right outboard motor 1*b* is at 270 degrees, or where the rudder angles point in directly opposite directions, i.e., the left outboard motor 1*a* is at 270 degrees and the right outboard motor 1*b* is at 90 degrees. In either case, all or substantially all thrust can be cancelled. Additionally, as used herein, "partly opposed" can mean where the rudder angles of the outboard motors 1*a*, 1*b* are pointed partly toward or party away from each other, which thereby cancels some or all of the x-component thrust and/or the y-component thrust from each outboard motor.

In the present mode of operation illustrated in FIG. 4A, where the joystick 23 is in its default position, the controller 10 controls the shift actuator 7*a*, 7*b* to maintain the outboard motors 1*a*, 1*b* in the forward gear 14*a*, at idle speed and additionally controls the steering actuators 8*a*, 8*b* so as to direct the lower units $U_L$ of the outboard motors 1*a*, 1*b* to face toward each other, in other words, with the propellers of the outboard motors 1*a*, 1*b* oriented at about 270 degrees and about 90 degrees, respectively so as to be substantially directly opposed to each other. In this orientation, with the propellers 6*a*, 6*b* spinning and generating thrust, all or substantially all the thrust generated by each propeller 6*a*, 6*b* is cancelled because they are directed in opposing directions and are generating approximately the same amount of thrust as both outboard motors 1*a*, 1*b* are operated at idle speed. In some conditions, the controller 10 in the no-propulsion mode can maintain the watercraft 100 to be stationary and to have no propulsion.

FIG. 4B is a schematic diagram showing control of the outboard motors 1*a*, 1*b* in the sole operation of forward propulsion, at a sub-idle watercraft speed. In FIG. 4B, the joystick 23 is tilted in the forward direction by a first amount in the +y direction. In this case, the controller controls each of the left and right outboard motors 1*a*, 1*b* to generate a first amount of thrust in the forward moving direction. The watercraft 100 thus moves forward.

The controller 10 can be configured to recognize ranges of movement of the joystick 23 as corresponding to different ranges of intended or requested watercraft thrust. For example, with reference to FIG. 4A, a measure of tilt of the joystick 23 in the forward direction can be specified relative to the default position 23*a*. More specifically, the measure of tilt in the forward direction can be characterized or defined according to a first range $F_L$, from the default position of 23*a*, through the position illustrated in FIG. 4C (e.g., a first zone). Additionally, the measure of tilt in the forward direction can be characterized or defined according to a second range $F_H$, from the position of FIG. 4C to the position of FIG. 4D. Additionally, the measure of tilt of the joystick 23 in the rearward direction can be specified relative to the default position 23*a*. More specifically, the measure of tilt in the rearward direction can be characterized or defined according to a first range $R_L$, from the default position of 23*a*, through the position illustrated in FIG. 5B. Additionally, the measure of tilt in the forward direction can be characterized or defined according to a second range $R_H$, from the position of FIG. 5B to the position of FIG. 5C. The controller 10 can be configured to recognize joystick positions (or tilt) characterized as being within the first range $F_L$ as a request for forward propulsion at sub idle watercraft speeds and joystick positions (or tilt) characterized as being within the second range $F_H$ as a request for forward propulsion at super idle watercraft speeds. The position of FIG. 4C can be considered as residing in the super idle watercraft speed $F_H$ range. Similarly, the controller 10 can be configured to recognize joystick positions (or tilt) characterized as being within the first range $R_L$ as a request for reverse propulsion at sub idle watercraft speeds and joystick positions (or tilt) characterized as being within the second range $F_H$ as a request for reverse propulsion at super idle watercraft speeds.

In the first mode of sole forward propulsion of FIG. 4B, the outboard motors 1*a*, 1*b* can be operated to continue operating at idle speed and in the forward gear 14*a*. Additionally, the steering actuators 8*a*, 8*b* are operated to turn the lower units $U_L$ of the outboard motors 1*a*, 1*b* so that the rudder angles point more forward than the position of FIG. 4A. Thus, the lower unit $U_L$ of the outboard motor 1*a* points towards quadrant A and the lower unit $U_L$ of outboard motor 1*b* points towards quadrant D. As such, a portion of the thrust generated by each outboard motor 1*a*, 1*b* can be cancelled by the other. However, there remains a net positive amount of forward thrust for moving the watercraft 100 forward.

Various aspects of the present disclosure can include the realization that by controlling outboard motors in this way, a watercraft speed that is slower than the maximum watercraft speed obtainable during idle operation of the outboard motors 1*a*, 1*b* with the rudder angles at 0 degrees can be achieved, which can be desirable for trolling or docking maneuvers. This is because, as noted above, some of the thrust generated by each outboard motor 1*a*, 1*b* is cancelled by the thrust generated by the other outboard motor 1*a*, 1*b* because the lower units $U_L$ are directed partially toward each other, thereby cancelling some of the thrust created. However, because the lower units $U_L$ of the outboard motor 1*a*, 1*b* are not directly opposed to each other, there is a net positive amount of thrust, in this case, in the forward direction. As used herein, the term "idle watercraft speed" refers to a steady state. For example, the idle watercraft speed can be a steady state at the maximum watercraft speed obtainable during idle operation, with the rudder angles at 0 degrees. The term "sub idle watercraft speed" refers to watercraft speeds that are less than idle watercraft speed. The term "super idle watercraft speed" can be considered as including idle watercraft speeds and higher speeds.

With reference to FIG. 4B1, in the orientation illustrated in FIG. 4B, the left outboard motor 1*a* produces a thrust Ta and the outboard motor 1*b* generates a thrust Tb. Broken down into x and y components, the thrust Ta has a positive y component Tay and a positive x thrust component Tax. Similarly, the outboard motor 1*b* produces the thrust Tb with a positive y thrust component Tby but a negative x component Tbx. With the outboard motors 1*a*, 1*b* both in the forward gear 14*a* and operating at idle speed, the magnitudes of thrust Ta and Tb are theoretically equal, however, with an opposite x component. Thus, the x components of the thrusts produced by the outboard motors 1*a*, 1*b* (Tax and Tbx) cancel each other out. The resulting net thrust produced in its mode of operation is thus Tay plus Tby, which is a net positive forward thrust.

Figure 4D:
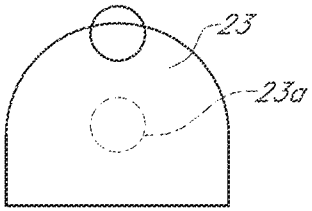
FIG. 4D is a schematic diagram showing control of the outboard motors in a third mode of operation for forward movement.
Figure 4D:
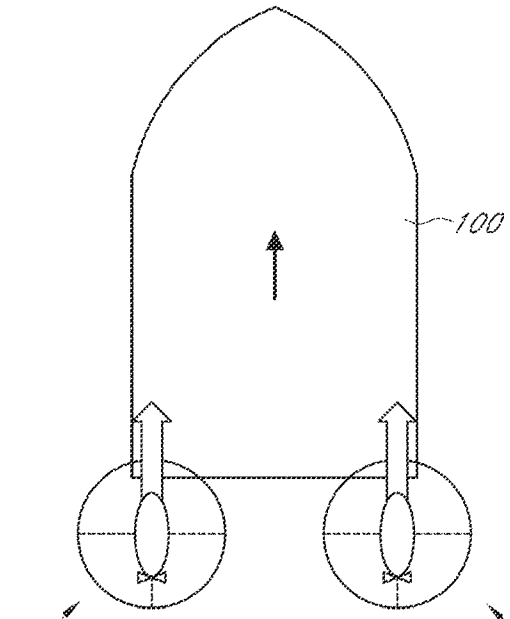
Figure 4C:
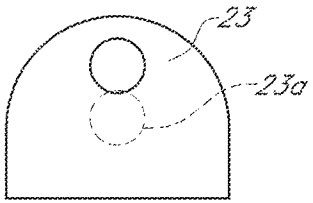
FIG. 4C is a schematic diagram showing control of the outboard motors in a second mode of operation of forward movement.
Figure 4C:
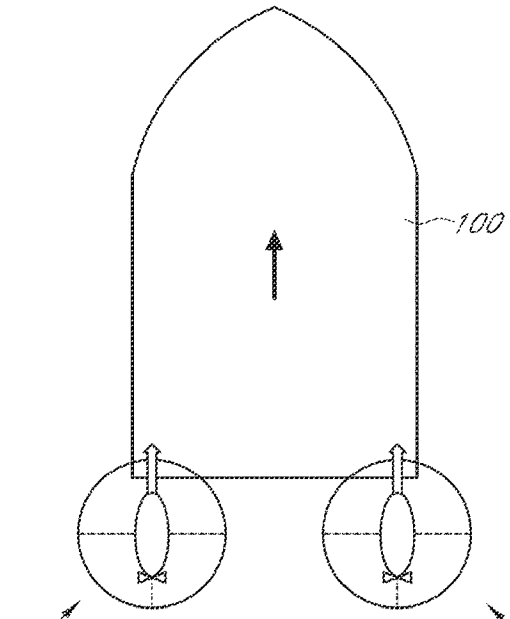

FIG. 4C is a schematic diagram showing control of the outboard motors 1*a*, 1*b* in a second forward, sole operation mode for propulsion. In FIG. 4C, the joystick 23 is tilted to a further forward position than that illustrated in FIG. 4B, between the position illustrated in FIG. 4B and a maximum forward deflection position (illustrated in FIG. 4D). In this case, the controller 10 controls the steering actuators 8*a*, 8*b* to adjust the rudder angles to orientate the lower units $U_L$ of the outboard motors 1*a*, 1*b* to a full forward position, e.g., pointing at zero degrees. As such, the rudder angles of the left and right outboard motors 1*a*, 1*b* are both zero degrees. As such, the watercraft 100 would move ahead in a forward direction, at an idle watercraft speed. In some embodiments, the controller 10 can be configured to control the rudder angles of the outboard motors 1*a*, 1*b* in accordance with a lateral, leftward and rightward tilting of the joystick 23, in some modes of operation.

As noted above, the controller 10 can be configured to provide for a proportional change in forward thrust produced by gradually adjusting the rudder angles of the outboard motors 1*a*, 1*b* between the position illustrated in FIG. 4A and the position illustrated in FIG. 4C (FIG. 4B illustrating an intermediate position therebetween) in response to detected positions of the joystick 23 (or integrated detection signals thereof) falling in the range $R_L$. The controller 10 can be configured to provide for any number of particular steps (e.g., predetermined steps) of rudder angles corresponding to joystick positions in the $R_L$ range, between the rudder angles illustrated in FIGS. 4A and 4C or continuous proportional adjustments, for example, based at least in part on a magnitude of deflection of the joystick 23 from the default position 23*a* and the position illustrated in FIG. 4C. Further, the controller 10 can include an integrator module (not shown) for integrating the detected position of the joystick 23 to provide an integrated position signal value. Integrator modules are well known in the art. The position of the joystick 23 detected by sensor 230 can be input into a commonly available integrator module as a source value (Integrand) and an amount of time (Divisor) can be selected to provide the desired responsiveness in the system.

FIG. 4D is a schematic diagram showing control of the outboard motors 1*a*, 1*b* in a third mode of sole operation for forward movement. In this mode, the rudder angles of the left and right outboard motors 1*a*, 1*b* remain at zero degrees. However, in this mode of operation, the joystick 23 has been moved to its full forward position, e.g., 100% of its range of movement. In this case, the controller 10 controls the engines 2*a*, 2*b* of the outboard motors 1*a*, 1*b* so as to increase the power output and thus a rotational speed of the propellers 6*a*, 6*b*.

The controller 10 can be configured to allow for full power output from the outboard motors 1*a*, 1*b* or configured for limiting maximum output to a particular engine output (e.g., a predetermined engine output), which would correspond to a maximum thrust generated by the outboard motors 1*a*, 1*b*. In some embodiments, where the engines 2*a*, 2*b* are internal combustion engines, the controller 10 can be configured to control a throttle opening of the engines 2*a*, 2*b*, to thereby control the output from the engines 2*a*, 2*b*. Thus, in such embodiments, the controller 10 can be configured to limit the maximum throttle opening achievable by operation of the joystick 23. For example, the controller 10 may be configured or programmed with a maximum of a 35% opening of the throttle valves of the engines 2*a*, 2*b*. In some embodiments, the controller 10 can be configured to adjust the power output from the engines 2*a*, 2*b*, e.g., adjusting the opening of the throttle valves, between the idle speed setting associated with the operational mode of FIG. 4C and the operational mode of FIG. 4D, between the idle speed setting and the maximum output setting.

In some embodiments, the controller 10 can be configured to adjust the throttle openings proportionally corresponding to proportional movements of the joystick 23 over the range $F_H$, between the position illustrated in FIG. 4C and the position illustrated in FIG. 4D. Optionally, the controller 10 can be configured to adjust the throttle openings of the engines 2*a*, 2*b* in a stepwise manner, for example, with any number of predetermined steps between the idle speed associated with the joystick position over range $F_H$.

Thus, when a user operates the joystick 23 starting from the default position illustrated in FIG. 4A to the maximum displacement position illustrated in FIG. 4D, the controller 10 first adjusts the rudder angle of the outboard motors 1*a*, 1*b* from the zero watercraft thrust position illustrated in FIG. 4A in which the rudder angles are directly opposed and thus cancelling all thrust produced by the outboard motors 1*a*, 1*b*, then through one or more intermediate steps of changing the rudder angles of the outboard motors 1*a*, 1*b* as the joystick 23 is moved from the position of FIG. 4A, through the range $F_L$. Thus, the controller 10 can be configured to adjust a forward speed of the watercraft 10 into different ranges of watercraft speeds using two different types of adjustments of the outboard motors 1*a*, 1*b*. For example, in some embodiments, the first range $F_L$ is associated with speeds from zero up to idle speed by adjusting the rudder angle of the outboard motors 1*a*, 1*b*, and in some embodiments, only adjusting the rudder angles of the outboard motors 1*a*, 1*b*. The second $F_H$ is associated with changing the power output from the outboard motors 1*a*, 1*b* for adjustment of watercraft speed between idle speed (FIG. 4C) and a full power speed (FIG. 4D). As noted above, the full power speed of FIG. 4D can be limited to a predetermined maximum that is less than the maximum power output possible from the outboard motors 1*a*, 1*b*.

Figure 5C:
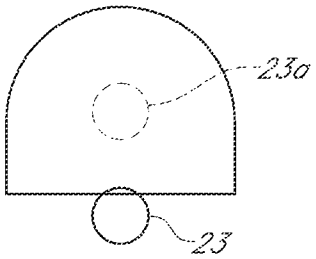
FIG. 5C is a schematic diagram showing control of the outboard motors in a third mode of operation for rearward movement.
Figure 5C:
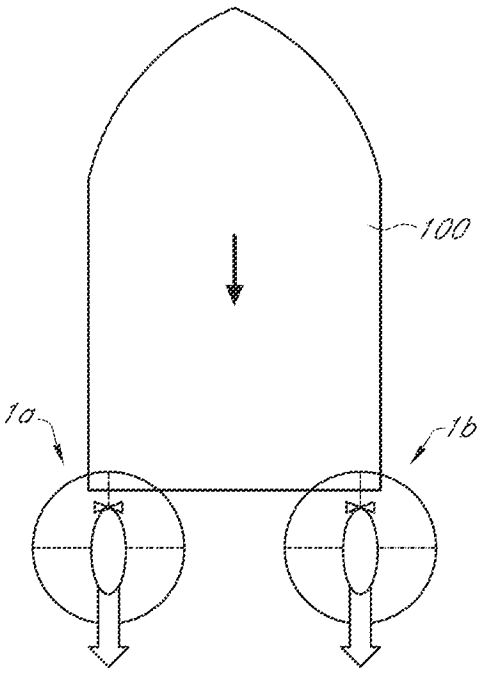
Figure 5B:
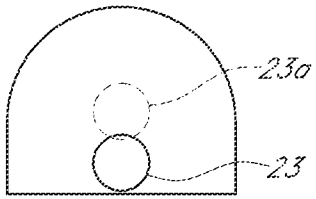
FIG. 5B is a schematic diagram showing control of the outboard motors in a second mode of operation for rearward movement.
Figure 5B:
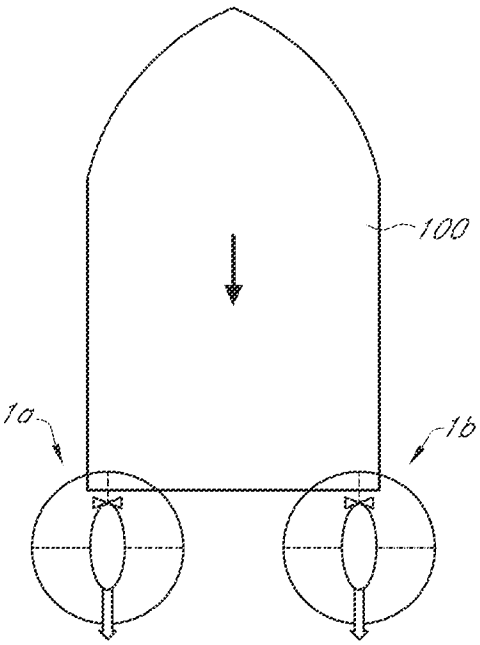
Figure 5A:
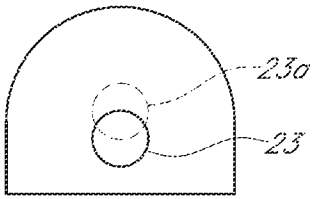
FIG. 5A is a schematic diagram showing control of the outboard motors in a first mode of operation for rearward movement.
Figure 5A:
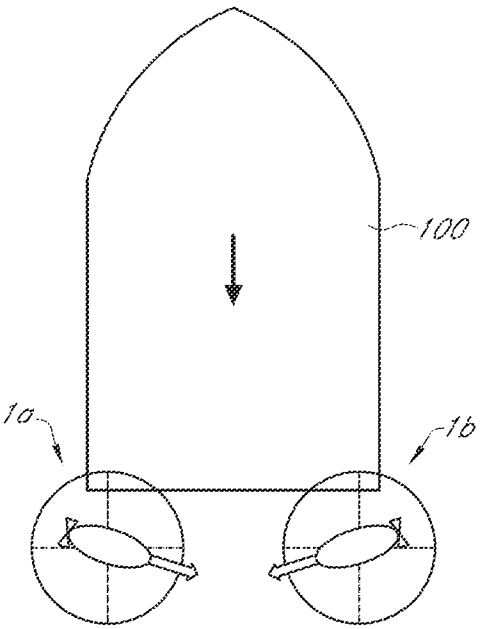

FIG. 5A is a schematic diagram showing control of the outboard motors 1*a*, 1*b* in a first rearward sole operation for propulsion in the rearward direction, in which the joystick 23 has been moved into the range $R_L$. Similarly to the operation illustrated in FIG. 4B, the controller 10, in this case, controls the steering actuators 8*a*, 8*b* to adjust the rudder angles of the outboard motors 1*a*, 1*b* from the opposing orientation of FIG. 4A, to the orientation illustrated in FIG. 5A in which the rudder angles of the outboard motors 1*a*, 1*b* are still pointing partially towards each other, but also partially rearward. For example, the outboard motor 1*a* is pointing towards quadrant B and the rudder angle of outboard motor 1*b* is pointing towards quadrant C. Similarly to the mode of operation of FIG. 4B, this produces a net rearward thrust to thereby move the watercraft 100 rearwardly. Because the rudder angles of the outboard motors 1*a*, 1*b* are pointed towards each other, the x component of the thrust values cancel each other out, similarly to that described above with reference to FIG. 4B1.

FIG. 5B is a schematic diagram showing control of the outboard motors 1*a*, 1*b* in a second rearward sole operation for rearward propulsion. In this case, the joystick 23 has been moved to a second rearward position, into the range $F_H$, further rearward than that associated with FIG. 5A. In this case, the controller 10 controls the steering actuators 8*a*, 8*b* to adjust the rudder angles of the outboard motors 1*a*, 1*b* so as to point in the full rearward direction, i.e., 180 degrees. The controller 10 also maintains the outboard motors 1*a*, 1*b* in a "forward" gear position with the engines 2*a*, 2*b* at idle speed. As such, the watercraft 100 would move rearwardly at the idle watercraft speed, similarly to the forward movement of the watercraft 100 described above with reference to FIG. 4C.

FIG. 5C is a schematic diagram showing control of the outboard motors 1*a*, 1*b* in the third rearward sole operation mode for rearward propulsion. In FIG. 5C, the joystick 23 is tilted to the rearward most position, further into the range $R_H$. In this case, the controller 10 controls the outboard motors 1*a*, 1*b* so as to maintain the rudder angles in the straight rearward direction, i.e., 180 degrees, and increases the output from the engines 2*a*, 2*b* to a maximum setting. As noted above, with reference to FIG. 4D, the maximum output from the engines 2*a*, 2*b* in such a mode of operation can be limited to a predetermined amount that is less than the maximum power output from the engines 2*a*, 2*b* possible.

As such, the controller 10 can adjustment the watercraft speed in rearward direction in various ranges of watercraft speeds, similarly to that described above with regard to the forward modes of sole operation. For example, the controller 10 can be configured to provide an adjustment of rearward speeds from zero speed associated with FIG. 4A to idle speed in the rearward direction associated with FIG. 5B, by adjusting the rudder angles of the outboard motors 1*a*, 1*b* and maintaining the power output from the engines 2*a*, 2*b* at idle speed. As such, over this first range of adjustment, the watercraft 100 is driven rearwardly between zero up to idle watercraft speed which includes one or more speeds that is less than idle watercraft speed associated with the mode of FIG. 5B. A second range of adjustment is achieved by way of maintaining the rudder angles of the outboard motors 1*a* and 1*b* at 180 degrees but increasing the power output from the engines 2*a*, 2*b*, for example, in proportion to movement of the joystick 23 between the positions illustrated in FIG. 5B and the position illustrated in FIG. 5C.

Further, as described above with reference to FIGS. 4A-4D, the controller 10 can be configured to allow a user to cycle through a plurality of predetermined rearward propulsion modes by "tapping" the joystick in the rearward direction. For example, in such a mode of operation, the controller 10 can be configured to detect a "tap" of the joystick 23 toward the rearward direction and adjust the rudder angles of the outboard motors 1*a*, 1*b* from the position illustrated in FIG. 4A, to a position between the position of FIG. 4A and the position of FIG. 5B, such as the position illustrated in FIG. 5A. Additionally, the controller 10 can be configured to, in a stepwise manner, increase rearward propulsion each time a user "taps" the joystick 23 in the rearward direction cycling the rearward propulsion modes between the sub-idle range by adjustment of rudder angles and through the super idle speed range by adjustment of the power output of the outboard motors 2*a*, 2*b*, up to the maximum rearward propulsion mode associated with FIG. 5C.

Figure 6:
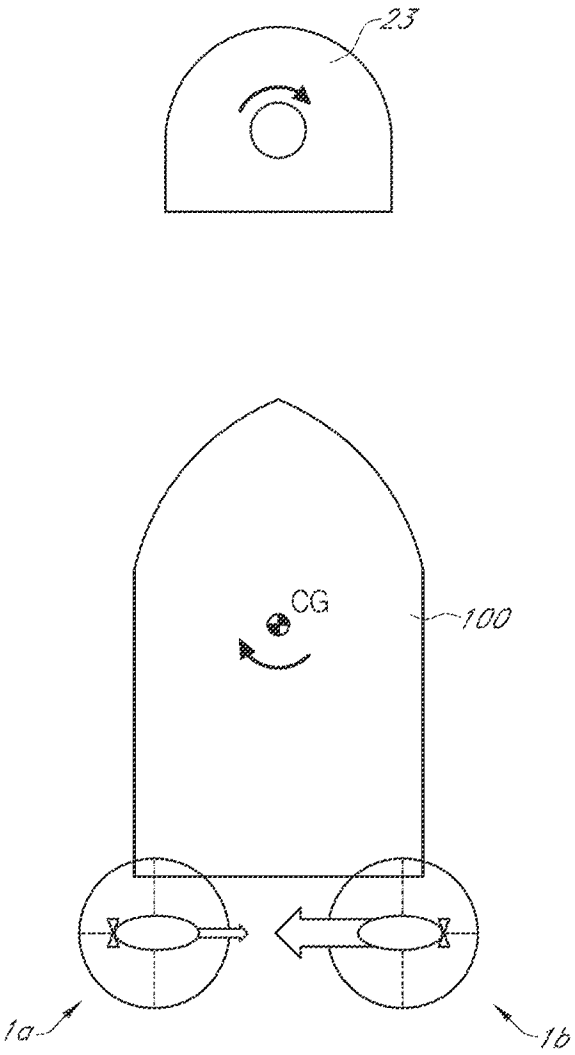
FIG. 6 is a schematic diagram showing control of the outboard motors in a first mode of operation for rightward or clockwise rotation.

FIG. 6 is a diagram showing control of the outboard motors 2*a*, 2*b* in a sole operation mode of bow turning in a clockwise direction. In FIG. 6, the joystick 23 has been rotated from its default position 23*a* clockwise about the z axis in the positive z direction, to a rotated position of the joystick 23. In this case, the controller 10 maintains the rudder angles of the outboard motors 1*a*, 1*b* in the directly opposed orientation of FIG. 4A, and increases the power output from the engine 2*b* of the right outboard motor 1*b*. Thus, there is a net thrust produced by the combined thrusts of the outboard motors 1*a*, 1*b* (a greater thrust of the right outboard motor 1*b* in the −x direction in the illustrated embodiment), causing a clockwise torque Tcw to be exerted on the watercraft 100 that generally rotates the watercraft 100 about its center of pressure CP. The term "center of pressure" is also referred to as "center of resistance," "center of lateral resistance," and "center of lateral plane," all of which refer to geometric center of the underwater profile of the hull. In some embodiments, the controller 10 can be configured to proportionally increase the power output from the engine 2*b* of the right outboard motor 1*b* in proportion to the magnitude of clockwise rotation of the joystick 23 about the z axis, in a continuously proportional linear or non-linear, or a stepwise fashion.

various aspects of the present disclosure can include the realization that initiation of rotation or bow turning of a watercraft 100 can be significantly quicker and smoother compared to conventional techniques. For example, some conventional outboard motor control systems, when switching from a zero propulsion mode to a rotation mode, shift one outboard motor into forward gear, one outboard motor into rearward gear, which would cause multiple shocks, one from the gear shifting of each outboard motor, after which, the watercraft begin to rotate. However, in accordance with some embodiments of modes of operation, by continuing to operate the outboard motors 1*a*, 1*b* in the forward gear 14*a* and at idle speed and with diametrically opposed rudder angles for zero propulsion, then only increasing the power output from one outboard motor to induce rotation of the watercraft, the initiation of rotation is significantly smoother than the conventional technique noted above. In accordance with various embodiments, certain disadvantages associated with conventional systems can be eliminated or reduced the system for controlling a watercraft disclosed herein.

Further, no adjustment of the rudder angles of the outboard motors 1*a*, 1*b* is necessary in this mode of operation. Further, because watercraft are generally elongated, the distance between the center of pressure and the net thrust vector is much larger, thereby providing an opportunity to generate much larger torques on the watercraft 100 for rotation of the watercraft 100 than when the thrust vector were located closer to the center of pressure. As such, the rotation of the watercraft 100 can be more responsive to rotational inputs to the joystick 23.

In some embodiments, the controller 10 can be configured to proportionally increase the power output of the engine 2*b* between idle and a maximum output based on the proportional twisting of the joystick 23 between its default position and a maximum twisted position.

Figure 7:
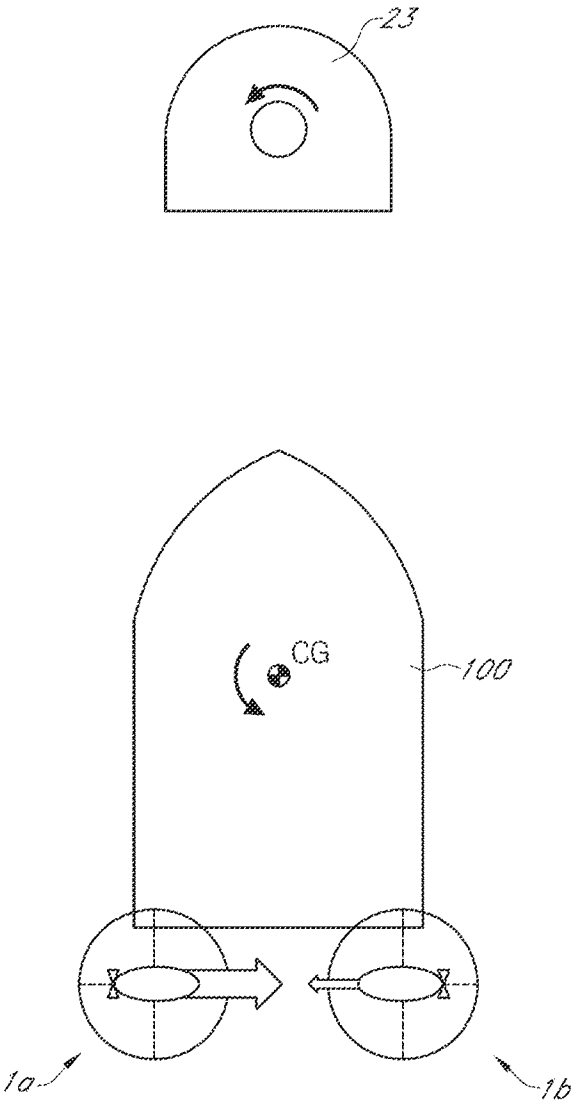
FIG. 7 is a schematic diagram showing control of the outboard motors in a mode of operation for leftward or counterclockwise rotation.

FIG. 7 is a schematic diagram showing control of the outboard motors 1*a*, 1*b* in the counterclockwise sole operation mode of bow turning or rotation in the counterclockwise direction. In FIG. 7, the joystick 23 is twisted counterclockwise about the z axis, or in other words, in the −z direction. In this case, the controller 10 increases the power output from the engine 2*a* of the left outboard motor 1*a*, thereby increasing the thrust generated by the left outboard motor 1*a*, while maintaining the rudder angles of the outboard motors 1*a*, 1*b* in the diametrically opposed orientation of FIG. 4A. As such, there is a net thrust in the positive x direction generated by the combined thrusts of the outboard motors 1*a*, 1*b*, thereby generating a counter clockwise torque Tccw on the watercraft 100, and causing rotation of the watercraft 100 generally about its center of pressure CP.

Figure 8A:
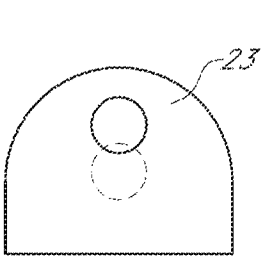
FIG. 8A is a schematic diagram showing control of the outboard motors in the first mode of operation for forward movement.
Figure 8A:
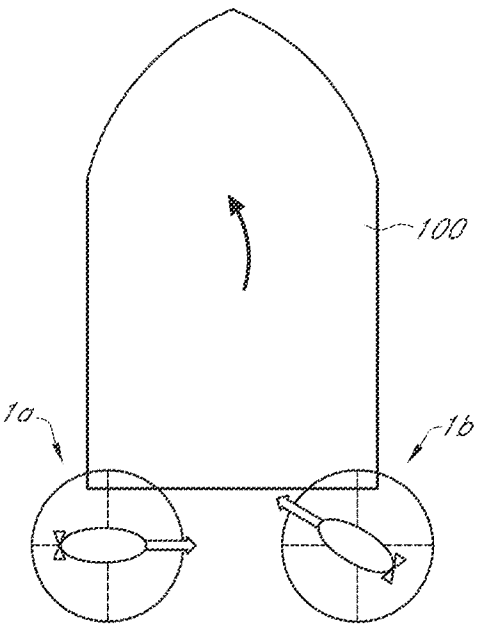
Figure 8B:
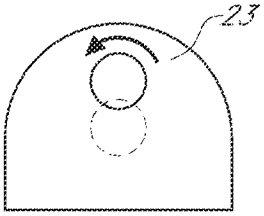
FIG. 8B is a schematic diagram showing control of the outboard motors in a first composite mode of operation for forward movement and counterclockwise rotation.
Figure 8C:
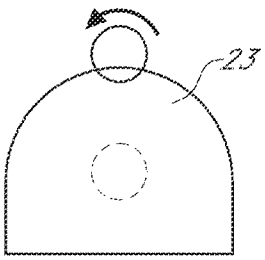
FIG. 8C is a schematic diagram showing control of the outboard motors in a second composite mode of operation for forward movement and counterclockwise rotation.
Figure 8C:
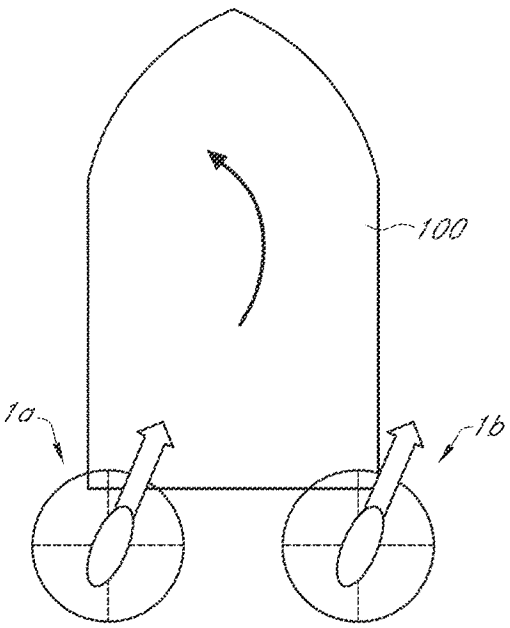

FIG. 8A is a schematic diagram showing control of the outboard motors 1*a*, 1*b* under the first forward sole mode of operation as described above with reference to FIG. 4B, repeated here for illustrating composite modes of operation illustrated in FIGS. 8B and 8C.

FIG. 8B is a schematic diagram showing control of the outboard motors 1*a*, 1*b* under the first composite operation of forward movement and counterclockwise rotation. In this scenario, the joystick 23 is initially moved to a forward propulsion position as illustrated in FIG. 8A, in which the controller 10 adjusts the rudder angles of the outboard motors 1*a*, 1*b* to be pointing slightly forward so as to produce a net forward thrust. In FIG. 8B, the joystick maintains a forward tilted position and twisted counterclockwise (in the −z direction). In this case, the controller 10 adjusts the rudder angle of the outboard motor 1*a* to reduce its y axis thrust component and thereby increase its x axis thrust component.

For example, in the embodiment of FIG. 8B, the rudder angle of the left outboard motor 1*a* is adjusted to 90 degrees from an angle in the quadrant A, and the right outboard motor 1*b* is adjusted to have a more forward thrust (angled more towards the +y direction) relative to the orientation of the right outboard motor 1*b* of FIG. 8A. There is a net propulsion directed in the +x direction generated by the outboard motor 1*a* only partially offset by the smaller −x thrust component from the outboard motor 1*b*. Additionally, the outboard motor 1*b* provides some +y component thrust due to its rudder angle orientation into the D quadrant. As such, the watercraft 100 moves forward and rotates counterclockwise, with the outboard motors remaining in the forward gear 14*a* and operating at idle speed.

FIG. 8C is a schematic diagram showing control of the outboard motors 1*a*, 1*b* in a second composite mode of operation for forward movement and counterclockwise rotation. In FIG. 8C, the joystick 23 has been moved to the forward most position and has been rotated counterclockwise. In this case, the controller 10 adjusts the rudder angle of the outboard motors 1*a*, 1*b* to be generally parallel, like in the forward mode of operation of FIG. 4D, and further adjusts the rudder angles of the outboard motors 1*a*, 1*b* to provide for rotation or turning to the left, or counterclockwise. Additionally, like in the mode of FIG. 4D, the controller 10 increases the power output of the engines 2*a*, 2*b* of the outboard motors 1*a*, 1*b*, respectively. This provides greater than idle speed propulsion and turning.

The composite mode of operation illustrated in FIG. 8C can also be combined with tap-mode operation described above. For example, the controller 10 can be configured to gradually or stepwise increase the forward propulsion of the watercraft 100 in the super idle watercraft speed range in which the rudder angles of the outboard motors 1*a*, 1*b* are held to be generally parallel and also to maintain the power output of the engines 2*a*, 2*b* at a speed above idle. Thus, a user could tilt or tap the joystick 23 a number of times until the watercraft 100 enters a speed range that is greater than idle speed with the joystick 23 returning to the default position 23*a*. Then, a user could subsequently twist the joystick 23 clockwise or counterclockwise so as to turn the watercraft 100 in the desired direction, while the controller 10 maintains the elevated output of the engines 2*a*, 2*b* and thus the super idle watercraft speed. This can provide the user with a more user-friendly convenient mode of operation in which a user is not required to hold the joystick 23 in a tilted position to maintain the watercraft 100 operating at a super idle watercraft speed, and use the twisting motions of the joystick 23 to control heading or a direction of travel. In some embodiments, the controller 10 can be configured to control the rudder angles of the outboard motors 1*a*, 1*b* in accordance with a lateral, leftward and rightward tilting of the joystick 23, in this mode of operation. Based on the above disclosure, those of ordinary skill in the art will understand how to achieve forward and propulsion and clockwise rotation.

Additionally, the controller 10 can be configured to, when operating in super idle speed mode, further limit the maximum steering angles used during super idle operation. For example, with reference to FIG. 16, the controller 10 can include a map of values including any of those illustrated in FIG. 16 correlating the throttle angle of the outboard motors 1*a*, 1*b* to the maximum steering angle. In the illustrated embodiment of FIG. 16, at 0% throttle, the maximum steering angle is limited to a particular angle (e.g., a first predetermined steering angle) for operation at smaller throttle openings. This corresponds to operation at the beginning of super idle mode, where throttle angle is 0% and the engines 2*a*, 2*b* are operating at idle. As the controller 10 responds to further joystick inputs to increase thrust, the super idle mode requires increasing the output from the outboard motors 1*a*, 1*b*, for example, by increasing the opening of the throttle valves above 0%. In the illustrated embodiment, the maximum steering angle falls to another angle (e.g., a second steering angle that is smaller than the first steering angle) at 100% throttle opening.

Figure 16:
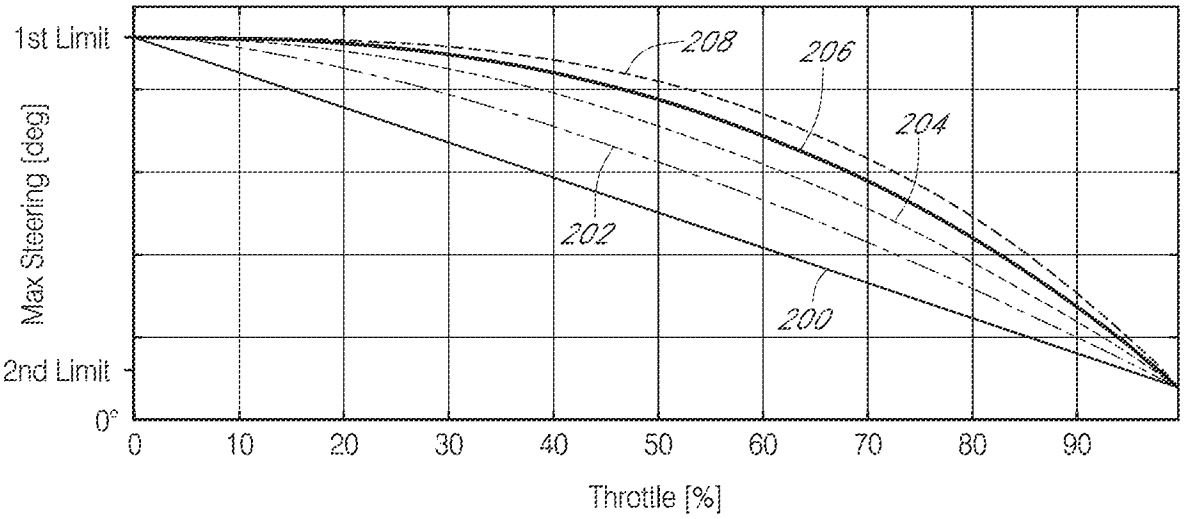
FIG. 16 is a graph illustrating an optional map for limiting steering angles or rudder angles of the outboard motors during cruise control operation, such as those cruise control operations of FIGS. 14 and 15.

With continued reference to FIG. 16, various different proportional relationships of throttle angle, and max steering angle can be used. For example, FIG. 16 includes a first linear curve 200 defining as direct proportional relationship of max steering angle between the first and second angles over the range of throttle openings from 0-100%. FIG. 16 also includes four additional curves 202, 204, 206, 208 which define other predetermined relationships between max steering angle and throttle opening. The curves 202, 204, 206, 208 can be exponential curves. In the illustrated embodiment, the curve 208 provides the most gradually introduced limit on max steering angle and the curve 202, of the curves, is the most linear, line 200 being directly linear. Other curves can also be used.

Figures 9A, 9B, 9C:
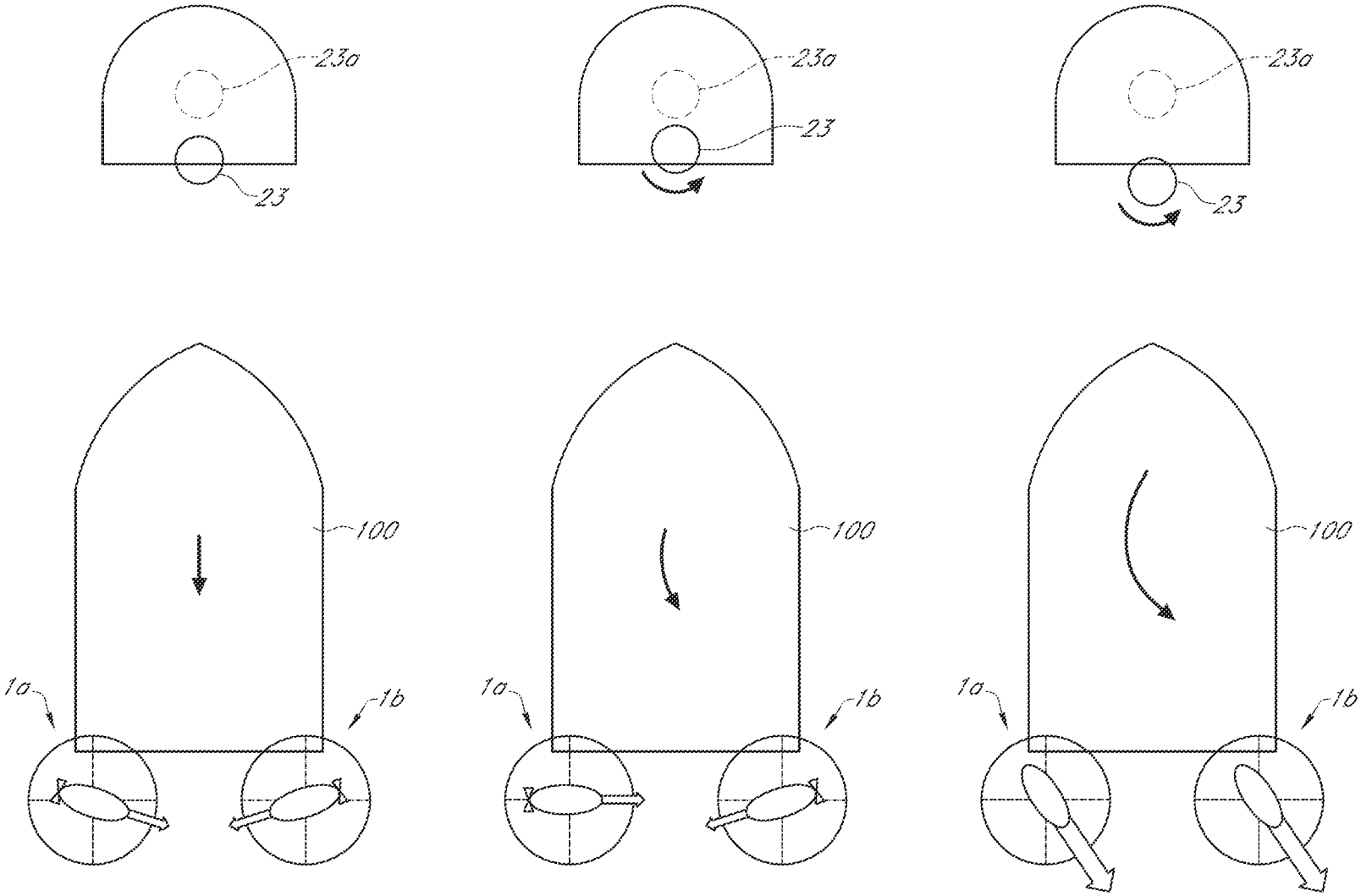
FIG. 9A is a schematic diagram showing control of the outboard motors in the first mode of operation for rearward movement.
FIG. 9B is a schematic diagram showing control of the outboard motors in a first composite mode of operation for rearward movement and counterclockwise rotation.
FIG. 9C is a schematic diagram showing control of the outboard motors in a second composite mode of operation for rearward movement and counterclockwise rotation.

FIG. 9A is a schematic diagram showing control of the outboard motors in a reverse sole operation for reverse movement, which can be the same as that described above with reference to FIG. 5A.

FIG. 9B is a schematic diagram illustrating control of the outboard motors 1*a*, 1*b* under a first reverse composite operation for reverse propulsion with counterclockwise rotation. In FIG. 9B, the joystick 23 has been moved to a first rearward position in the $R_L$ range, and twisted counterclockwise. In this case, the controller 10 can adjust the rudder angles of the outboard motors 1*a*, 1*b* such that the rudder angle of the left outboard motor 1*a* points directly towards or more towards the right outboard motor 1*b* such as about or approximately 90 degrees (e.g., the angle with potential variances of +/−5 degrees). Additionally, the controller 10 can adjust the rudder angle of the right outboard motor 1*b* to be directly at or more towards 180 degrees. Additionally, the controller 10 can maintain both outboard motors 1*a*, 1*b* in the forward gear 14*a* and at idle speed operation. As such, all, substantially all, or part of the thrust generated by the left outboard motor 1*a* is directed laterally in the +x direction. On the other hand, the right outboard 1*b* motor creates a thrust that is all, substantially or partly directed in the −y direction. Together, the net thrust generated by both outboard motors 1*a*, 1*b* creates a reverse thrust with counterclockwise rotation.

FIG. 9C is a schematic diagram illustrating control of the outboard motors 1*a*, 1*b* in a second rearward composite mode of operation for rearward movement and counterclockwise rotation. In FIG. 9C, the joystick 23 has been tilted to its rearward most position and has been rotated in the counterclockwise direction. In this case, the controller 10 operates in a reverse, super idle watercraft speed mode similar to that of FIG. 5B, and adjusts the rudder angles of the outboard motors 1*a*, 1*b* to provide for counterclockwise rotation. Thus, in the illustrated embodiment, the controller 10 adjusts the rudder angles of both of the outboard motors 1*a*, 1*b* to point towards quadrant B.

Figure 10A:
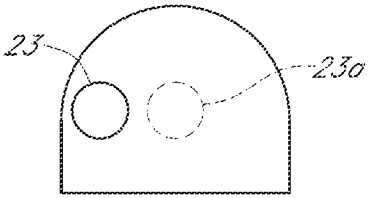
FIG. 10A is a schematic diagram showing control of the outboard motors in a first port side operation for lateral movement in the port side direction.
Figure 10A:
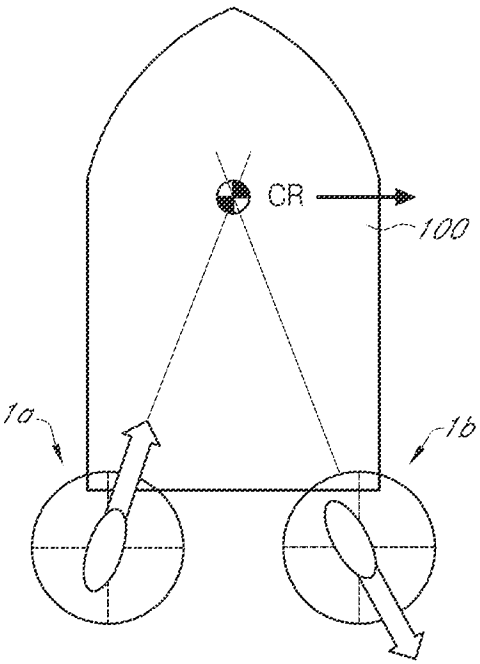

FIG. 10A is a schematic diagram illustrating control of the outboard motors 1*a*, 1*b* and a sole lateral movement operation for lateral movement to the left or portside. In FIG. 10A, the joystick 23 has been tilted to left of its default position 23*a*, in the −x direction. In this case, the controller 10 adjusts the rudder angles of the outboard motors 1*a*, 1*b* so as to generate no torque on the watercraft 100 and provide a net thrust in the −x lateral direction. This technique has been used commercially and disclosed in various patent publications, including U.S. Pat. No. 8,700,238 the entire contents of which is hereby incorporated by reference. As is well known, to create a lateral movement of a watercraft with two outboard motors, in the −x direction, or to the left, the rudder angle of the left outboard motor 1*a* is adjusted to point substantially directly away from the center of pressure CP of the watercraft, for example in quadrant C. This creates a thrust vector that passes through the center of pressure CP of the watercraft 100, thereby imparting no torque on the watercraft 100. Additionally, the controller 10 can be configured to adjust the rudder angle of the right outboard motor 1*b* to point towards quadrant D, directly or substantially directly at the center of pressure CP. As such, the right outboard motor 1*b* would create a torque vector that is directly or substantially directly at the center of pressure CP, thereby imparting no torque on the watercraft 100. However, with the ruder angles as such, a net lateral thrust is imparted to the watercraft, in the −x direction, thereby providing leftward lateral propulsion of the watercraft 100. In some embodiments, the controller 10 can also increase the power output of the engines 2*a*, 2*b* to move the watercraft 100 at a desirable speed.

Figure 10B:
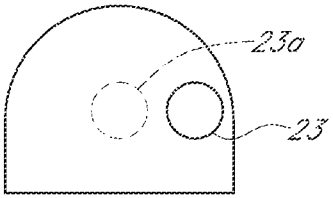
FIG. 10B is a schematic diagram showing control of the outboard motors in a first starboard side mode of operation for lateral movements toward the starboard side.

FIG. 10B is a schematic diagram illustrating control of the outboard motors 1*a*, 1*b* in a sole mode of operation for lateral movement in the +x direction or towards the starboard side. In FIG. 10B, the joystick 23 has been tilted to the right side, in the +x direction. In this case, the controller 10 adjusts the rudder angles of the left and right outboard motors 1*a*, 1*b* to create a lateral movement of the watercraft 100 in the +x direction or to the starboard side. Thus, the controller adjusts the rudder angles of the left outboard motors 1*a* to point towards the quadrant A, directly at the center of pressure CP and the rudder angle of the right outboard motor 1*b* to point towards the quadrant B, directly away from the center of pressure CP. Similarly to the mode of FIG. 10A, the outboard motors 1*a*, 1*b* thus do not impart any torques on the watercraft 100, but do impart a net lateral thrust in the +x direction.

Figure 10C:
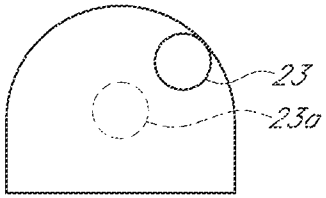
FIG. 10C is a schematic diagram showing control of the outboard motors in a first composite side and forward mode of operation for lateral movements toward the starboard side and forward.
Figure 10C:
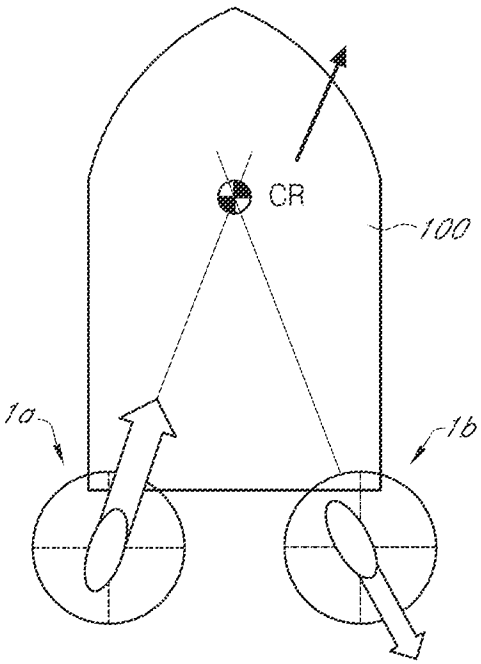

FIG. 10C is a schematic diagram illustrating control of the outboard motors 1*a*, 1*b* in a composite mode of operation for lateral movement in the +x direction or towards the starboard side, and forward. In FIG. 10C, the joystick 23 has been tilted to the right side, in the +x direction and tilted forward in the +y direction. In this case, the controller 10 adjusts the rudder angles of the left and right outboard motors 1*a*, 1*b* to create a lateral movement of the watercraft 100 in the +x direction or to the starboard side. Thus, the controller adjusts the rudder angles of the left outboard motors 1*a* to point towards the quadrant A, directly at the center of pressure CP and the rudder angle of the right outboard motor 1*b* to point towards the quadrant B, directly away from the center of pressure CP. Similarly to the mode of FIG. 10A, the outboard motors 1*a* and 1*b* thus do not impart any torques on the watercraft 100, but do impart a net lateral thrust in the +x direction. To obtain the additional forward thrust, the controller 10 increases the output of the outboard motor with the rudder angle that points forwardly, in this case, the left outboard motor 1*a*. As such, the watercraft 100 moves both rightward and forward.

Figures 11A, 11B:
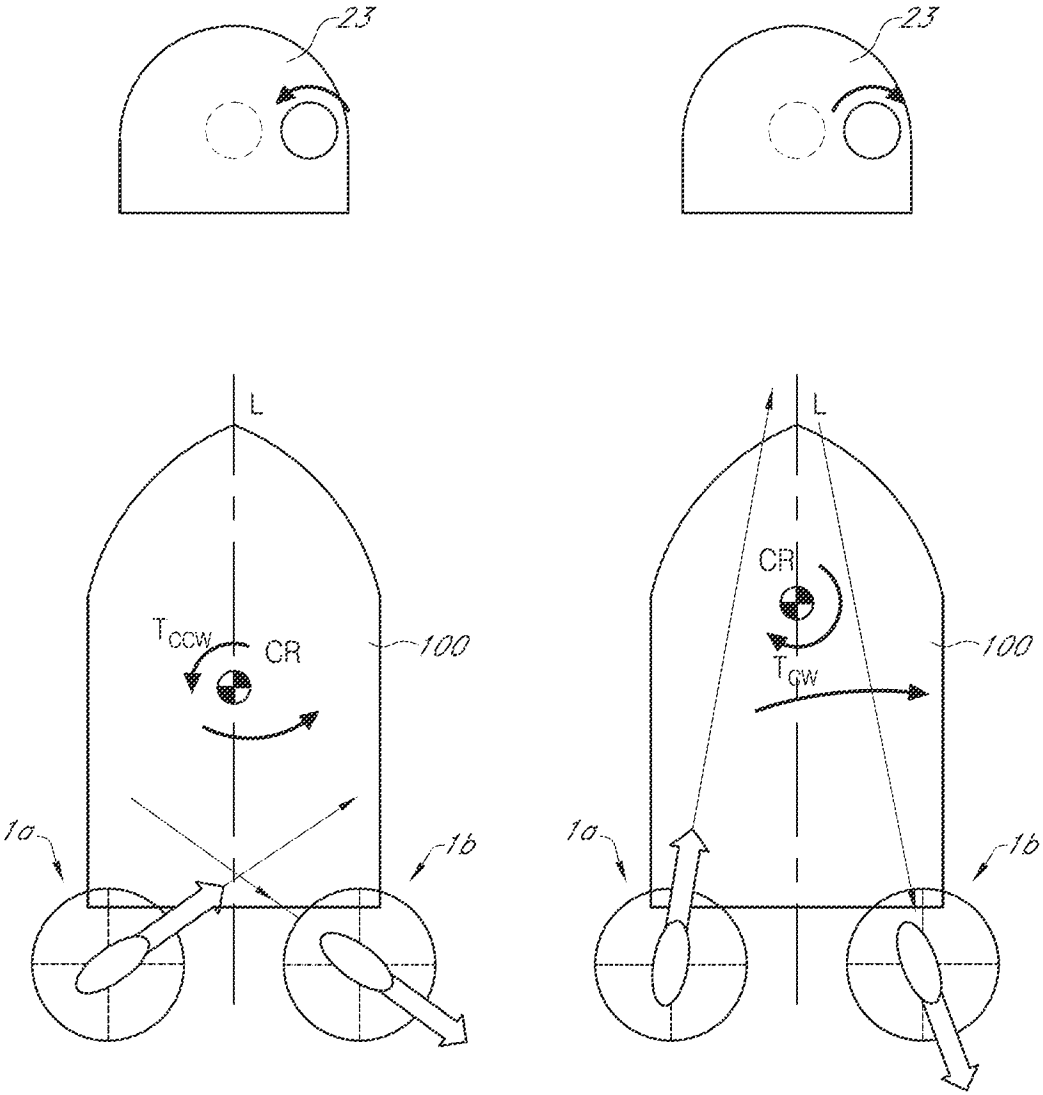
FIG. 11A is a schematic diagram showing control of the outboard motors in a first composite lateral mode of operation for movement toward the starboard side and with counterclockwise rotation.
FIG. 11B is a schematic diagram showing operation of the outboard motors in a second starboard composite mode of operation for movement in the starboard lateral direction with clockwise rotation.

FIG. 11A is a schematic diagram illustrating the control of the outboard motors 1*a*, 1*b* under a first composite operation for rightward movement and counterclockwise rotation. In this case, the controller 10 adjusts the rudder angle of the outboard motors 1*a*, 1*b* to create a lateral movement in the +x direction or towards the starboard side as well as a torque for rotating the watercraft in a counterclockwise direction. In this case, the controller 10 adjusts the rudder angles of the left outboard motor 1*a* to point towards quadrant A and the adjusts the rudder angle of the right outboard motor 1*b* to point towards quadrant B, both crossing the centerline L of the watercraft on the aft side of the center of pressure CP. The resulting thrust vectors of the outboard motors 1*a* and 1*b* both create a counterclockwise torque Tccw on the watercraft 100 and also produce a net lateral thrust in the +x direction. Thus, the watercraft 100 moves laterally to the starboard side as well as rotates in the counterclockwise direction.

FIG. 11B is a schematic diagram illustrating a second composite lateral mode of operation for movement rightward with clockwise rotation. In this case, the controller 10 adjusts the rudder angles of the outboard motors 1*a*, 1*b* to create a net clockwise torque about the center of pressure as well as a net lateral thrust in the +x direction. For example, the controller 10 can adjust the rudder angle of the left outboard motor 1*a* to create a thrust vector generally in the forward direction but greater than zero degrees. Additionally, the controller 10 can adjust the rudder angle of the right outboard motor 1*b* to create a generally rearward thrust vector largely rearward, both thrust vectors crossing the centerline L of the watercraft on the forward side of the center of pressure CP. As such, the thrusts generated by the outboard motors 1*a*, 1*b* can combine to create a net clockwise torque Tcw about the center of pressure CP. Additionally the thrust vectors have lateral components that produce a net lateral thrust on the watercraft 100 in the +x direction. Based on the above disclosure, those of ordinary skill in the art will understand how to achieve leftward lateral propulsion with clockwise and counter clockwise rotation.

Figure 12:
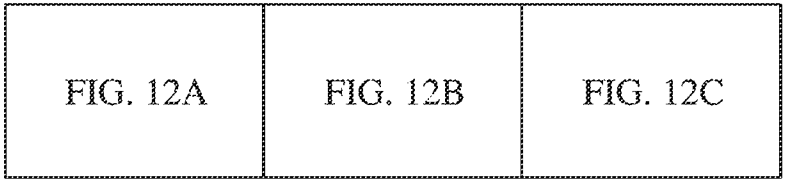
FIG. 12 shows FIGS. 12A-12C.
Figure 12A:
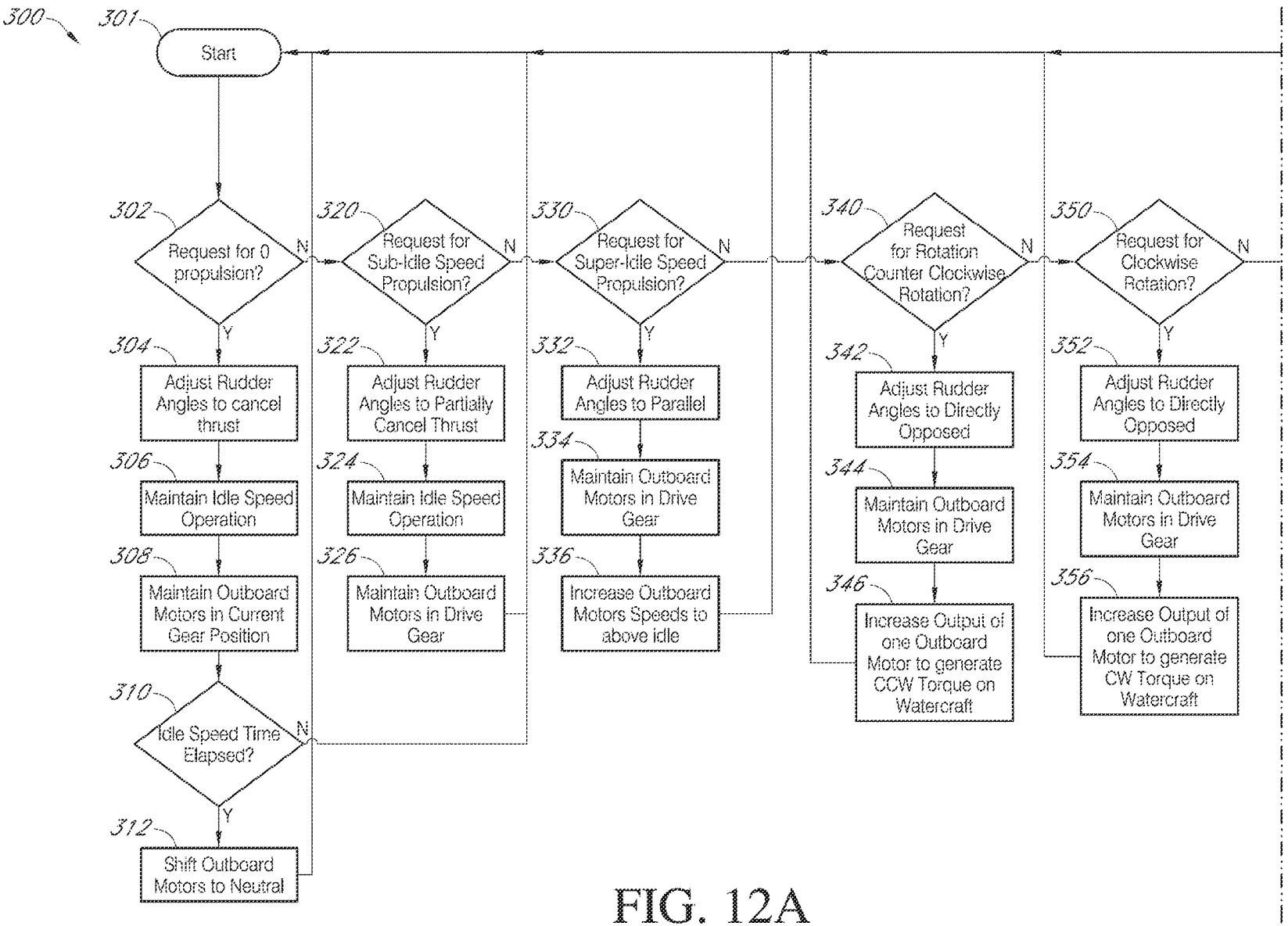
FIG. 12A is a first portion of a flowchart illustrating a control routine that can be used with the watercraft system of FIG. 3.
Figure 12B:
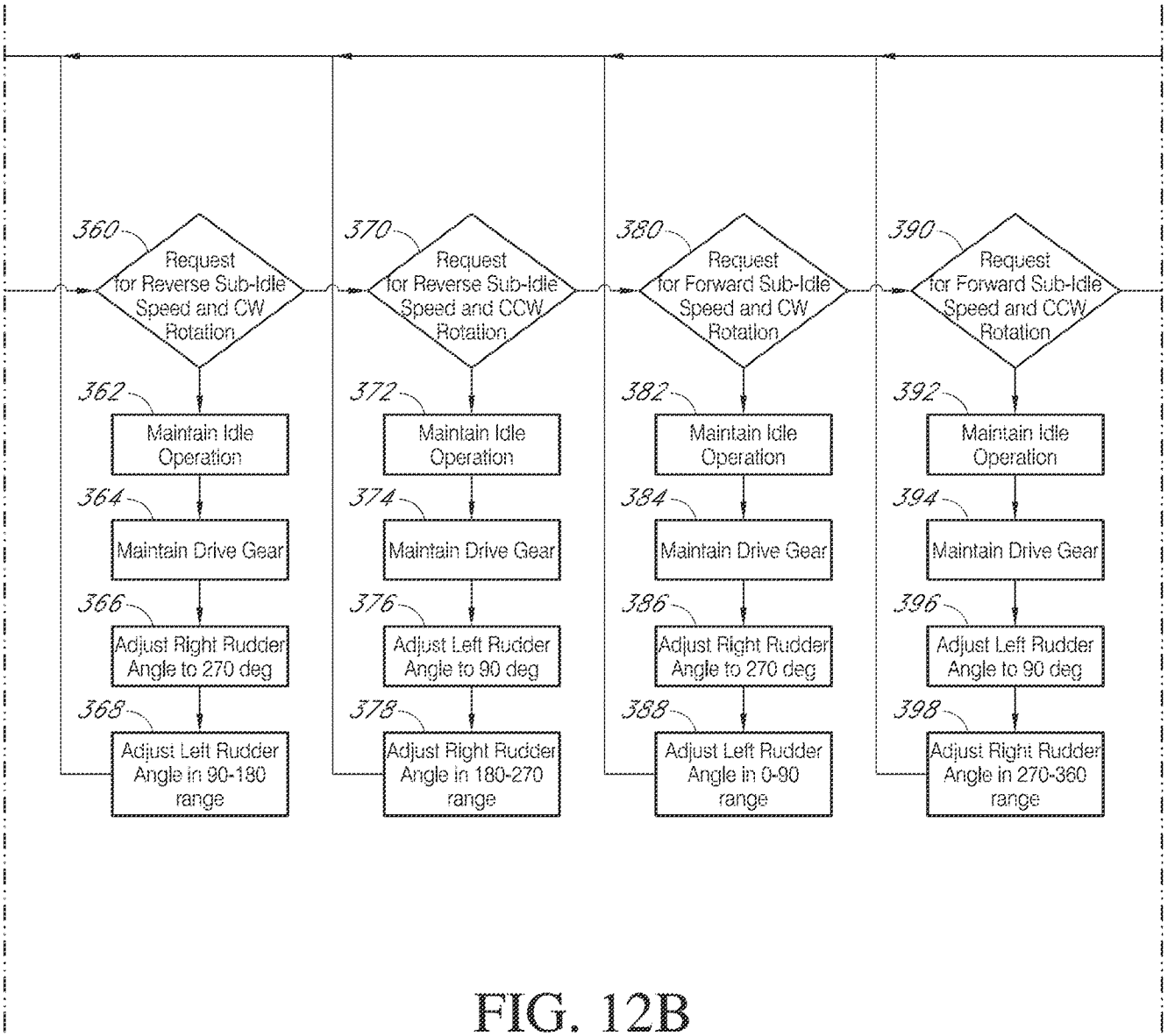
FIG. 12B is a second portion of the flowchart partially illustrated in FIG. 12A.
Figure 12C:
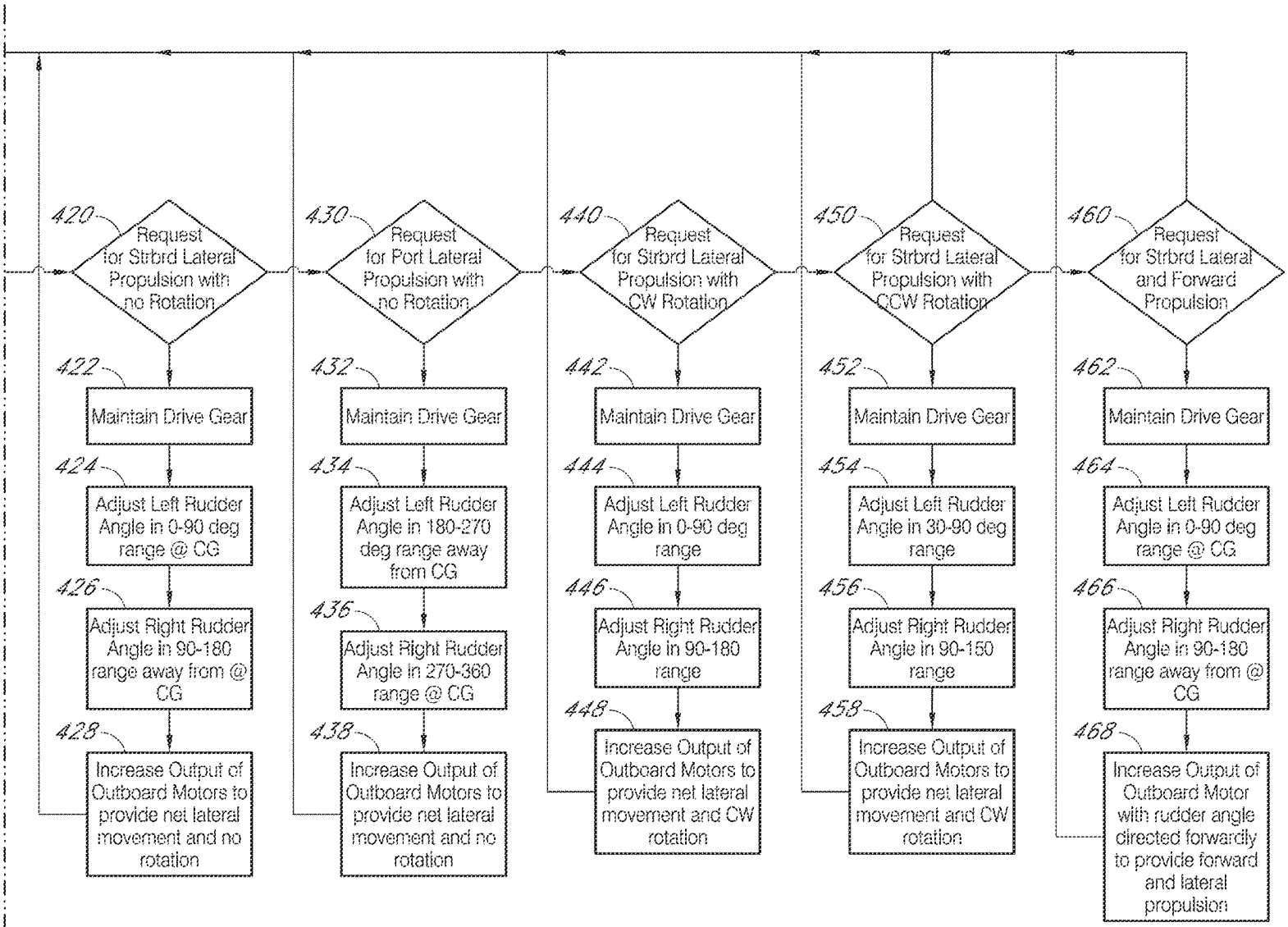
FIG. 12C is a third portion of the flowchart partially illustrated in FIG. 12A.

FIGS. 12A-12C illustrate a control routine 300 that can accommodate various modes of operation, including "sole operation" and "composite operations". For example, the control routine 300 can include an operation block 301 in which the routine starts. The control routine, as noted above, can accommodate various different modes of operation.

For example, with respect to the zero propulsion mode described above with FIG. 4A, the control routine can include decision block 302 in which whether the user has issued a request for zero propulsion is determined. For example, the controller 10 can determine, with the sensor 230, whether the joystick 23 is in its default position 23*a* (FIG. 4A). When it is determined that the joystick 23 is in the default joystick position 23*a*, the routine can move on to operation block 304.

In operation block 304, the controller 10 can adjust the rudder angles of the outboard motors 1*a*, 1*b* to be in direct opposition, to thereby cancel all thrust or substantially all thrust generated by the outboard motors 1*a*, 1*b*. The motors 1*a*, 1*b* can be maintained at an idle speed operation (operation block 306). Additionally, the outboard motors 1*a*, 1*b* can be maintained in the then current gear position (operation block 308). For example, in some embodiments, when the shift actuators 7*a*, 7*b* are already in forward gear, they can be left in that position. On the other hand, when the shift actuators 7*a*, 7*b* are in neutral, they can be left in that position. In other options, at the operation block 308, the shift actuator 7A, 7B can be controlled to shift the outboard motors 1*a*, 1*b* into forward gear.

Optionally, following the operation block 308, the routine 300 can move onto decision block 310. In the optional decision block 310, it can be determined whether or not the outboard motors 1*a*, 1*b* have been in zero propulsion mode for a particular period of time (e.g., a predetermined amount of time). For example, the predetermined amount of time can be any amount of time including 30 seconds, one minute, two minutes, three minutes or more. When in decision block 310 it is determined that the predetermined time has elapsed, the outboard motors 1*a*, 1*b* can be shifted into neutral (operation block 312). After the operation bock 312, the routine 300 can return to start (the operation block 301). On the other hand, when in the decision block 310, it has been determined that the outboard motors 1*a*, 1*b* have not been operating in the zero propulsion mode for the predetermined amount of time, the routine 300 can return to the start (the operation block 301).

Further, when in the decision block 302 it is determined that there has not been a request for a zero propulsion, the operation 300 can move to decision block 320.

In the decision block 320, it can be determined whether there has been a request for sub idle speed propulsion. For example, the controller 10 can determine whether the joystick 23 has been moved to any position within a first range of movement $R_L$ associated with sub idle speed movement. When it is determined that there has been a request received for sub idle speed movement, the rudder angles of the outboard motors 1*a*, 1*b* can be adjusted to provide some net thrust (forward or rearward) and also to partially cancel thrust (operation block 322). For example, the rudder angles of the outboard motors 1*a*, 1*b* can be adjusted as described above with reference to FIGS. 4B and 5A. Additionally, the outboard motors 1*a*, 1*b* can be maintained at idle operation, for example, leaving the throttle valves of the outboard motors 1*a*, 1*b* at the idle positions (operation block 324). Additionally, the outboard motors 1*a*, 1*b* can be maintained in a drive gear, such as forward (operation bock 326). After the operation block 326, the routine 300 can return to the start (the operation block 301).

When, at the decision block 323, it is determined that a request for sub idle speed propulsion has not been received, the routine 300 can move to decision block 330. In the decision block 330 whether there has been a request for super idle speed propulsion can be determined. For example, the controller 10 can detect whether the joystick 23 has been moved to super idle speed range $F_H$ or $R_H$, as described above with reference to FIGS. 4C, 4D, 5B, and 5C. When it has been determined that the joystick 23 has been moved into the super idle speed propulsion range $F_H$ or $R_h$, the routine can continue to adjust the rudder angles of the outboard motors 1*a*, 1*b* to parallel, for example, parallel with the longitudinal axis L of the watercraft 100 (operation block 332). Additionally, the controller 10 can maintain the outboard motors 1*a*, 1*b* in a forward drive gear (operation block 334). Further, the controller can adjust the output of the outboard motors 1*a*, 1*b* for example, by controlling the position of the throttle valves, to increase the output of the outboard motors 1*a*, 1*b* to engine speeds above idle. After the operation block 336, the routine 300 can return to the start (the operation block 301).

When, in the decision block 330, it is determined that there has not been a request for super idle speed propulsion, the operation 300 can move to decision block 340. In the decision block 340, it can be determined whether there has been a request for counterclockwise rotation. For example, the controller 10 can read an output of the sensor 230 to determine if the joystick 23 has been twisted about the z axis. When it is determined that there has been a request for counter-clockwise rotation, the operation 300 can continue to operation block 342 in which the rudder angles of the outboard motors 1*a*, 1*b* are adjusted to be directly opposed, for example, in the orientation illustrated in FIG. 7. Additionally, the outboard motors 1*a*, 1*b* can be maintained in a drive gear (operation block 344) and the output of the left outboard motor 1*a* can be increased to an output greater than an output of the right outboard motor 1*b* then operating, to thereby create a net positive counter-clockwise torque on the watercraft 100, as described above with reference to FIG. 7. After the operation block 346, the routine 300 can return to start (the operation block 301).

When, in the decision block 340, it is determined that counter-clockwise rotation has not been requested, the routine 300 moves on to decision block 350. In the decision block 350, it can be determined whether a request for clockwise rotation has been requested. When a request for clockwise rotation has been requested, the rudder angles of the left and right outboard motors 1*a*, 1*b* can be adjusted to be in direct opposition (operation block 352), the outboard motors 1*a*, 1*b* can be maintained in a drive gear (operation block 354), and the output of the right outboard motor 1*b* can be increased to an output greater than that of the left outboard motor 1*a*, to thereby create a clockwise torque on the watercraft 100, as described above with reference to FIG. 6. After the operation block 356, the routine 300 can return to start (the operation block 301). When, in the operation block 350, it is determined that clockwise rotation has not been requested, the routine 300 can move to decision block 360.

In the decision block 360, it can be determined whether a request for a reverse sub idle speed and clockwise rotation has been requested. when a request for a reverse sub idle speed and clockwise rotation has been requested, the routine 300 can move on to operation block 362 and maintain idle operation of both outboard motors 1*a*, 1*b*, maintain both outboard motors 1*a*, 1*b* in a drive gear (operation block 364), adjust the right rudder angle to approximately 270°, including variances of +/−5° (operation block 366), and adjust the left rudder angle to the range of 90° to 180° (operation block 368), in the manner described above with reference to FIG. 9B. As such, reverse sub idle speed and clockwise rotation of the watercraft 100 would result. After operation block 368, the routine 300 can return to start (the operation block 301).

When, in the decision block 360, it has been determined that there has been no request for reverse sub idle speed and clockwise rotation, the routine 300 can move to decision block 370. In the decision block 370, it can be determined whether a reverse sub idle speed and counter-clockwise rotation has been requested. When a reverse sub idle speed and counter-clockwise rotation has been requested, the routine 300 can move on to operation block 372 and maintain both outboard motors 1*a*, 1*b* in idle operation. Additionally, both outboard motors 1*a*, 1*b* can be maintained in a drive gear (operation block 374), the left rudder angle can be adjusted to approximately 90°, such as 90+/−5° (operation block 376), and the right rudder angle can be adjusted in a range of 180° to 270°, as described above with reference to FIG. 9B. As such, reverse sub idle speed and counter-clockwise rotation of the watercraft 100 would result. After the operation block 378, the routine 300 can return to start (the operation block 301).

When, in the decision block 370, it is determined that a request for reverse sub idle and counter-clockwise rotation has not been requested, the routine 300 can move to decision block 380. In the decision block 380, it can be determined whether a request for forward sub idle speed and clockwise rotation has been requested. When a request for forward sub idle speed and clockwise rotation has been requested, the outboard motors 1*a*, 1*b* can be maintained in an idle operation (operation block 382), the outboard motors 1*a*, 1*b* can be maintained in a drive gear (operation block 384). The right rudder angle can be adjusted to approximately 270°, such as 270+/−5° (operation block 386) and the left rudder angle can be adjusted to an angle within the range of 0° to 90° (operation block 388). As such, forward sub idle speed and clockwise rotation of the watercraft 100 would result. After the operation block 388, the routine 300 can be returned to start the (operation block 301).

When, in the decision block 380, it is determined that a request for forward sub idle speed and clockwise rotation has not been requested, the routine 300 can move to decision block 390. In the decision block 390, it can be determined whether a forward sub idle speed and counter-clockwise rotation has been requested. When a forward sub idle speed and counter-clockwise has been requested, the outboard motors 1*a*, 1*b* can be maintained at idle (operation block 392), the outboard motors 1*a*, 1*b* can be maintained in a drive gear (operation block 394), the left rudder angle can be adjust to approximately 90°, such as 90+/−5° (operation block 396), and the right rudder angle can be adjust to an angle within the range of 270°-360° (operation block 398), as described above with reference to FIG. 8B. As a result, forward sub idle speed and counter-clockwise rotation of the watercraft 100 would result. After the operation block 398, the routine 300 can return to start (the operation block 301).

When, in the decision block 390, a forward sub idle speed and counter-clockwise rotation has not been requested, the routine 300 can move onto decision block 420 (FIG. 12C).

In decision block 420 it can be determined whether there has been a request for starboard lateral propulsion with no rotation and if so the routine 300 moves to operation block 422. In operation block 422 the outboard motors 1*a*, 1*b* can be maintained in a drive gear, such as forward. Additionally, the left rudder angle can be adjusted in the 0° to 90° range to be directed at the center of pressure CP of the watercraft 100 and in operation block 426, the right rudder angle can be adjusted to the range of 90° to 180° and directed substantially away from the center of pressure CP, as described above with reference to FIG. 10B. Optionally, operation block 428, the output of the outboard motors 1*a*, 1*b* can be increased to provide the desired amount of movement of the watercraft 100 by the outboard motors 1*a*, 1*b*. After the operation block 428, the routine 300 can return to start (the operation block 301).

When, in the decision block 420, it is determined that a request for starboard lateral propulsion has not been received, the routine can move to the decision block 430. In the decision block 430, it can be determined whether there has been a request for port lateral movement with no rotation. When it has been determined that a request has been received for port lateral propulsion with no rotation, the outboard motors 1*a*, 1*b* can be maintained in a drive gear (operation block 432) and the left rudder angle can be adjusted to 180° to 270° substantially away from the center of pressure CP of the watercraft 100 (operation block 434) and the right rudder angle can be adjusted to a range of 270° to 360°, and substantially directly at the center of pressure CP (operation block 436), such as that described above with reference to FIG. 10A. Optionally, the output of the outboard motors 1*a*, 1*b* can be increased to provide the desired speed of lateral movement (operation block 438), as described above with reference to FIG. 10A. After the operation block 438, the routine 300 can return to start (the operation block 301).

When, in the decision block 430, it is determined that a request for port-side lateral movement with no rotation has not been received, the routine 300 can move on to decision block 440. In the decision block 440 it can be determined whether a request has been received for starboard lateral propulsion with clockwise rotation. When such a request has been received, the outboard motors can be maintained in a drive gear, such as forward (operation block 442), the left rudder angle can be adjusted to the 0° to 90° range so as to pass on the left side of the center of pressure CP of the watercraft 100 (operation block 444) and the right rudder angle can be adjust to the 90° to 100° range along the direction passing to the right of the center of pressure CP of the watercraft 100 (operation block 446). This would result in a net clockwise torque on the watercraft 100, as well as a net starboard lateral thrust on the watercraft 100, causing both lateral movement towards the starboard-side plus clockwise rotation, as described above with reference to FIG. 11B. Additionally, in operation block 448, the output of the outboard motors 1*a*, 1*b* can be increased to provide the desired rate of movement and rotation (operation block 448). After the operation block 448, the routine can return to start (the operation block 301).

When, in the decision block 440, it is determined that a request for starboard lateral propulsion with clockwise rotation has not been received, the routine 300 can move to the decision block 450. In the decision block 450, it can be determined whether a request for starboard lateral propulsion with counter-clockwise rotation has been received. When such a request has been received, the outboard motors 1*a*, 1*b* can be maintained in a drive gear (e.g., the forward gear 14*a*) (operation block 452), the left rudder angle can be adjusted to the 0° to 90° range along an angle that passes to the right of the center of pressure CP of the watercraft (operation block 454) and the right rudder angle can be adjust to the 90° to 180° range along a direction that passes to the left of the center of pressure CP of the watercraft 100 (operation block 456). These orientations would generate a net starboard lateral thrust and a net counter clockwise torque on the watercraft as described above with reference to FIG. 11A. Optionally, the output of the outboard motors 1*a*, 1*b* can be increased to provide a desired rate of movement of the watercraft (operation block 458). After the operation block 458, the routine can return to start (the operation block 301).

When, in the decision block 450, a starboard lateral propulsion with counter-clockwise rotation has not been requested, the routine 300 can move onto decision block 460.

In the decision block 460 it can be determined whether there has been a request for starboard lateral and forward propulsion has been received, and when so, the routine 300 moves to operation block 462. In the operation block 462 the outboard motors 1*a*, 1*b* can be maintained in a drive gear, such as the forward gear 14*a*. Additionally, the left rudder angle can be adjusted in the 0° to 90° range to be directed at the center of pressure CP of the watercraft 100 and in operation block 466, the right rudder angle can be adjusted to the range of 90° to 180° and directed substantially away from the center of pressure CP, as described above with reference to FIG. 10C. In operation block 468, the output of the left outboard motors 1*a* can be further increased to provide additional forward thrust, thereby providing both starboard lateral and forward movement of the watercraft 100. After the operation block 468, the routine 300 can return to start (the operation block 301).

Figure 13:
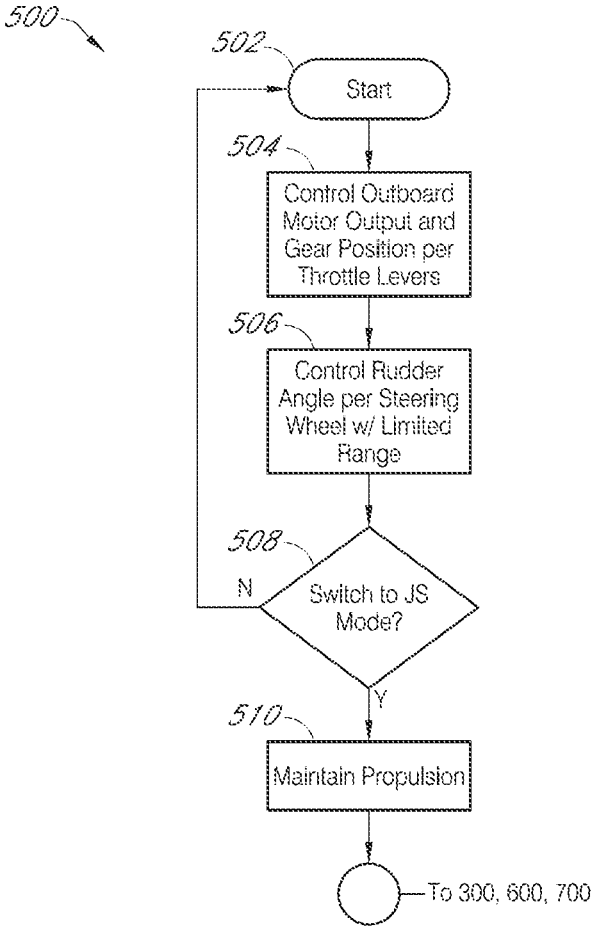
FIG. 13 is a flowchart illustrating a control routine that can be used with the watercraft system of FIG. 3 for controlling the transition to joystick mode control.

FIG. 13 illustrates a control routine 500 that can be used for transitioning control of the outboard motors 1*a*, 1*b* from first mode in which they are controlled based at least in part on the steering wheel and throttle levers 22*a*, 22*b*, to a second (joystick) mode in which the joystick 23 is used for propulsion control. For example, the control routine 500 can start with operation block 502 and move to operation block 504.

In the operation block 504, the throttle opening and gear position of the outboard motors 1*a*, 1*b* are controlled in accordance with the position of the throttle levers 22*a*, 22*b*. Additionally, the rudder angles of the outboard motors 1*a*, 1*b* are controlled in accordance with the position of the steering wheel 21. Optionally, in some embodiments, the maximum rudder angles of the outboard motors 1*a*, 1*b* can be limited to approximately 30° or less when the controller 10 is adjusting the rudder angles according to the position of the steering wheel 21. In other embodiments, the controller 10 can be configured to limit maximum rudder angle of the outboard motors 1*a*, 1*b* in accordance with the curves 200-208 of FIG. 16, as described above.

The routine 500 can move to decision block 508 in which it is determined whether or not propulsion control has been switched to joystick mode. For example, the housing for mounting the throttle levers 22*a*, 22*b*, or the housing for mounting the joystick 23 can include a button for signaling the controller 10 to switch modes, or other techniques can be used to switch to joystick mode. When it is determined that the joystick mode has not been activated, the routine can return to start block 502. On the other hand, when it is determined that the joystick mode has been initiated, the routine 500 moves to operation block 510.

In the operation block 510, the controller 10 can control the outboard motors to maintain the then-current propulsion of the watercraft 100. For example, when prior to the time operation block 510 is initiated, the controller 10 was controlling the left and right outboard motors 1*a*, 1*b* to generate forward propulsion at 50% throttle opening, then at the operation block 510, the controller 10 can continue operating the left and right outboard motors 1*a*, 1*b* at 50% throttle opening, despite the joystick being at its default position 23*a*. In another operating condition, when, prior to the time operation block 510 is initiated, the controller 10 was controlling the left and right outboard motors 1*a*, 1*b* to be at idle in a neutral gear position, then at the operation block 510, the controller 10 can continue operating the left and right outboard motors 1*a*, 1*b* at idle, adjust the rudder angles to be directly opposed, and shift into drive gear (e.g., the forward gear 14*a*). After the operation block 510, the routine 500 can continue to the routine 300 (FIG. 12), a routine 600 (FIG. 14, below), or a routine 700 (FIG. 15, below).

Figure 14:
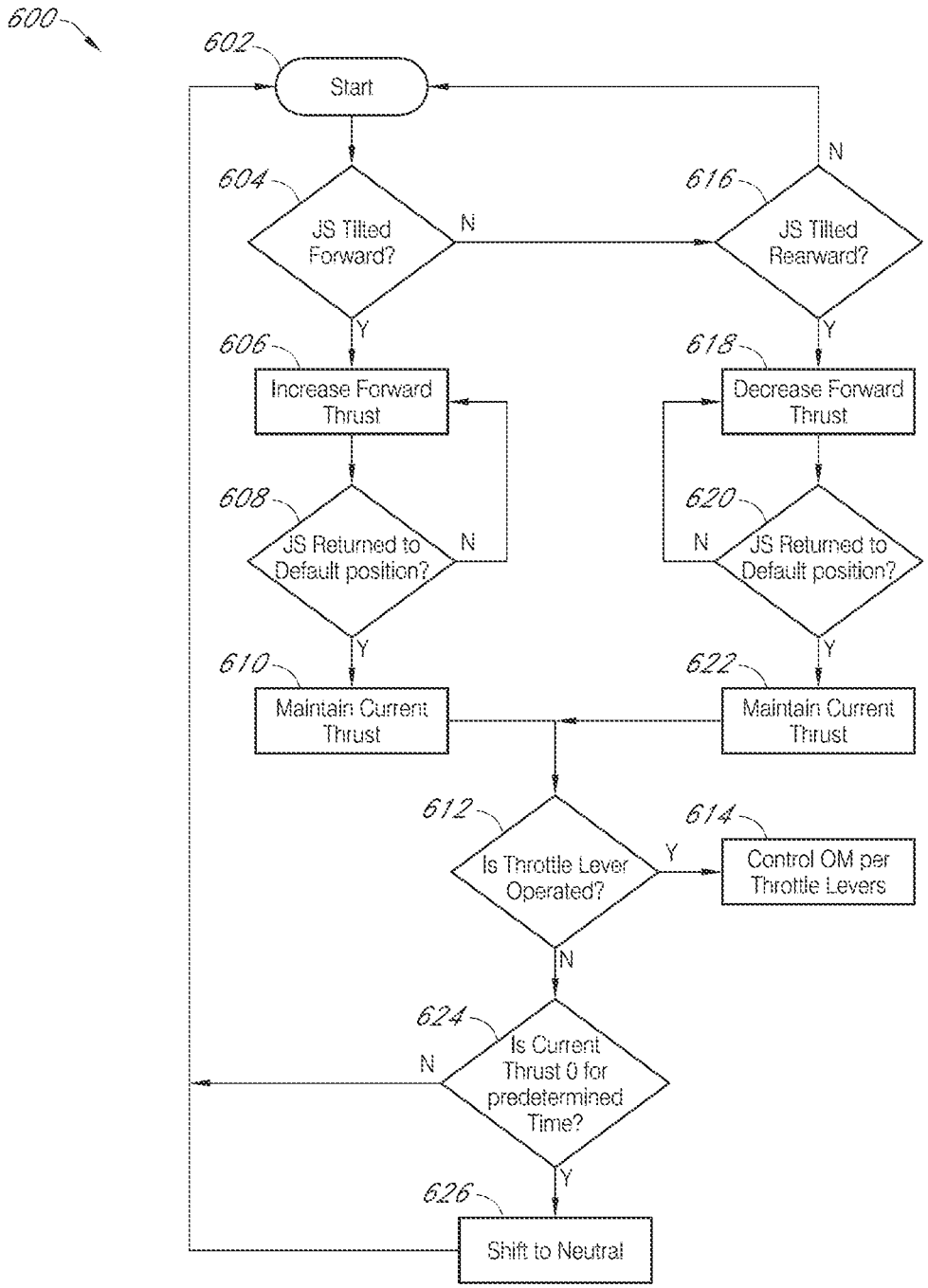
FIG. 14 is a flowchart of a control routine that can be used with a watercraft system of FIG. 3 for cruise control mode operation with joystick position integration.
Figure 15:
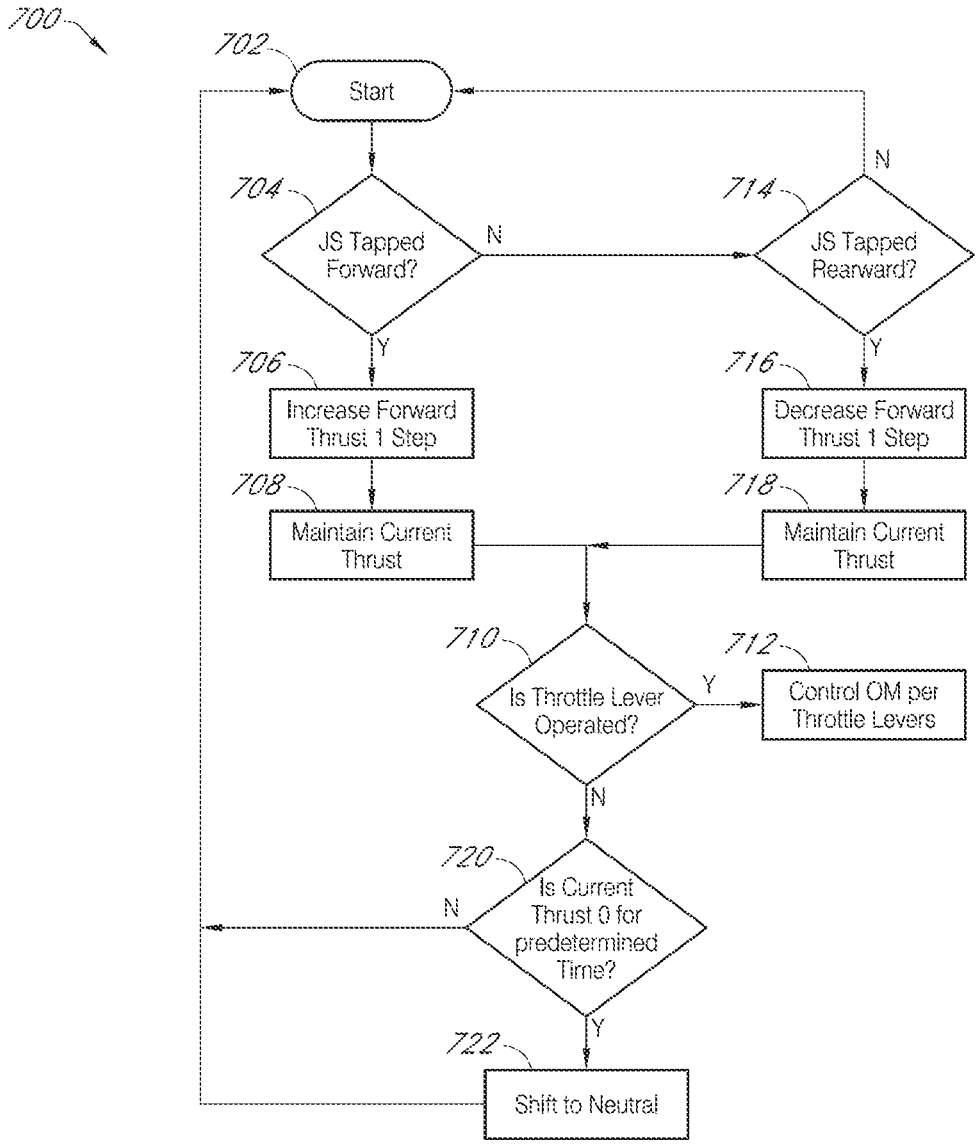
FIG. 15 is a flowchart illustrating a control routine that can be used with a watercraft system of FIG. 3 for cruise control operation with tap mode.

FIG. 14 illustrates the control routine 600 that can be used in a joystick-operated, cruise control mode. For example, the controller 10 can be configured to operate the outboard motors 1*a*, 1*b* in a cruise control mode for operation at various watercraft speeds, based at least in part on inputs to the joystick 23 in which propulsion is maintained even after the joystick 23 has been returned to its default position 23*a*. For example, the routine 600, can be considered a sub routine, can begin operation block 602. The controller 10 can determine if the joystick 23 has been tilted in a forward position (decision block 604), and when so increase forward thrust or reduce rearward thrust (operation block 606). For example, in this mode of operation, the controller 10 can provide for a smooth and/or continuous increase in thrust depending on the tilting of the joystick 23 in the forward direction. In some operating conditions, prior to the execution of operation block 606, the controller 10 might be currently operating the outboard motors 1*a*, 1*b* to produce a net forward thrust and thus forward propulsion of the watercraft 100. As such, the controller 10 would increase forward thrust in operation block 606. In other scenarios, for example, when the controller 10 was currently operating the outboard motors 1*a*, 1*b* to produce a net rearward thrust and thus rearward propulsion of the watercraft 100, the controller 10 would then decrease rearward thrust in operation block 606.

In some embodiments, to increase forward thrust, the controller 10 can be configured to increase the power output from the outboard motors 1*a*, 1*b*, for example by opening the throttle valves of the engines 2*a*, 2*b* to a degree proportional to the deflection or tilting of the joystick 23. Optionally, the controller 10 can incorporate an integrator unit, to increase the power output of the outboard motors 1*a*, 1*b*, for example, by opening the throttle valves more gradually than the detected movement of the joystick 23, based at least in part on an integration of the detected position of the joystick 23. As described above with reference to FIG. 3, the controller 10 can include an integrator unit, other structures or software for providing such an integrator operation.

After the operation block 606, the routine 600 can move to decision block 608 in which it is determined whether the joystick 23 has been returned to the default position 23*a*. When it is determined that the joystick 23 has not been returned to the default position 23*a*, the routine 600 can return to operation block 606 and continue to increase forward thrust. On the other hand, when it is determined in decision block 608 that the joystick 23 has not been returned to the default position 23*a*, the routine 600 can move to operation block 610.

In the operation block 610, the then-current thrust generated by the outboard motors 1*a*, 1*b* can be maintained. For example, the controller 10 can maintain the power output of the outboard motors 1*a*, 1*b* by maintaining the position of the throttle valves in the engines 2*a*, 2*b* at their then-current position. As such, the watercraft 100 will continue under the thrust generated by the outboard motors 1*a*, 1*b*, despite the joystick 23 having returned to the default position 23*a*. Alternatively, in the operation block 610, the controller 10 can incorporate a speed control function to maintain a detected watercraft speed.

The routine 600 can then move to decision block 612 in which it is determine whether the throttle levers 22*a*, 22*b* have been operated. For example, the controller 10 can detect the output of sensors 221, 222 to determine that the throttle levers 22*a*, 22*b* have been moved. When it is determined that the throttle levers 22*a*, 22*b* have been moved, the routine 600 can move to operation block 614 and end the cruise control mode and control the output of the outboard motors 1*a*, 1*b* based on the throttle levers 22*a*, 22*b* and the rudder angles according to the steering wheel 21, effectively terminating the cruise control mode.

On the other hand, when it is determined that the throttle levers 22*a*, 22*b* have not been operated, the routine 600 can move to optional decision block 624 to determine whether the current thrust request has been zero for a predetermined amount of time. For example, a zero thrust request could occur in this mode when the watercraft was under rearward propulsion and the user had pushed the joystick 23 forward sufficiently to result in the controller 10 determining that a zero thrust has been requested. When a zero thrust has been requested for a particular time frame (e.g., a predetermined amount of time), the routine 600 can move to operation block 626 and shift the outboard motors 1*a*, 1*b* to neutral. The routine 600 can then return to start (the operation block 602). On the other hand, if it is determined that a zero thrust has not been requested for a predetermined amount of time, the routine 600 can move from the decision block 624 to start (the operation block 602).

When, in the decision block 604, it is determined that the joystick 23 has not been tilted forward, the routine 600 can move to decision block 616. In the decision block 616, it can be determined whether the joystick 23 has been tilted rearwardly. When it is determined that the joystick 23 has not been tilted rearwardly, the routine 600 can return to start 602.

On the other hand, when, in the decision block 616, it is determined that the joystick 23 has been tilted rearwardly, the routine 600 moves to operation block 618.

In the operation block 618, controller 10 decreases forward thrust or increase rearward thrust of the outboard motors 1*a*, 1*b*. As described above with regard to the operation block 606, in the operation block 618, the controller 10 can decrease the forward thrust being generated by the outboard motors 1*a*, 1*b* by an amount proportional to the movement or the tilt angle of the joystick 23 in the rearward direction. In some embodiments, when the outboard motors 1*a*, 1*b* were then providing a current forward thrust, then the controller 10 could reduce the amount of forward thrust in proportion to the movement of the joystick 23 in the rearward direction. Alternatively, when the thrust then existing was zero, the controller 10 can then generate a rearward thrust. On the other hand, when the thrust from the outboard motors 1*a*, 1*b* was already a rearward thrust, the rearward thrust can be increased. Additionally, the decrease of forward thrust can be considered as an increase of negative (−) forward thrust, or in other words, an increase of rearward thrust.

After the operation block 616, the routine 600 can move to decision block 620. In the decision block 620, it can be determined whether the joystick 23 has been returned to the default position 23*a*. When it determined that the joystick 23 has not been returned to the default position 23*a*, the routine 600 can return to operation block 618 and continue to decrease forward thrust. On the hand, when it is determined in the decision block 620 that the joystick 23 has been returned to the default position 23*a*, the routine 600 moves to operation block 622 and maintains the then-current thrust whether it is a positive forward thrust or a negative forward thrust (e.g., a rearward thrust). After the operation block 622, the routine 600 can move to decision block 612 and repeat as described above.

Optionally, during operation of the routine 600, the controller 10 can be configured to control the rudder angles of the outboard motors 1*a*, 1*b* in accordance with a twisting movement of the joystick 23, rightward or leftward. In some embodiments, the controller 10 can be configured to control the rudder angles of the outboard motors 1*a*, 1*b* in accordance with a lateral, leftward and rightward tilting of the joystick 23, in this mode of operation. Further, optionally, the maximum steering angles of the outboard motors 1*a*, 1*b* can be limited in accordance with the above description of FIG. 16 when the outboard motors 1*a*, 1*b* are operated in super idle watercraft speed modes, e.g., when the throttle valves of the engines are opened to greater than 0%.

FIG. 15 illustrates another control routine 700 that can be used for an alternative joystick cruise control mode in which thrust is changed in a stepwise-manner in response to inputs to the joystick 23. For example, the routine 700 can start at operation block 702 and determine whether the joystick 23 is "tapped" in a forward direction (decision block 704) or "tapped" in a rearward direction (decision block 714). One example, of a "tap" input to the joystick can be when the joystick 23 is tilted, forward or rearward, then returned to the default position 23*a*. Such an input would be characterized by the controller receiving a signal from the sensor 230, corresponding to a forward or rearward movement of the joystick 23, followed by another signal indicating that the joystick 23 has returned to the default position 23*a*. Optionally, the controller 10 can be configured to recognize a dead zone of joystick movements. For example, the controller 10 can be configured to ignore tilting of the joystick 23 when the tilting is less than a particular value, such as a predetermined amount of the range of movement of the joystick, e.g., 10%, or any other desired limit. Other limitations can also be used for distinguishing between an intentional and unintentional "taps".

When it is determined, in decision block 704, that the joystick 23 has been "tapped" in the forward direction, the routine 700 moves to operation block 706 and increases forward thrust one step, or by one amount (e.g., a predetermined amount). In some situations, the then-current thrust generated by the outboard motors 1*a*, 1*b* could be in the net rearward direction. Thus, in operation block 706 in which the forward thrust in increased by one step, the then-current rearward thrust would be reduced by one step. Additionally, the then existing thrust produced by the outboard motors 1*a*, 1*b* could be zero. In that situation, in operation block 706, the net thrust generated by the outboard motors 1*a*, 1*b* would be increased from zero to a net forward thrust. Similarly, when the net thrust generated by the outboard motors 1*a*, 1*b* already was a positive forward thrust, the thrust, in operation block 706, would be increased by a step. As described above, any number of steps can be used over any range of propulsion modes, including sub idle and super idle ranges of propulsion. After the operation block 706, the routine 700 can move to operation block 708.

In the operation block 708, the then-current thrust generated by the outboard motors 1*a*, 1*b* is maintained, despite the joystick 23 having returned to its default position 23*a* after having been "tapped" as described above. After operation block 708, the routine 700 moves to decision block 710 in which it can be determined whether either of the throttle levers 22*a* or 22*b* have been operated. When it is determined that either of the throttle levers 22*a* or 22*b* have been operated, the routine 700 moves to operation block 712 and terminates the joystick cruise control mode and thus control of the output of the outboard motors 1*a*, 1*b* is controlled in accordance with the throttle levers 22*a*, 22*b* and the rudder angles are controlled based on signals from the steering wheel sensor 210.

On the other hand, when it is determined in decision block 710 that the throttle levers 22*a* or 22*b* have not been operated, the routine 700 can move to operation block 720 to determine whether zero thrust has been requested for a particular time frame (e.g., a predetermined amount of time). As described above with reference to the decision block 612, the controller 10 can determine whether the outboard motors 1*a*, 1*b* have been operated at a zero thrust mode for a predetermined amount of time. when it is determined that the then-current thrust has not been zero for a predetermined amount of time, the routine 700 can return to start (operation block 702). On the other hand, when it is been determined that the then-current thrust has been zero for a predetermined amount of time, the routine moves to operation block 722 and shifts the outboard motors 1*a*, 1*b* to neutral and returns to start (the operation block 702).

When it is determined in the decision block 714 that the joystick 23 has not been tapped in a rearward direction, the routine 700 can return to start (operation block 702). On the other hand, when it is determined in decision block 714 that the joystick has been tapped rearwardly, the routine can move to operation block 714 and decrease forward thrust by one step. For example, as described above with reference to FIG. 14 and operation block 618, the controller 10 can control the outboard motors 1*a*, 1*b* to decrease forward thrust from the then-current thrust generated by the outboard motors 1*a*, 1*b*. Thus, in some circumstances, the outboard motors 1*a*, 1*b* may already be producing a net forward thrust. In such a situation, the controller 10 can control the outboard motors 1*a*, 1*b* to reduce the thrust by one step. For example, when the outboards 1*a*, 1*b* were then producing a super idle thrust, then the controller 10 would reduce the throttle openings of the outboard motors 1*a*, 1*b* to thereby reduce the total output and total thrust generated. When the outboard motors 1*a*, 1*b* were in a state of idle speed operation, then the controller 10 would maintain the outboard motors 1*a*, 1*b* operating in an idle mode and adjust the rudder angles to be partly or more opposed. For example, adjusting the rudder angles either more towards or more away from each other. In some scenarios, the reduction of forward thrust could result in a request for zero thrust, in which the controller 10 would maintain the outboard motors 1*a*, 1*b* in idle speed operation and adjust the rudder angles to be directly opposed to thereby generate zero thrust. Additionally, were the then existing thrust to be a zero thrust mode, the controller 10 would adjust the rudder angles of the outboard motors 1*a*, 1*b* to be partially rearward and partially opposed, thereby generating a net rearward thrust.

When the then-existing thrust generated by the outboard motors 1*a*, 1*b* was a sub idle rearward thrust, the controller 10 can adjust the rudder angles of the outboard motors 1*a*, 1*b* to be more rearward and less opposed, thereby increasing the rearward thrust. When the then existing thrust the outboard motors 1*a*, 1*b* was idle speed operation with the rudder angles being parallel and pointing rearwardly, the controller 10 could increase the throttle opening of the engines 2*a*, 2*b* to thereby increase thrust in the rearward direction.

After the stepwise decrease for forward thrust in the operation block 716, the routine 700 can move to operation block 718. In the operation block 718, the controller 10 can maintain the then current thrust generated by the outboard motors 1*a*, 1*b* despite the joystick 23 having been returned to its default position 23*a*. After the operation block 718, the routine 700 can move to decision block 710 and repeat as described above.

The controller 10 can also be configured to present an optional parameter adjustment interface for a user. For example, the controller can present on a display an interface for allowing a user to adjust parameters such as throttle dead zone, max throttle percent, a max differential angle.

In some embodiments, a thrust of a motor may mean force applied to fluid (e.g., water) by the motor, thrust of a watercraft may mean force that propels the watercraft, speed of the watercraft may mean a speed of the movement of the watercraft and include a velocity, velocity of the watercraft may mean the speed of the watercraft in a particular direction, propulsion of the watercraft may mean a propulsive power of the watercraft and be determined as the product of the thrust of the watercraft and the velocity of the watercraft, and torque of the watercraft may mean rotational force about a center of pressure of the watercraft that can change an orientation of the watercraft.

Unless the context clearly requires otherwise, throughout the description and the claims, the words "comprise," "comprising," "include," "including" and the like are to be construed in an inclusive sense, as opposed to an exclusive or exhaustive sense; that is to say, in the sense of "including, but not limited to." The word "connected" as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or" in reference to a list of two or more items, that word covers all of the following interpretations of the word: any of the items in the list, all of the items in the list, and any combination of the items in the list.

Moreover, conditional language used herein, such as, among others, "can," "could," "might," "may," "e.g.," "for example," "such as" and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

Furthermore, language such as "up to," "at least," "greater than," "less than," "between," and the like includes the number recited. Numbers preceded by a term such as "approximately", "about", and "substantially" as used herein include the recited numbers (e.g., about 10%=10%), and also represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

Clause 1. A system for controlling a watercraft, the system comprising:

a left outboard motor on a port side of the watercraft;

a left steering actuator configured to change a left rudder angle of the left outboard motor;

a left gear shift actuator configured to change a gear position of the left outboard motor between at least a forward gear position and a neutral gear position;

a left motor output control actuator configured to adjust a power output of the left outboard motor between a first idle speed power operational mode and a first elevated speed power operational mode;

a right outboard motor on a starboard side of the watercraft;

a right steering actuator configured to change a right rudder angle of the right outboard motor; and a right gear shift actuator configured to change a gear position of the right outboard motor between at least a forward gear position and a neutral gear position;

a right motor output control actuator configured to adjust a power output of the right outboard motor between a second idle speed power operational mode and a second elevated speed power operational mode;

a propulsion control joystick unit comprising:

a 3-axis joystick mounted so as to be biased to a central default position, the joystick being tiltable in a forward direction in a first forward range, a second forward range, and a third forward position between the first and second forward ranges, the joystick being tiltable in a rearward direction in a first rearward range, and a second rearward range, the joystick being tiltable in a leftward lateral direction and in a rightward lateral direction, the joystick being twistable in a clockwise direction and in a counter-clockwise direction;

a joystick position sensor configured to detect and output position signals indicative of a position of the joystick, the output position signals comprising a default position signal in response to detecting the joystick being in the central default position, a first range of forward signals in response to the joystick being positioned in the first forward range, a second range of forward signals in response to the joystick being positioned in the second forward range, a first range of rearward signals in response to the joystick being positioned in the first rearward range, a second range of rearward signals in response to the joystick being positioned in the second rearward range, a leftward lateral position signal in response to the joystick being tilted in the leftward lateral direction, a rightward lateral position signal in response to the joystick being tilted in the rightward lateral direction, a clockwise position signal in response to the joystick being twisted in the clockwise direction and a counter-clockwise position signal in response to the joystick being twisted in the counter-clockwise direction; and a controller in communication with the propulsion control joystick unit, the right and left outboard motors, the left and right steering actuators, the left and right gear shift actuators, and the left and right motor output control actuators, the controller configured to receive the default position signal, the first range of forward signals, the third forward signal, the second range of forward signals, the first range of rearward signals, the third rearward position signal, the second range of rearward signals, the leftward lateral position signal, the rightward lateral position signal, the clockwise position signal, and the counter-clockwise position signal;

wherein the controller is configured to, in response to receiving the default position signal, control the left and right steering actuators to adjust the left and right rudder angles to be directly opposed to each other, control the left and right shift actuators to maintain the forward gear position, and control the left and right motor output control actuators to maintain the left and right outboard motors in the idle speed power operational mode, thereby substantially cancelling all thrust generated by the left and right outboard motors to generate a substantially zero net thrust and torque on the watercraft;

wherein the controller is configured to, in response to receiving a signal in the first range of forward signals, control the left and right steering actuators to adjust the left and right rudder angles to be non-parallel, directed toward each other and toward a forward direction of the watercraft, control the left and right shift actuators to maintain the forward gear position, and control the left and right motor output control actuators to maintain the left and right outboard motors in the idle speed power operational mode, thereby partly cancelling the thrust generated by the left and right outboard motors and generating a net forward thrust on the watercraft so as to propel the watercraft at a forward speed slower than an idle watercraft speed of the watercraft; and wherein the controller is configured to, in response to receiving a signal in the second range of forward signals, control the left and right steering actuators to adjust the left and right rudder angles to be substantially parallel and toward a forward direction of the watercraft, control the left and right shift actuators to maintain the forward gear position, and control the left and right motor output control actuators to increase the output of the left and right outboard motors to thereby propel the watercraft at a super-idle speed.

Clause 2. The system according to Clause 1, wherein the controller is further configured to, in response to receiving only the clockwise position signal, control the left and right steering actuators to adjust the left and right rudder angles to be directly opposed to each other, control the left and right shift actuators to maintain the forward gear position, to control the left motor output control actuator to maintain the left outboard motor in the idle speed power operational mode, and to control the right motor output control actuator to increase the output of the right outboard motor to a greater than idle speed power operational mode, thereby creating a net leftward thrust and thereby rotating the watercraft in a clockwise direction.

Clause 3. The system according to Clause 1, wherein the controller is further configured to, in response to receiving a combination of any signal in the first range of forward signals and the clockwise position signal, control the left and right steering actuators to adjust the left and right rudder angles to be asymmetric and such that the right rudder angle is directed more laterally and toward the left outboard motor and the left rudder angle is directed more toward the forward direction, thereby creating a net forward thrust and a net clockwise torque thereby propelling the watercraft in a forward direction while simultaneously rotating the watercraft in a clockwise direction.

Clause 4. The system according to Clause 1, wherein the controller is further configured to, in response to receiving a combination of the clockwise position signal and the rightward lateral position signal, control the left and right steering actuators to adjust the left and right rudder angles to be asymmetric and such that the right rudder angle is directed at an angle of less than 150 degrees and directed in the rearward and rightward directions and such that the left rudder angle is directed at an angle of greater than 30 degrees and in the forward and rightward directions, thereby creating a net rightward lateral and counter-clockwise thrust, thereby propelling the watercraft in a rightward lateral direction while simultaneously rotating the watercraft in a counter-clockwise direction.

Clause 5. A system for controlling a watercraft, the system comprising:

a left outboard motor on a port side of the watercraft;

a left steering actuator configured to change a left rudder angle of the left outboard motor;

a left gear shift actuator configured to change a gear position of the left outboard motor between at least a forward gear position and a neutral gear position;

a left motor output control actuator configured to adjust a power output of the left outboard motor between a first idle speed power operational mode and a first elevated speed power operational mode;

a right outboard motor on a starboard side of the watercraft;

a right steering actuator configured to change a right rudder angle of the right outboard motor; and a right gear shift actuator configured to change a gear position of the right outboard motor between at least a forward gear position and a neutral gear position;

a right motor output control actuator configured to adjust a power output of the right outboard motor between a second idle speed power operational mode and a second elevated speed power operational mode; and a controller in communication with the right and left outboard motors, the left and right steering actuators, the left and right gear shift actuators, and the left and right motor output control actuators, the controller configured to receive a zero propulsion signal, and a first range of sub-idle speed forward propulsion signals;

wherein the controller is configured to, in response to receiving the zero propulsion signal, control the left and right steering actuators to adjust the left and right rudder angles to be directly opposed to each other, control the left and right shift actuators to maintain the forward gear position, and control the left and right motor output control actuators to maintain the left and right outboard motors in the idle speed power operational mode, thereby substantially cancelling all thrust generated by the left and right outboard motors;

wherein the controller is configured to, in response to receiving a signal in the first range of forward propulsion signals, control the left and right steering actuators to adjust the left and right rudder angles to be non-parallel, directed partly toward each other and partly toward a forward direction of the watercraft, control the left and right shift actuators to maintain the forward gear position, and control the left and right motor output control actuators to maintain the left and right outboard motors in the idle speed power operational mode, thereby partly cancelling the thrust generated by the left and right outboard motors and generating a net forward thrust on the watercraft.

Clause 6. The system according to Clause 5 wherein the controller is configured to, in response to receiving the forward idle speed propulsion signal, control the left and right steering actuators to adjust the left and right rudder angles to be substantially parallel, and toward a forward direction of the watercraft, control the left and right shift actuators to maintain the forward gear position, and to control the left and right motor output control actuators to maintain the left and right outboard motors in the idle speed power operational mode, thereby generating a net forward thrust on the watercraft so as to propel the watercraft at an idle speed.

Clause 7. The system according to Clause 5 wherein the controller is configured to, in response to receiving any signal in a second range of super-idle speed forward propulsion signals, control the left and right steering actuators to adjust the left and right rudder angles to be substantially parallel and toward a forward direction of the watercraft, control the left and right shift actuators to maintain the forward gear position, and to control the left and right motor output control actuators to increase the output of the left and right outboard motors to thereby propel the watercraft at a super-idle speed.

Clause 8. The system according to Clause 5, wherein the controller is further configured to, in response to receiving a clockwise position signal, control the left and right steering actuators to adjust the left and right rudder angles to be directly opposed to each other, control the left and right shift actuators to maintain the forward gear position, to control the left motor output control actuator to maintain the left outboard motor in the idle speed power operational mode, and to control the right motor output control actuator to increase the output of the right outboard motor to a greater than idle speed power operational mode, thereby creating a net leftward thrust and thereby rotating the watercraft in a clockwise direction.

Clause 9. The system according to Clause 5, wherein the controller is further configured to, in response to receiving a combination of any signal in the first range of forward signals and a clockwise position signal, control the left and right steering actuators to adjust the left and right rudder angles to be asymmetric and such that the right rudder angle is directed more laterally and toward the left outboard motor and the left rudder angle is directed more toward the forward direction, thereby creating a net forward and leftward thrust and thereby propelling the watercraft in a forward direction while simultaneously rotating the watercraft in a clockwise direction.

Clause 10. The system according to Clause 5, wherein the controller is further configured to, in response to receiving a combination of a clockwise position signal and the rightward lateral position signal, control the left and right steering actuators to adjust the left and right rudder angles to be asymmetric and such that the right rudder angle is directed at an angle of less than 150 degrees and directed in the rearward and rightward directions and such that the left rudder angle is directed at an angle of greater than 30 degrees and in the forward and rightward directions, thereby creating a net rightward lateral and counter-clockwise thrust, thereby propelling the watercraft in a rightward lateral direction while simultaneously rotating the watercraft in a counter-clockwise direction.

Clause 11. The system according to Clause 5 additionally comprising a propulsion control joystick unit comprising:

a joystick mounted so as to be biased to a central default position, tiltable in a forward direction in a first forward range, a second forward range, and a third forward position between the first and second forward ranges, the joystick also being tiltable in a rearward direction in a first rearward range, a second rearward range, and a third rearward position between the first and second rearward ranges, the joystick also tiltable in a leftward lateral direction and in a rightward lateral direction, the joystick also mounted for twisting in a clockwise direction and in a counter-clockwise direction; and a joystick position sensor configured to detect and output position signals indicative of a position of the joystick, the output position signals comprising a default position signal in response to detecting the joystick being in the central default position, a first range of forward signals in response to the joystick being positioned in the first forward, a second range of forward signals in response to the joystick being positioned in the second forward range, a third forward position signal in response to the joystick being position in the third forward position, a first range of rearward signals in response to the joystick being positioned in the first rearward range, a second range of rearward signals in response to the joystick being positioned in the second rearward range, a third rearward position signal in response to the joystick being position in the third rearward position, a leftward lateral position signal in response to the joystick being tilted in the leftward lateral direction, a rightward lateral position signal in response to the joystick being tilted in the rightward lateral direction, a clockwise position signal in response to the joystick being twisted in the clockwise direction and a counter-clockwise position signal in response to the joystick being twisted in the counter-clockwise direction;

Clause 12. A system for controlling a watercraft, the system comprising:

a left outboard motor on a port side of the watercraft;

a right outboard motor on a starboard side of the watercraft; and a controller communicating with the right and left outboard motors, the controller configured to receive a zero propulsion signal and at least a first forward propulsion signal;

wherein the controller is configured to, in response to receiving the zero propulsion signal, control left and right rudder angles of the left and right outboard motors, respectively, to adjust the left and right rudder angles to be directly opposed to each other.

Clause 13. The system according to Clause 12, wherein the controller, in response to receiving the zero propulsion signal, controls a gear position of the left and right outboard motors to maintain a forward gear position, and to control power output of both the left and right outboard motors to maintain an idle speed power operational mode, thereby substantially cancelling all thrust generated by the left and right outboard motors.

Clause 14. The system according to Clause 12, wherein the controller is configured to, in response to receiving the first forward propulsion signal, control the left and right outboard motors to adjust left and right rudder angles of the left and right outboard motors to be non-parallel, directed partly opposed and partly toward a forward direction of the watercraft, thereby partly cancelling the thrust generated by the left and right outboard motors and generating a net forward thrust on the watercraft.

Clause 15. The system according to Clause 12, wherein the controller is configured to, in response to receiving the first forward propulsion signal, control gear positions of the left and right outboard motors to maintain a forward gear position, and to control the power output of both the left and right outboard motors to maintain an idle speed power operational mode.

Clause 16. The system according to Clause 12, wherein the controller is further configured to receive a first range of sub-idle speed forward propulsion signals, a forward idle speed propulsion signal, a second range of super-idle speed forward propulsion signals, a clockwise rotation signal, and a counter-clockwise rotation signal.

Clause 17. The system according to Clause 12 additionally comprising a left steering actuator configured to change a left rudder angle of the left outboard motor, a left gear shift actuator configured to change a gear position of the left outboard motor between at least a forward gear position and a neutral gear position, a left motor output control actuator configured to adjust a power output of the left outboard motor between first idle speed power operational mode and a first elevated speed power operational mode, a right steering actuator configured to change a right rudder angle of the right outboard motor, a right gear shift actuator configured to change a gear position of the right outboard motor between at least a forward gear position and a neutral gear position, and a right motor output control actuator configured to adjust a power output of the right outboard motor between second idle speed power operational mode and a second elevated speed power operational mode.

Clause 18. The system according to Clause 17, wherein the controller communicates with the left and right steering actuators, the left and right gear shift actuators, and the left and right motor output control actuators.

Clause 19. The system according to Clause 12 wherein the controller is configured to, in response to receiving a forward idle speed propulsion signal, control the left and right outboard motors to adjust left and right rudder angles of the left and right outboard motors to be substantially parallel, and toward a forward direction of the watercraft, thereby generating a net forward thrust on the watercraft so as to propel the watercraft at an idle speed.

Clause 20. The system according to Clause 12 wherein the controller is configured to, in response to receiving a super-idle speed forward propulsion signal, control the left and right outboard motors to adjust left and right rudder angles of the left and right outboard motors to be substantially parallel and toward a forward direction of the watercraft, and to increase power output of the left and right outboard motors to thereby propel the watercraft at a super-idle speed.

Clause 21. The system according to Clause 12, wherein the controller is further configured to, in response to receiving the clockwise position signal, control the left and right outboard motors to adjust left and right rudder angles of the left and right outboard motors to be directly opposed to each other, to control a power output of the right outboard motor to a greater output than a power output of the left outboard motor, thereby creating a net leftward thrust and thereby rotating the watercraft in a clockwise direction.

Clause 22. The system according to Clause 12, wherein the controller is further configured to, in response to receiving a combination of the first forward signal and a counter clockwise rotation signal, control left and right rudder angles of the left and right outboard motors, respectively, to be asymmetric and such that the left rudder angle is directed more laterally and toward the right outboard motor and the right rudder angle is directed more toward the forward direction, thereby creating a net forward and counter clockwise torque and thereby propelling the watercraft in a forward direction while simultaneously rotating the watercraft in a counter clockwise direction.

Clause 23. The system according to Clause 12, wherein the controller is further configured to, in response to receiving a combination of a counter-clockwise rotation signal and a rightward lateral position signal, control the left and right outboard motors to be in forward gear and to adjust left and right rudder angles of the left and right outboard motors, respectively, such that the right rudder angle is directed in the rearward and rightward directions and that the left rudder angle is directed in the forward and rightward directions, wherein both rudder angles cross the longitudinal axis of the watercraft rearward of the center of pressure, thereby creating a net rightward lateral and counter-clockwise thrust, thereby propelling the watercraft in a rightward lateral direction while simultaneously rotating the watercraft in a counter-clockwise direction.

Clause 24. The system according to Clause 12 additionally comprising a propulsion control joystick unit comprising:

a joystick mounted so as to be biased to a central default position, tiltable in a forward direction in a first forward range, a second forward range, and a third forward position between the first and second forward ranges, the joystick also being tiltable in a rearward direction in a first rearward range, a second rearward range, and a third rearward position between the first and second rearward ranges, the joystick also tiltable in a leftward lateral direction and in a rightward lateral direction, the joystick also mounted for twisting in a clockwise direction and in a counter-clockwise direction; and a joystick position sensor configured to detect and output position signals indicative of a position of the joystick, the output position signals comprising a default position signal in response to detecting the joystick being in the central default position, a first range of forward signals in response to the joystick being positioned in the first forward, a second range of forward signals in response to the joystick being positioned in the second forward range, a third forward position signal in response to the joystick being position in the third forward position, a first range of rearward signals in response to the joystick being positioned in the first rearward range, a second range of rearward signals in response to the joystick being positioned in the second rearward range, a third rearward position signal in response to the joystick being position in the third rearward position, a leftward lateral position signal in response to the joystick being tilted in the leftward lateral direction, a rightward lateral position signal in response to the joystick being tilted in the rightward lateral direction, a clockwise position signal in response to the joystick being twisted in the clockwise direction and a counter-clockwise position signal in response to the joystick being twisted in the counter-clockwise direction.

Clause 25. The system according to Clause 24, wherein the controller is configured to, in response to receiving a reverse sub idle watercraft propulsion signal, adjust left and right rudder angles of the left and right outboard motors to be non-parallel and directed partly opposed and partly toward a rearward direction of the watercraft, thereby partly cancelling the thrust generated by the left and right outboard motors and generating a net rearward thrust on the watercraft.

Clause 26. The system according to Clause 24, wherein the controller is configured to, in response to receiving a reverse idle watercraft propulsion signal, adjust left and right rudder angles of the left and right outboard motors to be substantially parallel and directed toward a rearward direction of the watercraft, thereby generating a rearward thrust on the watercraft.

Clause 27. The system according to Clause 24, wherein the controller is configured to, in response to receiving a reverse super idle watercraft propulsion signal, adjust left and right rudder angles of the left and right outboard motors to be to be substantially parallel and directed toward a rearward direction of the watercraft, and to increase an output of the outboard motors to an output greater than idle operation.

Clause 28. The system according to Clause 24, wherein the controller is configured to, in response to receiving a reverse watercraft propulsion signal, adjust left and right rudder angles of the left and right outboard motors to be directed at least partly toward a rearward direction of the watercraft, and to control the gear position of the left and right outboard motors to a forward gear position.

Clause 29. The system according to Clause 24, wherein the controller is configured to, in response to receiving a rightward lateral watercraft propulsion signal, adjust a rudder angle of the left outboard motor to be directed at a center of pressure of the watercraft and adjust a rudder angle of the right outboard motor to be directed aligned with and away from the center of pressure of the watercraft, with the left and right outboard motors in forward gear, to thereby generate a net rightward lateral thrust on the watercraft.

Clause 30. The system according to Clause 24, wherein the controller is configured to, in response to receiving a leftward lateral watercraft propulsion signal, adjust a rudder angle of the left outboard motor to be aligned with and directed away from a center of pressure of the watercraft and adjust a rudder angle of the right outboard motor to be directed at the center of pressure of the watercraft, with the left and right outboard motors in forward gear, to thereby generate a net leftward lateral thrust on the watercraft.

Clause 31. The system according to Clause 24, wherein the controller is configured to, in response to receiving a combination of a lateral watercraft propulsion signal and a forward watercraft propulsion signal, adjust a rudder angle of one of the left and right outboard motors to be aligned with and directed away from a center of pressure of the watercraft and adjust a rudder angle of the other of the left and right outboard motors to be directed at the center of pressure of the watercraft, and increase an output of the outboard motor that is directed at the center of pressure to be higher than an output of the other outboard motor, with the left and right outboard motors in forward gear, to thereby generate a net lateral and forward thrust on the watercraft.

Clause 32. A method for controlling a watercraft, the watercraft including a left outboard motor and a right outboard motor, the method comprising:

receiving a zero propulsion signal; and adjusting a left rudder angle of the left outboard motor and a right rudder angle of the right outboard motor, in response to receiving the zero propulsion signal, such that the left and right rudder angles are directly opposed to each other.

Clause 33. The method according to Clause 32 additionally comprising maintaining a gear position of the left and right outboard motors, in response to receiving the zero propulsion signal, in a forward gear position.

Clause 34. The method according to Clause 33 additionally comprising maintaining a power output of both the left and right outboard motors, in response to receiving the zero propulsion signal, in an idle speed power operational mode, thereby substantially cancelling all thrust generated by the left and right outboard motors.

Clause 35. The method according to Clause 32 additionally comprising:

receiving a first forward propulsion signal; and adjusting left and right rudder angles of the left and right outboard motors, in response to receiving the first forward propulsion signal, to be non-parallel, directed partly opposed and partly toward a forward direction of the watercraft, thereby partly cancelling thrust generated by the left and right outboard motors and generating a net forward thrust on the watercraft.

Clause 36. The method according to Clause 35 additionally comprising maintaining gear positions of the left and right outboard motors in a forward gear position, and maintaining power output of both the left and right outboard motors at an idle speed power operational mode.

Clause 37. The method according to Clause 32 additionally comprising:

receiving a forward idle speed propulsion signal; and adjusting left and right rudder angles of the left and right outboard motors, in response to receiving the forward idle speed propulsion signal, to be substantially parallel, and toward a forward direction of the watercraft, thereby generating a net forward thrust on the watercraft so as to propel the watercraft at an idle speed.

Clause 38. The method according to Clause 32 additionally comprising:

receiving a super-idle speed forward propulsion signal; and adjusting left and right rudder angles of the left and right outboard motors, in response to receiving the super-idle speed forward propulsion signal, increasing power output of the left and right outboard motors to thereby propel the watercraft at a super-idle speed.

Clause 39. The method according to Clause 32 additionally comprising:

receiving a clockwise rotation signal;

adjusting left and right rudder angles of the left and right outboard motors, in response to receiving the clockwise rotation signal, to be directly opposed to each other;

maintaining a power output of the left outboard motor at an idle speed power operational mode; and increasing a power output of the right outboard motor to a greater than idle speed power operational mode, thereby creating a net leftward thrust and thereby rotating the watercraft in a clockwise direction.

Clause 40. The method according to Clause 32, additionally comprising:

receiving a combination of a forward signal and a clockwise rotation signal; and adjusting left and right rudder angles of the left and right outboard motors, in response to receiving the clockwise rotation signal, to be asymmetric and such that the right rudder angle is directed more laterally and toward the left outboard motor and the left rudder angle is directed more toward the forward direction, thereby creating a net forward and leftward thrust and thereby propelling the watercraft in a forward direction while simultaneously rotating the watercraft in a clockwise direction.

Clause 41. The method according to Clause 32 additionally comprising:

receiving a combination of a clockwise rotation signal and a rightward lateral position signal; and adjusting left and right rudder angles of the left and right outboard motors, in response to receiving a combination of a clockwise rotation signal and a rightward lateral position signal, to be asymmetric and such that the right rudder angle is directed at an angle of less than 150 degrees and directed in the rearward and rightward directions and such that the left rudder angle is directed at an angle of greater than 30 degrees and in the forward and rightward directions, thereby creating a net rightward lateral and counter-clockwise thrust, thereby propelling the watercraft in a rightward lateral direction while simultaneously rotating the watercraft in a counter-clockwise direction.

Clause 42. The method according to Clause 32 additionally comprising receiving a series of pulsed forward propulsion signals; and adjusting left and right rudder angles of the left and right outboard motors, in response to receiving the a series of pulsed forward propulsion signals in a series of different predetermined positions in which the left and right rudder angles are directed partially opposed and partially toward a forward direction of the watercraft, thereby generating a corresponding plurality of different magnitudes of net forward thrust to propel the watercraft at a corresponding plurality of different watercraft speeds.

Clause 43. A system for controlling a watercraft, the system comprising:

a left outboard motor on a port side of the watercraft comprising a left side steering actuator configured to adjust a rudder angle of the left outboard motor;

a right outboard motor on a starboard side of the watercraft comprising a right side steering actuator configured to adjust a rudder angle of the right outboard motor;

a joystick unit comprising a joystick mounted so as to be tiltable in a plurality of directions, the joystick unit configured to output joystick position signals corresponding to tilting of the joystick in the plurality of directions;

a steering wheel unit comprising a steering wheel mounted to be rotatable, the steering wheel unit being configured to output steering wheel position signals corresponding to an angular position of the steering wheel; and a controller communicating with the joystick unit, the left and right side steering actuators, and the steering wheel unit;

wherein the controller is configured to control the left and right side steering actuators in a joystick mode, so as to change the rudder angles of the left and right outboard motors in a first range of rudder angles based at least in part on the joystick position signals; and wherein the controller is configured to control the left and right side steering actuators in a steering wheel mode, so as to change the rudder angles of the left and right outboard motors in a second range of rudder angles that is limited to a narrower range of angles than the first range of rudder angles, based at least in part on the steering wheel position signals.

Clause 44. The system according to Clause 43, wherein the controller is configured to, in response to receiving a joystick position signal corresponding to a zero propulsion request, adjusts the left and right rudder angles to angles that are outside of the second range.

Clause 45. The system according to Clause 44, wherein the controller is configured to, in response to receiving a joystick position signal corresponding to a zero propulsion request, adjusts the left and right rudder angles to be directly opposed to each other.

Clause 46. The system according to Clause 45, wherein the controller is configured to, in response to receiving the zero propulsion signal, control a gear position of the left and right outboard motors to maintain a forward gear position, and to control power output of both the left and right outboard motors to maintain an idle speed power operational mode, thereby substantially cancelling all thrust generated by the left and right outboard motors.

Clause 47. The system according to Clause 43, wherein the controller is configured to, in response to receiving a joystick position signal corresponding to a forward sub idle watercraft speed, adjust left and right rudder angles of the left and right outboard motors to be non-parallel and at angles that are outside of the second range.

Clause 48. The system according to Clause 43, wherein the controller is configured to, in response to receiving a joystick position signal corresponding to a sub idle watercraft speed, adjust left and right rudder angles of the left and right outboard motors to be directed partly opposed and partly toward a forward direction of the watercraft, thereby partly cancelling the thrust generated by the left and right outboard motors and generating a net forward thrust on the watercraft.

Clause 49. The system according to Clause 43, wherein the controller is configured to, in response to receiving a joystick position signal corresponding to a reverse sub idle watercraft speed, adjust left and right rudder angles of the left and right outboard motors to be non-parallel and at angles that are outside of the second range.

Clause 50. The system according to Clause 43, wherein the controller is configured to, in response to receiving a joystick position signal corresponding to a reverse sub idle watercraft speed, adjust left and right rudder angles of the left and right outboard motors to be directed partly opposed and partly toward a rearward direction of the watercraft, thereby partly cancelling the thrust generated by the left and right outboard motors and generating a net rearward thrust on the watercraft.

Clause 51. The system according to Clause 43, wherein the controller is configured to, in response to receiving a joystick position signal corresponding to a rotation only watercraft propulsion operation, adjust left and right rudder angles of the left and right outboard motors to be at angles that are outside of the second range.

Clause 52. The system according to Clause 43, wherein the controller is configured to, in response to receiving a joystick position signal corresponding to a reverse sub idle watercraft speed, adjust left and right rudder angles of the left and right outboard motors to be substantially directly opposed and to set an output of one of the left and right outboard motors to be greater than an output of the other of the left and right outboard motors, to thereby create a net torque on the watercraft.

Clause 53. A system for controlling a watercraft, the system comprising:

a left outboard motor on a port side of the watercraft;

a right outboard motor on a starboard side of the watercraft; and a controller communicating with the right and left outboard motors, the controller configured to receive a first forward propulsion signal;

wherein the controller is configured to, in response to receiving a first forward propulsion signal, control the left and right outboard motors to adjust left and right rudder angles of the left and right outboard motors to be non-parallel, directed partly opposed and partly toward a forward direction of the watercraft, thereby partly cancelling the thrust generated by the left and right outboard motors and generating a net forward thrust on the watercraft.

Clause 54. The system according to Clause 53, wherein the controller is configured to, in response to receiving a plurality of propulsion signals corresponding to a plurality of sub idle watercraft speeds, control the left and right outboard motors to adjust left and right rudder angles to a range of angles in which the rudder angle of the left and right outboard motors are non-parallel, directed partly opposed and partly toward a forward direction of the watercraft, thereby partly cancelling the thrust generated by the left and right outboard motors and generating a net forward thrust in each of the plurality of sub idle watercraft speeds.

Clause 55. The system according to Clause 53, wherein the controller is configured to, in response to receiving a zero propulsion signal, control left and right rudder angles of the left and right outboard motors, respectively, to adjust the left and right rudder angles to be directly opposed to each other.

Clause 56. The system according to Clause 55, wherein the controller, in response to receiving the zero propulsion signal, controls a gear position of the left and right outboard motors to maintain a forward gear position, and to control power output of both the left and right outboard motors to maintain an idle speed power operational mode, thereby substantially cancelling all thrust generated by the left and right outboard motors.

Clause 57. The system according to Clause 53, wherein the controller is configured to, in response to receiving the first forward propulsion signal, control the left and right outboard motors to adjust left and right rudder angles of the left and right outboard motors to be non-parallel, directed partly opposed and partly toward a forward direction of the watercraft, thereby partly cancelling the thrust generated by the left and right outboard motors and generating a net forward thrust on the watercraft.

Clause 58. The system according to Clause 53, wherein the controller is configured to, in response to receiving the first forward propulsion signal, control gear positions of the left and right outboard motors to maintain a forward gear position, and to control the power output of both the left and right outboard motors to maintain an idle speed power operational mode.

Clause 59. The system according to Clause 53, wherein the controller is further configured to receive a first range of sub-idle speed forward propulsion signals, a forward idle speed propulsion signal, a second range of super-idle speed forward propulsion signals, a clockwise rotation signal, and a counter-clockwise rotation signal.

Clause 60. The system according to Clause 53 additionally comprising a left steering actuator configured to change a left rudder angle of the left outboard motor, a left gear shift actuator configured to change a gear position of the left outboard motor between at least a forward gear position and a neutral gear position, a left motor output control actuator configured to adjust a power output of the left outboard motor between first idle speed power operational mode and a first elevated speed power operational mode, a right steering actuator configured to change a right rudder angle of the right outboard motor, a right gear shift actuator configured to change a gear position of the right outboard motor between at least a forward gear position and a neutral gear position, and a right motor output control actuator configured to adjust a power output of the right outboard motor between second idle speed power operational mode and a second elevated speed power operational mode.

Clause 61. The system according to Clause 60, wherein the controller communicates with the left and right steering actuators, the left and right gear shift actuators, and the left and right motor output control actuators.

Clause 62. The system according to Clause 53 wherein the controller is configured to, in response to receiving a forward idle speed propulsion signal, control the left and right outboard motors to adjust left and right rudder angles of the left and right outboard motors to be substantially parallel, and toward a forward direction of the watercraft, thereby generating a net forward thrust on the watercraft so as to propel the watercraft at an idle speed.

Clause 63. The system according to Clause 53 wherein the controller is configured to, in response to receiving a super-idle speed forward propulsion signal, control the left and right outboard motors to adjust left and right rudder angles of the left and right outboard motors to be substantially parallel and toward a forward direction of the watercraft, and to increase power output of the left and right outboard motors to thereby propel the watercraft at a super-idle speed.

Clause 64. The system according to Clause 53, wherein the controller is further configured to, in response to receiving the clockwise position signal, control the left and right outboard motors to adjust left and right rudder angles of the left and right outboard motors to be directly opposed to each other, to control a power output of the left outboard motor to maintain an idle speed power operational mode, and to control a power output of the right outboard motor to a greater than idle speed power operational mode, thereby creating a net leftward thrust and thereby rotating the watercraft in a clockwise direction.

Clause 65. The system according to Clause 53, wherein the controller is further configured to, in response to receiving a combination of the first forward signal and a clockwise rotation signal, control left and right rudder angles of the left and right outboard motors, respectively, to be asymmetric and such that the right rudder angle is directed more laterally and toward the left outboard motor and the left rudder angle is directed more toward the forward direction, thereby creating a net forward and leftward thrust and thereby propelling the watercraft in a forward direction while simultaneously rotating the watercraft in a clockwise direction.

Clause 66. The system according to Clause 53, wherein the controller is further configured to, in response to receiving a combination of a clockwise rotation signal and a rightward lateral position signal, control the left and right outboard motors to adjust left and right rudder angles of the left and right outboard motors, respectively, to be asymmetric and such that the right rudder angle is directed at an angle of less than 150 degrees and directed in the rearward and rightward directions and such that the left rudder angle is directed at an angle of greater than 30 degrees and in the forward and rightward directions, thereby creating a net rightward lateral and counter-clockwise thrust, thereby propelling the watercraft in a rightward lateral direction while simultaneously rotating the watercraft in a counter-clockwise direction.

Clause 67. The system according to Clause 53 additionally comprising a propulsion control joystick unit comprising:

a joystick mounted so as to be biased to a central default position, tiltable in a forward direction in a first forward range, a second forward range, and a third forward position between the first and second forward ranges, the joystick also being tiltable in a rearward direction in a first rearward range, a second rearward range, and a third rearward position between the first and second rearward ranges, the joystick also tiltable in a leftward lateral direction and in a rightward lateral direction, the joystick also mounted for twisting in a clockwise direction and in a counter-clockwise direction; and a joystick position sensor configured to detect and output position signals indicative of a position of the joystick, the output position signals comprising a default position signal in response to detecting the joystick being in the central default position, a first range of forward signals in response to the joystick being positioned in the first forward, a second range of forward signals in response to the joystick being positioned in the second forward range, a third forward position signal in response to the joystick being position in the third forward position, a first range of rearward signals in response to the joystick being positioned in the first rearward range, a second range of rearward signals in response to the joystick being positioned in the second rearward range, a third rearward position signal in response to the joystick being position in the third rearward position, a leftward lateral position signal in response to the joystick being tilted in the leftward lateral direction, a rightward lateral position signal in response to the joystick being tilted in the rightward lateral direction, a clockwise position signal in response to the joystick being twisted in the clockwise direction and a counter-clockwise position signal in response to the joystick being twisted in the counter-clockwise direction.

Clause 68. The system according to Clause 67, wherein the controller is further configured to detect tap inputs into the joystick, and in response to detecting a series of tap inputs to the joystick in the forward direction, to control the control the left and right steering actuators to adjust the left and right rudder angles in a range of different predetermined positions in which the left and right rudder angles are directed partially toward each other and partially toward a forward direction of the watercraft, thereby generating a corresponding plurality of different magnitudes of net forward thrust to propel the watercraft at a corresponding plurality of different watercraft speeds.

Clause 69. The system according to Clause 53 additionally comprising a joystick mounted to be moveable in at least forward and rearward directions and connected to the controller, wherein the controller is further configured to detect tap inputs into the joystick, and in response to detecting a series of tap inputs to the joystick in the forward direction, to control the control the left and right steering actuators to adjust the left and right rudder angles in a range of different predetermined positions in which the left and right rudder angles are directed partially toward each other and partially toward a forward direction of the watercraft, thereby generating a corresponding plurality of different magnitudes of net forward thrust to propel the watercraft at a corresponding plurality of different watercraft speeds.

Clause 70. A system for controlling a watercraft having a cruise control mode, the system comprising:

first and second outboard motors mounted to the watercraft;

a joystick unit comprising a joystick mounted for displacement about multiple axes, the joystick unit being configured to output joystick signals indicative of a position of the joystick including at least a forward signal, a rearward signal, and a neutral signal;

a throttle lever unit including at least a first throttle lever mounted to be displaceable by a user, the throttle lever unit configured to output throttle lever signals indicative of a position of the first throttle lever;

a steering wheel unit comprising a steering wheel mounted for rotatable movement, the steering wheel unit configured to output steering wheel signals indicative of a rotational position of the steering wheel; and a controller communicating with the first and second outboard motors, the joystick unit, the steering wheel unit, and the throttle lever unit;

wherein the controller is configured to control the first and second outboard motors in a first mode, based at least in part on the throttle lever signals and steering wheel signals, and in a second mode based at least in part on the joystick signals;

wherein when the controller is configured such that when the controller is switched from the first mode to the second mode, the controller controls the first and second outboard motors to generate substantially the same net thrust on the watercraft as that being generated prior to switching from the first mode; and wherein when the controller is configured to operate in a cruise control mode in which the controller:

in response to receiving the forward signal followed by the neutral signal, controls the outboard motors to increase forward thrust on the watercraft and to maintain a resulting increased forward thrust after receiving the neutral signal; and in response to receiving the reverse signal followed by the neutral signal, controls the first and second outboard motors to decreased forward thrust, and to maintain a resulting decreased forward thrust after receiving the neutral signal.

Clause 71. The system according to Clause 70, wherein the controller is configured to, when in a state of producing rearward thrust, control the first and second outboard motors to decrease forward thrust by increasing rearward thrust.

Clause 72. The system according to Clause 70, wherein the controller is configured to, when in a state of producing rearward thrust, control the first and second outboard motors to increase forward thrust by decreasing rearward thrust.

Clause 73. The system according to Clause 70, wherein the controller is further configured to, when operating the first and second outboard motors to produce net thrust in a first direction, which is either forward or rearward, and the controller receives a joystick signal corresponding to a direction opposite to the first direction, the controller reduces the thrust in the first direction.

Clause 74. The system according to Clause 70, wherein the controller is further configured to, in response to receiving the forward signal followed by the neutral signal, control the first and second outboard motors to increase forward thrust by a predetermined amount.

Clause 75. The system according to Clause 70, wherein the controller is further configured to, in response to receiving the reverse signal followed by the neutral signal, control the first and second outboard motors to decrease forward thrust by a predetermined amount.

Clause 76. The system according to Clause 70, wherein the controller is configured to, when in a state of producing forward thrust, in response to receiving the reverse signal followed by the neutral signal, control the first and second outboard motors to decrease forward thrust by a predetermined amount.

Clause 77. The system according to Clause 70, wherein the controller is configured to, when in a state of producing forward thrust, in response to receiving the forward signal followed by the neutral signal, control the first and second outboard motors to increase forward thrust by a predetermined amount.

Clause 78. The system according to Clause 70, wherein the controller is configured to, when in a state of producing rearward thrust, in response to receiving the forward signal followed by the neutral signal, control the first and second outboard motors to decrease rearward thrust by a predetermined amount.

Clause 79. The system according to Clause 70, wherein the controller is configured to, when in a state of producing rearward thrust, in response to receiving the rearward signal followed by the neutral signal, control the first and second outboard motors to increase rearward thrust by a predetermined amount.

Clause 80. A cruise control method for a watercraft having at least first and second outboard motors, throttle levers, a steering wheel, and a joystick, the method comprising:

adjusting rudder angles of the first and second outboard motors based at least in part on signals from the steering wheel, in a first mode of operation;

adjusting gear position and power output of the first and second outboard motors based at least in part on signals from the throttle levers, in the first mode of operation;

adjusting at least one of rudder angles, gear position and power output of the first and second outboard motors based at least in part on signals from the joystick, in a second mode of operation;

switching from the first mode of operation to the second mode of operation;

in response to switching from the first mode to the second mode, controlling the first and second outboard motors generate substantially the same net thrust on the watercraft as that being generated prior to switching from the first mode;

increasing forward thrust, in response to receiving a forward signal from the joystick followed by a neutral signal from the joystick, comprising adjusting at least one of the rudder angles, gear position and power output of the first and second outboard motors to increase forward thrust on the watercraft and maintaining a resulting increased forward thrust after receiving the neutral signal; and decreasing forward thrust, in response to receiving a reverse signal from the joystick followed by the neutral signal, comprising adjusting at least one of the rudder angles, gear position and power output of the first and second outboard motors to decrease forward thrust on the watercraft and maintaining a resulting decreased forward thrust after receiving the neutral signal.

Clause 81. The method according to Clause 80, wherein the step of increasing forward thrust comprises, when the first and second outboard motors are initially in a state of producing rearward thrust, adjusting at least one of the rudder angles, gear position and power output of the first and second outboard motors to decrease rearward thrust.

Clause 82. The method according to Clause 80, wherein the step of decreasing forward thrust comprises, when the first and second outboard motors are initially in a state of producing rearward thrust, adjusting at least one of the rudder angles, gear position and power output of the first and second outboard motors to increase rearward thrust.

Clause 83. The method according to Clause 80, additionally comprising adjusting at least one of the rudder angles, gear position and power output of the first and second outboard motors to generate a net thrust in a first direction, receiving an opposite direction signal the from the joystick in a second direction opposite from the first direction, and in response to receiving the opposite direction signal, adjusting at least one of the rudder angles, gear position and power output of the first and second outboard motors to reduce the thrust in the first direction.

Clause 84. The method according to Clause 80, wherein the step of increasing forward thrust, comprises adjusting at least one of the rudder angles, gear position and power output of the first and second outboard motors to increase forward thrust on the watercraft by a predetermined amount.

Clause 85. The method according to Clause 80, wherein the step of decreasing forward thrust, comprises adjusting at least one of the rudder angles, gear position and power output of the first and second outboard motors to decrease forward thrust on the watercraft by a predetermined amount.

Clause 86. The method according to Clause 80, wherein the step of decreasing forward thrust, when in a state of producing forward thrust, comprises adjusting at least one of the rudder angles, gear position and power output of the first and second outboard motors to decrease forward thrust on the watercraft by a predetermined amount.

Clause 87. The method according to Clause 80, wherein the step of decreasing forward thrust, when in a state of producing forward thrust, comprises adjusting at least one of the rudder angles, gear position and power output of the first and second outboard motors to increase forward thrust on the watercraft by a predetermined amount.

Clause 88. The method according to Clause 80, wherein the step of increasing forward thrust, when in a state of producing rearward thrust, comprises adjusting at least one of the rudder angles, gear position and power output of the first and second outboard motors to decrease rearward thrust on the watercraft by a predetermined amount.

Clause 89. The method according to Clause 80, wherein the step of decreasing forward thrust, when in a state of producing rearward thrust, comprises adjusting at least one of the rudder angles, gear position and power output of the first and second outboard motors to increase rearward thrust on the watercraft by a predetermined amount.

Clause 90. A system for controlling a watercraft having a cruise control mode, the system comprising:

at least a first outboard motor mounted to the watercraft;

a joystick unit comprising a joystick mounted for displacement about multiple axes, the joystick unit being configured to output joystick signals indicative of a position of the joystick including at least a forward signal, a rearward signal, a neutral signal, a rightward signal, and a leftward signal;

a throttle lever unit including at least a first throttle lever mounted to be displaceable by a user, the throttle lever unit configured to output throttle lever signals indicative of a position of the first throttle lever;

a steering wheel unit comprising a steering wheel mounted for rotatable movement, the steering wheel unit configured to output steering wheel signals indicative of a rotational position of the steering wheel; and a controller communicating with the first outboard motor, the joystick unit, the steering wheel unit, and the throttle lever unit;

wherein the controller is configured to control the first outboard motor in a first mode, based at least in part on the throttle lever signals and steering wheel signals, and in a second mode based at least in part on the joystick signals;

wherein when the controller is configured such that when the controller is switched from the first mode to the second mode, the controller controls the first outboard motor to generate substantially the same net thrust on the watercraft as that being generated prior to switching from the first mode; and wherein when the controller is configured to operate in a cruise control mode in which the controller:

in response to receiving the forward signal followed by the neutral signal, the controller controls the first outboard motor to increase forward thrust on the watercraft and to maintain a resulting increased forward thrust after receiving the neutral signal;

in response to receiving the reverse signal followed by the neutral signal, the controller controls the first outboard motor to decreased forward thrust, and to maintain a resulting decreased forward thrust after receiving the neutral signal;

in response to receiving the rightward signal, the controller controls a rudder angle of the first outboard motor to generate a rightward thrust on the watercraft; and in response to receiving the leftward signal, the controller controls the rudder angle of the first outboard motor generate a leftward thrust on the watercraft.

Clause 91. The system according to Clause 90, wherein the controller is configured to limit the maximum rudder angle based on a power output of the first outboard motor.

Clause 92. The system according to Clause 90, wherein the controller is configured to limit the maximum rudder angle based on a proportional relationship with a power output of the first outboard motor.

Clause 93. The system according to Clause 90, wherein the controller is configured to limit the maximum rudder angle based on a non-linear, proportional relationship with a power output of the first outboard motor.

Clause 94. The system according to Clause 90, wherein the controller is configured to limit the maximum rudder angle based on a throttle valve position of the first outboard motor.

Clause 95. The system according to Clause 90, wherein the controller is configured switch to the first mode in response to receiving at least one of the throttle lever signals.

Clause 96. A cruise control method for a watercraft having at least first and second outboard motors, throttle levers, a steering wheel, and a joystick, the method comprising:

adjusting rudder angles, gear position and power output of the first and second outboard motors based at least in part on signals from the joystick;

increasing forward thrust, in response to receiving a forward signal from the joystick followed by a neutral signal from the joystick, comprising adjusting at least one of the rudder angles, gear position and power output of the first and second outboard motors to increase forward thrust on the watercraft and maintaining a resulting increased forward thrust after receiving the neutral signal;

decreasing forward thrust, in response to receiving a reverse signal from the joystick followed by the neutral signal, comprising adjusting at least one of the rudder angles, gear position and power output of the first and second outboard motors to decrease forward thrust on the watercraft and maintaining a resulting decreased forward thrust after receiving the neutral signal;

adjusting a rudder angle of the first and second outboard motors in response to receiving the rightward signal to generate a rightward thrust on the watercraft; and adjusting the rudder angle of the first and second outboard motors in response to receiving the leftward signal to generate a leftward thrust on the watercraft.

Clause 97. The method according to Clause 96 additionally comprising limiting the rudder angle based on a power output of the first outboard motor.

Clause 98. The method according to Clause 96 additionally comprising limiting the rudder angle based on a proportional relationship with a power output of the first outboard motor.

Clause 99. The method according to Clause 96 additionally comprising limiting the rudder angle based on a non-linear, proportional relationship with a power output of the first outboard motor.

Clause 100. The method according to Clause 96 additionally comprising limiting the rudder angle based on a throttle valve position of the first outboard motor.

Clause 101. The method according to Clause 96, switching, in response to receiving at least one signal from at least one of the throttle levers, to a mode of operation comprising adjusting rudder angles of the first and second outboard motors based on signals from the steering wheel and adjusting gear position and power output of the first and second outboard motors based on signals from the throttle levers.

What is claimed is:

1. A system for controlling a watercraft, the system comprising:

a left outboard motor on a port side of the watercraft;

a left steering actuator configured to change a left rudder angle of the left outboard motor;

a left gear shift actuator configured to change a gear position of the left outboard motor between at least a forward gear position and a neutral gear position;

a left motor output control actuator configured to adjust a power output of the left outboard motor between a first idle speed power operational mode and a first elevated speed power operational mode;

a right outboard motor on a starboard side of the watercraft;

a right steering actuator configured to change a right rudder angle of the right outboard motor;

a right gear shift actuator configured to change a gear position of the right outboard motor between at least a forward gear position and a neutral gear position;

a right motor output control actuator configured to adjust a power output of the right outboard motor between a second idle speed power operational mode and a second elevated speed power operational mode; and a controller in communication with the right and left outboard motors, the left and right steering actuators, the left and right gear shift actuators, and the left and right motor output control actuators, the controller configured to receive a zero propulsion signal, and a first range of sub-idle speed forward propulsion signals;

wherein the controller is configured to, in response to receiving the zero propulsion signal, control the left and right steering actuators to adjust the left and right rudder angles to be directly opposed to each other, control the left and right gear shift actuators to maintain the forward gear position, and control the left and right motor output control actuators to maintain the left and right outboard motors in the idle speed power operational mode, thereby substantially cancelling all thrust generated by the left and right outboard motors; and wherein the controller is configured to, in response to receiving a signal in the first range of forward propulsion signals, control the left and right steering actuators to adjust the left and right rudder angles to be non-parallel, directed partly toward each other and partly toward a forward direction of the watercraft, control the left and right shift actuators to maintain the forward gear position, and control the left and right motor output control actuators to maintain the left and right outboard motors in the idle speed power operational mode, thereby partly cancelling the thrust generated by the left and right outboard motors and generating a net forward thrust on the watercraft.

2. The system according to claim 1, wherein the controller is configured to, in response to receiving the forward idle speed propulsion signal, control the left and right steering actuators to adjust the left and right rudder angles to be substantially parallel, and toward the forward direction of the watercraft, control the left and right shift actuators to maintain the forward gear position, and to control the left and right motor output control actuators to maintain the left and right outboard motors in the idle speed power operational mode, thereby generating the net forward thrust on the watercraft so as to propel the watercraft at an idle speed.

3. The system according to claim 1, wherein the controller is configured to, in response to receiving any signal in a second range of super-idle speed forward propulsion signals, control the left and right steering actuators to adjust the left and right rudder angles to be substantially parallel and toward the forward direction of the watercraft, control the left and right shift actuators to maintain the forward gear position, and to control the left and right motor output control actuators to increase the output of the left and right outboard motors to thereby propel the watercraft at a super-idle speed.

4. The system according to claim 1, wherein the controller is further configured to, in response to receiving a clockwise position signal, control the left and right steering actuators to adjust the left and right rudder angles to be directly opposed to each other, control the left and right shift actuators to maintain the forward gear position, to control the left motor output control actuator to maintain the left outboard motor in the idle speed power operational mode, and to control the right motor output control actuator to increase the output of the right outboard motor to a greater than idle speed power operational mode, thereby creating a net leftward thrust and thereby rotating the watercraft in a clockwise direction.

5. The system according to claim 1, wherein the controller is further configured to, in response to receiving a combination of any signal in the first range of forward signals and a clockwise position signal, control the left and right steering actuators to adjust the left and right rudder angles to be asymmetric and such that the right rudder angle is directed more laterally and toward the left outboard motor and the left rudder angle is directed more toward the forward direction, thereby creating a net forward and leftward thrust and thereby propelling the watercraft in a forward direction while simultaneously rotating the watercraft in a clockwise direction.

6. The system according to claim 1, wherein the controller is further configured to, in response to receiving a combination of a clockwise position signal and the rightward lateral position signal, control the left and right steering actuators to adjust the left and right rudder angles to be asymmetric and such that the right rudder angle is directed at an angle of less than 150 degrees and directed in the rearward and rightward directions and such that the left rudder angle is directed at an angle of greater than 30 degrees and in the forward and rightward directions, thereby creating a net rightward lateral and counter-clockwise thrust, thereby propelling the watercraft in a rightward lateral direction while simultaneously rotating the watercraft in a counter-clockwise direction.

7. The system according to claim 1 additionally comprising a propulsion control joystick unit comprising:

a joystick mounted so as to be biased to a central default position, tiltable in a forward direction in a first forward range, a second forward range, and a third forward position between the first and second forward ranges, the joystick also being tiltable in a rearward direction in a first rearward range, a second rearward range, and a third rearward position between the first and second rearward ranges, the joystick also tiltable in a leftward lateral direction and in a rightward lateral direction, the joystick also mounted for twisting in a clockwise direction and in a counter-clockwise direction; and a joystick position sensor configured to detect and output position signals indicative of a position of the joystick, the output position signals comprising a default position signal in response to detecting the joystick being in the central default position, a first range of forward signals in response to the joystick being positioned in the first forward, a second range of forward signals in response to the joystick being positioned in the second forward range, a third forward position signal in response to the joystick being position in the third forward position, a first range of rearward signals in response to the joystick being positioned in the first rearward range, a second range of rearward signals in response to the joystick being positioned in the second rearward range, a third rearward position signal in response to the joystick being position in the third rearward position, a leftward lateral position signal in response to the joystick being tilted in the leftward lateral direction, a rightward lateral position signal in response to the joystick being tilted in the rightward lateral direction, a clockwise position signal in response to the joystick being twisted in the clockwise direction and a counter-clockwise position signal in response to the joystick being twisted in the counter-clockwise direction.

8. A system for controlling a watercraft, the system comprising:

a left outboard motor on a port side of the watercraft;

a right outboard motor on a starboard side of the watercraft; and a controller communicating with the right and left outboard motors, the controller configured to receive a zero propulsion signal and at least a first forward propulsion signal;

wherein the controller is configured to, in response to receiving the zero propulsion signal, control left and right rudder angles of the left and right outboard motors, respectively, to adjust the left and right rudder angles to be directly opposed to each other so that a front end of the left outboard motor faces a front end of a right outboard motor.

9. The system according to claim 8, wherein the controller, in response to receiving the zero propulsion signal, controls a gear position of the left and right outboard motors to maintain a forward gear position, and to control power output of both the left and right outboard motors to maintain an idle speed power operational mode, thereby substantially cancelling all thrust generated by the left and right outboard motors.

10. The system according to claim 8, wherein the controller is configured to, in response to receiving the first forward propulsion signal, control the left and right outboard motors to adjust the left and right rudder angles of the left and right outboard motors to be non-parallel, directed partly opposed and partly toward a forward direction of the watercraft, thereby partly cancelling the thrust generated by the left and right outboard motors and generating a net forward thrust on the watercraft.

11. The system according to claim 8, wherein the controller is configured to, in response to receiving the first forward propulsion signal, control gear positions of the left and right outboard motors to maintain a forward gear position, and to control the power output of both the left and right outboard motors to maintain an idle speed power operational mode.

12. The system according to claim 8, wherein the controller is further configured to receive a first range of sub-idle speed forward propulsion signals, a forward idle speed propulsion signal, a second range of super-idle speed forward propulsion signals, a clockwise rotation signal, and a counter-clockwise rotation signal.

13. The system according to claim 8 additionally comprising a left steering actuator configured to change a left rudder angle of the left outboard motor, a left gear shift actuator configured to change a gear position of the left outboard motor between at least a forward gear position and a neutral gear position, a left motor output control actuator configured to adjust a power output of the left outboard motor between first idle speed power operational mode and a first elevated speed power operational mode, a right steering actuator configured to change a right rudder angle of the right outboard motor, a right gear shift actuator configured to change a gear position of the right outboard motor between at least a forward gear position and a neutral gear position, and a right motor output control actuator configured to adjust a power output of the right outboard motor between second idle speed power operational mode and a second elevated speed power operational mode.

14. The system according to claim 13, wherein the controller communicates with the left and right steering actuators, the left and right gear shift actuators, and the left and right motor output control actuators.

15. The system according to claim 8, wherein the controller is configured to, in response to receiving a forward idle speed propulsion signal, control the left and right outboard motors to adjust the left and right rudder angles of the left and right outboard motors to be substantially parallel, and toward a forward direction of the watercraft, thereby generating a net forward thrust on the watercraft so as to propel the watercraft at an idle speed.

16. The system according to claim 8, wherein the controller is configured to, in response to receiving a super-idle speed forward propulsion signal, control the left and right outboard motors to adjust the left and right rudder angles of the left and right outboard motors to be substantially parallel and toward a forward direction of the watercraft, and to increase power output of the left and right outboard motors to thereby propel the watercraft at a super-idle speed.

17. The system according to claim 8, wherein the controller is further configured to, in response to receiving the clockwise position signal, control the left and right outboard motors to adjust the left and right rudder angles of the left and right outboard motors to be directly opposed to each other, to control a power output of the right outboard motor to a greater output than a power output of the left outboard motor, thereby creating a net leftward thrust and thereby rotating the watercraft in a clockwise direction.

18. The system according to claim 8, wherein the controller is further configured to, in response to receiving a combination of the first forward signal and a counter clockwise rotation signal, control the left and right rudder angles of the left and right outboard motors, respectively, to be asymmetric and such that the left rudder angle is directed more laterally and toward the right outboard motor and the right rudder angle is directed more toward the forward direction, thereby creating a net forward and counter clockwise torque and thereby propelling the watercraft in a forward direction while simultaneously rotating the watercraft in a counter clockwise direction.

19. The system according to claim 8, wherein the controller is further configured to, in response to receiving a combination of a counter-clockwise rotation signal and a rightward lateral position signal, control the left and right outboard motors to be in forward gear and to adjust the left and right rudder angles of the left and right outboard motors, respectively, such that the right rudder angle is directed in the rearward and rightward directions and that the left rudder angle is directed in the forward and rightward directions, wherein both rudder angles cross the longitudinal axis of the watercraft rearward of the center of pressure, thereby creating a net rightward lateral and counter-clockwise thrust, thereby propelling the watercraft in a rightward lateral direction while simultaneously rotating the watercraft in a counter-clockwise direction.

20. The system according to claim 8 additionally comprising a propulsion control joystick unit comprising:

a joystick mounted so as to be biased to a central default position, tiltable in a forward direction in a first forward range, a second forward range, and a third forward position between the first and second forward ranges, the joystick also being tiltable in a rearward direction in a first rearward range, a second rearward range, and a third rearward position between the first and second rearward ranges, the joystick also tiltable in a leftward lateral direction and in a rightward lateral direction, the joystick also mounted for twisting in a clockwise direction and in a counter-clockwise direction; and a joystick position sensor configured to detect and output position signals indicative of a position of the joystick, the output position signals comprising a default position signal in response to detecting the joystick being in the central default position, a first range of forward signals in response to the joystick being positioned in the first forward, a second range of forward signals in response to the joystick being positioned in the second forward range, a third forward position signal in response to the joystick being position in the third forward position, a first range of rearward signals in response to the joystick being positioned in the first rearward range, a second range of rearward signals in response to the joystick being positioned in the second rearward range, a third rearward position signal in response to the joystick being position in the third rearward position, a leftward lateral position signal in response to the joystick being tilted in the leftward lateral direction, a rightward lateral position signal in response to the joystick being tilted in the rightward lateral direction, a clockwise position signal in response to the joystick being twisted in the clockwise direction and a counter-clockwise position signal in response to the joystick being twisted in the counter-clockwise direction.

21. The system according to claim 20, wherein the controller is configured to, in response to receiving a reverse sub idle watercraft propulsion signal, adjust the left and right rudder angles of the left and right outboard motors to be non-parallel and directed partly opposed and partly toward a rearward direction of the watercraft, thereby partly cancelling the thrust generated by the left and right outboard motors and generating a net rearward thrust on the watercraft.

22. The system according to claim 20, wherein the controller is configured to, in response to receiving a reverse idle watercraft propulsion signal, adjust left and right rudder angles of the left and right outboard motors to be substantially parallel and directed toward a rearward direction of the watercraft, thereby generating a rearward thrust on the watercraft.

23. The system according to claim 20, wherein the controller is configured to, in response to receiving a reverse super idle watercraft propulsion signal, adjust the left and right rudder angles of the left and right outboard motors to be substantially parallel and directed toward a rearward direction of the watercraft, and to increase an output of the outboard motors to an output greater than idle operation.

24. The system according to claim 20, wherein the controller is configured to, in response to receiving a reverse watercraft propulsion signal, adjust the left and right rudder angles of the left and right outboard motors to be directed at least partly toward a rearward direction of the watercraft, and to control the gear position of the left and right outboard motors to a forward gear position.

25. The system according to claim 20, wherein the controller is configured to, in response to receiving a rightward lateral watercraft propulsion signal, adjust a rudder angle of the left outboard motor to be directed at a center of pressure of the watercraft and adjust a rudder angle of the right outboard motor to be directed aligned with and away from the center of pressure of the watercraft, with the left and right outboard motors in forward gear, to thereby generate a net rightward lateral thrust on the watercraft.

26. The system according to claim 20, wherein the controller is configured to, in response to receiving a leftward lateral watercraft propulsion signal, adjust a rudder angle of the left outboard motor to be aligned with and directed away from a center of pressure of the watercraft and adjust a rudder angle of the right outboard motor to be directed at the center of pressure of the watercraft, with the left and right outboard motors in forward gear, to thereby generate a net leftward lateral thrust on the watercraft.

27. The system according to claim 20, wherein the controller is configured to, in response to receiving a combination of a lateral watercraft propulsion signal and a forward watercraft propulsion signal, adjust a rudder angle of one of the left and right outboard motors to be aligned with and directed away from a center of pressure of the watercraft and adjust a rudder angle of the other of the left and right outboard motors to be directed at the center of pressure of the watercraft, and increase an output of the outboard motor that is directed at the center of pressure to be higher than an output of the other outboard motor, with the left and right outboard motors in forward gear, to thereby generate a net lateral and forward thrust on the watercraft.

28. A system for controlling a watercraft, the system comprising:

a left outboard motor on a port side of the watercraft;

a right outboard motor on a starboard side of the watercraft; and a controller communicating with the right and left outboard motors, the controller configured to receive a first forward propulsion signal;

wherein:

the controller is configured to, in response to receiving a first forward propulsion signal, control the left and right outboard motors to adjust left and right rudder angles of the left and right outboard motors to be non-parallel, directed partly opposed and partly toward a forward direction of the watercraft, thereby partly cancelling the thrust generated by the left and right outboard motors and generating a net forward thrust on the watercraft, wherein the net forward thrust results in a speed of the watercraft less than a maximum speed of the watercraft defined by the left and right outboard motors operating at idle speed with the rudder angles at 0 degrees; and the controller is configured to, in response to receiving a zero propulsion signal, control the left and right rudder angles of the left and right outboard motors, respectively, to adjust the left and right rudder angles to be directly opposed to each other.

29. The system according to claim 28, wherein the controller is configured to, in response to receiving a plurality of propulsion signals corresponding to a plurality of sub idle watercraft speeds, control the left and right outboard motors to adjust the left and right rudder angles to a range of angles in which the rudder angle of the left and right outboard motors are non-parallel, directed partly opposed and partly toward the forward direction of the watercraft, thereby partly cancelling the thrust generated by the left and right outboard motors and generating a net forward thrust in each of the plurality of sub idle watercraft speeds.

30. The system according to claim 28, wherein the controller, in response to receiving the zero propulsion signal, controls a gear position of the left and right outboard motors to maintain a forward gear position, and to control power output of both the left and right outboard motors to maintain an idle speed power operational mode, thereby substantially cancelling all thrust generated by the left and right outboard motors.

31. The system according to claim 28, wherein the controller is configured to, in response to receiving the first forward propulsion signal, control the left and right outboard motors to adjust the left and right rudder angles of the left and right outboard motors to be non-parallel, directed partly opposed and partly toward a forward direction of the watercraft, thereby partly cancelling the thrust generated by the left and right outboard motors and generating a net forward thrust on the watercraft.

32. The system according to claim 28, wherein the controller is configured to, in response to receiving the first forward propulsion signal, control gear positions of the left and right outboard motors to maintain a forward gear position, and to control the power output of both the left and right outboard motors to maintain an idle speed power operational mode.

33. The system according to claim 28, wherein the controller is further configured to receive a first range of sub-idle speed forward propulsion signals, a forward idle speed propulsion signal, a second range of super-idle speed forward propulsion signals, a clockwise rotation signal, and a counter-clockwise rotation signal.

34. The system according to claim 28 additionally comprising a left steering actuator configured to change a left rudder angle of the left outboard motor, a left gear shift actuator configured to change a gear position of the left outboard motor between at least a forward gear position and a neutral gear position, a left motor output control actuator configured to adjust a power output of the left outboard motor between first idle speed power operational mode and a first elevated speed power operational mode, a right steering actuator configured to change a right rudder angle of the right outboard motor, a right gear shift actuator configured to change a gear position of the right outboard motor between at least a forward gear position and a neutral gear position, and a right motor output control actuator configured to adjust a power output of the right outboard motor between second idle speed power operational mode and a second elevated speed power operational mode.

35. The system according to claim 34, wherein the controller communicates with the left and right steering actuators, the left and right gear shift actuators, and the left and right motor output control actuators.

36. The system according to claim 28, wherein the controller is configured to, in response to receiving a forward idle speed propulsion signal, control the left and right outboard motors to adjust the left and right rudder angles of the left and right outboard motors to be substantially parallel, and toward a forward direction of the watercraft, thereby generating a net forward thrust on the watercraft so as to propel the watercraft at an idle speed.

37. The system according to claim 28, wherein the controller is configured to, in response to receiving a super-idle speed forward propulsion signal, control the left and right outboard motors to adjust the left and right rudder angles of the left and right outboard motors to be substantially parallel and toward a forward direction of the watercraft, and to increase power output of the left and right outboard motors to thereby propel the watercraft at a super-idle speed.

38. The system according to claim 28, wherein the controller is further configured to, in response to receiving the clockwise position signal, control the left and right outboard motors to adjust the left and right rudder angles of the left and right outboard motors to be directly opposed to each other, to control a power output of the left outboard motor to maintain an idle speed power operational mode, and to control a power output of the right outboard motor to a greater than idle speed power operational mode, thereby creating a net leftward thrust and thereby rotating the watercraft in a clockwise direction.

39. The system according to claim 28, wherein the controller is further configured to, in response to receiving a combination of the first forward signal and a clockwise rotation signal, control the left and right rudder angles of the left and right outboard motors, respectively, to be asymmetric and such that the right rudder angle is directed more laterally and toward the left outboard motor and the left rudder angle is directed more toward the forward direction, thereby creating a net forward and leftward thrust and thereby propelling the watercraft in a forward direction while simultaneously rotating the watercraft in a clockwise direction.

40. The system according to claim 28, wherein the controller is further configured to, in response to receiving a combination of a clockwise rotation signal and a rightward lateral position signal, control the left and right outboard motors to adjust the left and right rudder angles of the left and right outboard motors, respectively, to be asymmetric and such that the right rudder angle is directed at an angle of less than 150 degrees and directed in the rearward and rightward directions and such that the left rudder angle is directed at an angle of greater than 30 degrees and in the forward and rightward directions, thereby creating a net rightward lateral and counter-clockwise thrust, thereby propelling the watercraft in a rightward lateral direction while simultaneously rotating the watercraft in a counter-clockwise direction.

41. The system according to claim 28 additionally comprising a propulsion control joystick unit comprising:

a joystick mounted so as to be biased to a central default position, tiltable in a forward direction in a first forward range, a second forward range, and a third forward position between the first and second forward ranges, the joystick also being tiltable in a rearward direction in a first rearward range, a second rearward range, and a third rearward position between the first and second rearward ranges, the joystick also tiltable in a leftward lateral direction and in a rightward lateral direction, the joystick also mounted for twisting in a clockwise direction and in a counter-clockwise direction; and a joystick position sensor configured to detect and output position signals indicative of a position of the joystick, the output position signals comprising a default position signal in response to detecting the joystick being in the central default position, a first range of forward signals in response to the joystick being positioned in the first forward, a second range of forward signals in response to the joystick being positioned in the second forward range, a third forward position signal in response to the joystick being position in the third forward position, a first range of rearward signals in response to the joystick being positioned in the first rearward range, a second range of rearward signals in response to the joystick being positioned in the second rearward range, a third rearward position signal in response to the joystick being position in the third rearward position, a leftward lateral position signal in response to the joystick being tilted in the leftward lateral direction, a rightward lateral position signal in response to the joystick being tilted in the rightward lateral direction, a clockwise position signal in response to the joystick being twisted in the clockwise direction and a counter-clockwise position signal in response to the joystick being twisted in the counter-clockwise direction.

42. The system according to claim 41, wherein the controller is further configured to detect tap inputs into the joystick, and in response to detecting a series of tap inputs to the joystick in the forward direction, to control the control the left and right steering actuators to adjust the left and right rudder angles in a range of different predetermined positions in which the left and right rudder angles are directed partially toward each other and partially toward the forward direction of the watercraft, thereby generating a corresponding plurality of different magnitudes of net forward thrust to propel the watercraft at a corresponding plurality of different watercraft speeds.

43. The system according to claim 28 additionally comprising a joystick mounted to be moveable in at least forward and rearward directions and connected to the controller, wherein the controller is further configured to detect tap inputs into the joystick, and in response to detecting a series of tap inputs to the joystick in the forward direction, to control the control the left and right steering actuators to adjust the left and right rudder angles in a range of different predetermined positions in which the left and right rudder angles are directed partially toward each other and partially toward the forward direction of the watercraft, thereby generating a corresponding plurality of different magnitudes of net forward thrust to propel the watercraft at a corresponding plurality of different watercraft speeds.

* * * * *